US006369781B2

(12) United States Patent
Hashimoto et al.

(10) Patent No.: US 6,369,781 B2
(45) **Date of Patent: *Apr. 9, 2002**

(54) METHOD OF DRIVING PLASMA DISPLAY PANEL

(75) Inventors: Takashi Hashimoto; Akihiko Iwata, both of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,563

(22) Filed: Oct. 1, 1998

(30) Foreign Application Priority Data

Oct. 3, 1997 (JP) ..... 9-271458
Nov. 12, 1997 (JP) ..... 9-310432
Mar. 30, 1998 (JP) ..... 10-083962

(51) Int. Cl.[7] ..... G09G 3/28
(52) U.S. Cl. ..... 345/60; 345/63; 315/169.4

(58) Field of Search ..... 345/60, 63, 66, 345/67, 68; 315/169.4; 313/584, 585, 586

(56) References Cited

U.S. PATENT DOCUMENTS 5,677,600 A * 10/1997 Takahashi et al. ..... 315/169.4
5,818,175 A * 10/1998 Yoshioka et al. ..... 315/169.4
5,920,295 A * 7/1999 Takahashi et al. ..... 345/60
5,952,986 A * 9/1999 Nguyen et al. ..... 345/68
6,034,482 A * 3/2000 Kanazawa et al. ..... 315/169.4

OTHER PUBLICATIONS

"The State of the Art in Plasma Display", p. 70, 1.4 to p. 71, 1.8), with English translation of an extract.

* cited by examiner

*Primary Examiner*—Bipin Shalwala
*Assistant Examiner*—Ricardo Osorio

(57) ABSTRACT

A sustain discharge which is performed a specified number of times to obtain a predetermined luminance includes a first discharge mainly induced by externally-applied voltage and a second discharge mainly induced by wall charges, and an assistant pulse is applied in a direction to increase the second discharge. That allows an improvement in efficiency of an AC-PDP.

10 Claims, 30 Drawing Sheets

COLUMN ELECTRODE Wj 0
Pwp
Awp
Awp

ROW ELECTRODE Xi 0
Pxp
Sp
Sp

ROW ELECTRODE Yi 0
Scyp
Scyp
RESET PERIOD
ADDRESSING PERIOD
SUSTAIN DISCHARGE PERIOD
SUB-FIELD 1
ADDRESSING PERIOD
SUSTAIN DISCHARGE PERIOD
SUB-FIELD 2

1.6μsec OR LESS

Y GND

300nsec
OR LESS
X GND
1μsec OR MORE

LIGHT-EMITTING
WAVEFORM

VOLTAGE WAVEFORM AND LIGHT-EMIIITNG WAVEFORM IN SELF-ERASE DISCHARGE

VOLTAGE WAVEFORM AND LIGHT-EMITTING WAVEFORM IN SUPPLY OF ASSISTANT PULSE FOR SELF-ERASE DISCHARGE

LISSAJOUS FIGURE IN SELF-ERASE DISCHARGE

LISSAJOUS FIGURE IN SUPPLY OF ASSISTANT PULSE FOR SELF-ERASE DISCHARGE

FIG. 10
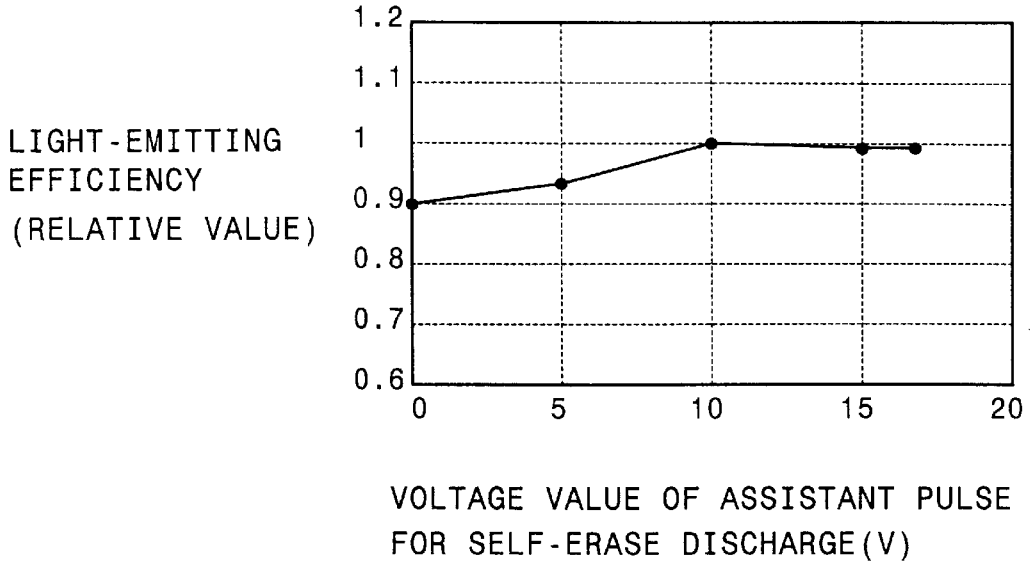
FIG. 11A
FIG. 11B
FIG. 11C
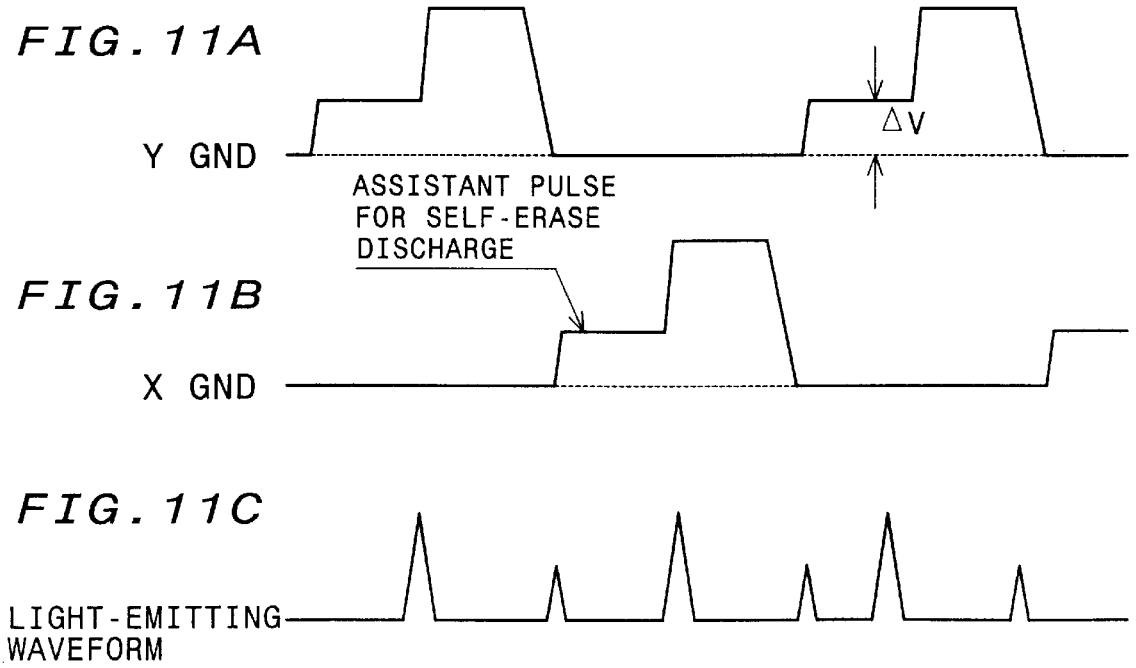

COLUMN ELECTRODE Wj 0
Pwp
Awp
Awp

ROW ELECTRODE Xi 0
Pxp
Sp

ROW ELECTRODE Yi 0
Scyp
Sp
Scyp
RESET PERIOD
ADDRESSING PERIOD
SUSTAIN DISCHARGE PERIOD
SUB-FIELD 1
ADDRESSING PERIOD
SUSTAIN DISCHARGE PERIOD
SUB-FIELD 2

<PRIOR ART>

<PRIOR ART>

COLUMN ELECTRODE Wj 0
Pwp
Awp
Awp

ROW ELECTRODE Xi 0
Pxp
Subp1
Exp

ROW ELECTRODE Yi 0
Scyp
Sp
Subp2
Scyp
RESET PERIOD
ADDRESSING PERIOD
SUSTAIN DISCHARGE PERIOD
ADDRESSING PERIOD
SUB-FIELD
SUB-FIELD
GROUP OF FIRST ASSISTANT PULSES
GROUP OF SECOND ASSISTANT PULSES

SUS1 PERIOD

SUS2 PERIOD

SUS3 PERIOD
Vw
Vwj 0
Vyj 0
Vxj 0
Vs
Vs
Wj
Xi
Yi
9C
6C (6AC)

COLUMN
ELECTRODE Wj
Vs/2
0
FULL-SCREEN WRITE PULSE

ROW ELECTRODE Y
Vs
0
SUSTAIN PULSE

ROW ELECTRODE X1
Vs
0
SCAN
PULSE

ROW ELECTRODE X2
Vs
0

ROW ELECTRODE Xn
Vs
0
TIME
RESET
PERIOD
ADDRESSING
PERIOD
SUSTAIN
DISCHARGE
PERIOD
(DISPLAY
PERIOD)
1 SUB-FIELD

METHOD OF DRIVING PLASMA DISPLAY PANEL

BACKGROUND OF THE INVENTION

1. Field of the Invention

The present invention relates to a surface-discharge type AC plasma display panel (hereinafter, referred to as "AC-PDP"), and more particularly to a method of driving the AC-PDP and a driving circuit therefor.

2. Description of the Background Art

A variety of studies has been made in a field of PDP (Plasma Display Panel) used as a slim television or display monitor. One of AC-PDPs having a memory function is a surface-discharge type AC-PDP, and structure and driving method of the PDP will be discussed below with reference to FIGS. 32 and 33A to 33E.

FIG. 32 is a perspective view showing a structure of a surface-discharge type AC-PDP in the prior art, and the surface-discharge type AC-PDP having this structure is disclosed in Japanese Patent Application Laid Open Gazettes 7-140922 and 7-287548. In FIG. 32, a surface-discharge type AC-PDP 101C comprises a front glass substrate 102C serving as a display surface and a rear glass substrate 103C opposed to the front glass substrate 102C with a discharge space therebetween. On a surface of the front glass substrate 102C on the side of the discharge space, n first electrodes 104C and n second electrodes 105C are extendedly provided in pairs. As shown in FIG. 32, when the first and second electrodes 104C and 105C have metal assistant electrodes (bus electrodes) on part of their surfaces, respective electrodes including the metal assistant electrodes may be termed "a first electrode 104C" and "a second electrode 105C". Further, the first and second electrodes 104C and 105C are also termed row electrodes 104C and 105C, respectively. In the AC-PDP 101C, a dielectric layer 106C is so provided as to cover the row electrodes 104C and 105C. In some cases, as shown in FIG. 32, an MgO film 107C made of MgO (magnesium oxide) which is a dielectric is formed by evaporation on a surface of the dielectric layer 106C. In this case, the dielectric layer 106C and the MgO film 107C are termed "dielectric layer 106AC" as a unit.

On a surface of the rear glass substrate 103C on the side of the discharge space, m third electrodes 108C (hereinafter, referred to as "column electrode 108C") are so provided extendedly as to cross the row electrodes 104C and 105C. Between adjacent column electrodes 108C, a barrier 110C is extendedly provided in parallel to the column electrodes 108C. The barrier 110C separates discharge cells and works as a pole for supporting the PDP lest the PDP should be broken by atmospheric pressure. On a surface of the column electrode 108C and a side-wall surface of the barrier 110C, phosphor layers 109C for emitting red, green and blue lights are provided orderly in stripes.

The front glass substrate 102C and the rear glass substrate 103C having the above structure are sealed to each other, and in a space between these glass substrates 102C and 103C, a discharge gas such as an Ne—Xe mixed gas and He—Xe mixed gas is enclosed by a pressure not more than atmospheric pressure. In the surface-discharge type AC-PDP 101C having this structure, the discharge space comparted by the row electrodes 104C and 105C in a pair and the column electrodes 108C is a discharge cell for the PDP 101C, i.e., a pixel.

Next, a principle of a display operation of the above prior-art PDP will be discussed.

First, a voltage pulse is applied to the row electrodes 104C and 105C to cause a discharge. An ultraviolet ray generated by this discharge excites the phosphor layer 109C, to cause the discharge cell to emit. In this discharge, electrons and ions generated in the discharge space move to the row electrodes 104C and 105C of reverse polarity and are stacked on a surface of the dielectric layer 106AC on the row electrodes 104C and 105C. The electrons and ions stacked on the surface of the dielectric layer 106AC are termed "wall charges". The amount of wall charges depend on an externally-applied voltage value and therefore a potential of the wall charges can not exceed the externally-applied voltage value.

An electric field induced by the wall charges works to weaken an applied electric field and therefore the discharge rapidly disappears as the wall charges are generated. After the discharge disappears, when a voltage pulse of reverse polarity is applied between the row electrodes 104C and 105C, a discharge occurs again since an electric field in which the applied electric field and the electric field induced by the wall charges are superposed is substantially applied in the discharge space. Thus, once a discharge occurs, successive discharge can be caused by applying an applied voltage (hereinafter, referred to as "sustain voltage") lower than the voltage at the time when the discharge starts. Therefore, applying the sustain voltage (hereinafter, referred to also as "sustain pulse") between the row electrodes 104C and 105C with its polarity reversed alternately makes it possible to stationarily sustain the discharge. Hereinafter, the discharge is referred to as "sustain discharge".

The sustain discharge can be kept as far as the sustain pulse is applied until the wall charges disappear. Extinguishing the wall charges is referred to as "erase" and generating the wall charges on the dielectric layers 106AC (MgO film 107C) in the initial stage of the discharge is referred to as "write". With respect to any cell in a screen of the AC-PDP, write is first performed, and thereafter the sustain discharge is performed, to display characters, figures and images. Performing quick operation of the write, sustain discharge and erase allows display of motion pictures.

According to the above principle of operation, in the discharge on the rise of the applied pulse, the effective voltage consists mainly of the externally-applied voltage and supplementally of the wall charges. Therefore, this discharge is termed "discharge mainly induced by externally-applied voltage".

On the other hand, if the externally-applied voltage is very high, in some times, the wall charges produce a potential not less than the firing voltage. In this case, on the fall of the applied pulse, the discharge can occur only by the wall charges. The discharge with no voltage externally applied is referred to as "self-erase discharge". Since the effective voltage of the discharge is given mainly by the wall charges, the discharge is referred to as "discharge mainly induced by wall charges". Since the externally-applied voltage may be supplementally applied in a direction to increase the discharge in the discharge mainly induced by wall charges, the definition of "discharge mainly induced by wall charges" herein includes the discharge with the supply of the external voltage.

When the AC-PDP is driven by using both the "discharge mainly induced by externally-applied voltage" and the "discharge mainly induced by wall charges", since the wall charges are reduced after termination of the discharge mainly induced by wall charges, in order to subsequently cause the discharge main induced by externally-applied voltage, it is necessary to (i) apply higher externally-applied voltage or (ii) apply the externally-applied voltage in a state where the firing voltage is lowered by the space charges generated in the discharge mainly induced by wall charges. Especially, the case (ii), i.e., the driving method using the pulse memory effect can lower a current density per one discharge, and can thereby improve a discharge efficiency and reduce a peak current value. Further, the discharge mainly induced by wall charges ends with a certain amount of wall charges according to the discharge characteristics of the cell even if a voltage variation exists in the panel. Hence, when the discharge mainly induced by externally-applied voltage is subsequently caused, it is possible to uniform the light-emitting intensity. Therefore, by the driving method of (ii), it is possible to prevent variation in luminance of the panel surface.

Next, a prior-art method of driving a PDP will be specifically discussed with reference to FIGS. 33A to 33E.

One of methods of driving the prior-art AC-PDP 101C (see FIG. 32) is, for example, a driving method in accordance with a prior-art ① disclosed in Japanese Patent Application Laid Open Gazette 7-160218. FIGS. 33A to 33E are timing charts showing driving waveforms of one sub-field period in the driving method. In the following discussion, each of the n row electrodes 104C is termed "row electrode Xi" (i: 1 to n) and the row electrodes X1 to Xn are termed "row electrode X" as a single unit. Each of the n row electrodes 105C is termed "row electrode Yk" (k: 1 to n) and the row electrodes Y1 to Yn are termed "row electrode Y" as a single unit driven by a single driving signal. Each of the m column electrodes 108C is termed "column electrode Wj" (j: 1 to m) and the column electrodes W1 to Wm are termed "column electrode W" as a single unit.

The sub-field (SF) of FIGS. 33A to 33E is one of a plurality of periods into which one frame (F) for image display are divided, and the sub-field is further divided into three periods, i.e., "reset period", "addressing period" and "sustain discharge period (display period)".

In the "reset period", a display history is erased at the ending point of immediately preceding sub-field and priming particles are supplied to increase a discharge probability in the following addressing period. Specifically, a full-screen write pulse of the voltage value that can cause the self-erase discharge on the fall is applied between the row electrode X and the row electrode Y, to erase the display history.

Subsequently, in the "addressing period", a discharge is made in only a cell to be lighted by matrix selection, to perform a write in the cell. Specifically, as shown in FIGS. 33A to 33E, a scan pulse is sequentially applied to the row electrode Xi and an "addressing discharge" which is a write discharge is established between the column electrode Wj and the row electrode Xi in a cell to be lighted. With this discharge as a trigger, a discharge is immediately established between the row electrodes Xi and Yi. At this time, positive or negative wall charges are stacked on the surface of the dielectric layer 106AC (see FIG. 32) of this cell up to the amount sufficient to cause the sustain discharge only by applying the sustain pulse later, as discussed above. On the other hand, in a cell being off, no discharge is established between the row electrodes Xi and Yi lest the addressing discharge should be caused and naturally no wall charge is stacked.

In the "sustain discharge period", applying the sustain pulse between the row electrodes X and Y keeps the sustain discharge of the cell in which a write is made.

In the above prior-art ① adopted is a driving method in which, assuming that the voltage value of the sustain pulse is Vs, a potential of the column electrode W is set to Vs/2. This method is used for starting a stable sustain discharge at the transition from the addressing period to the sustain discharge period. This will be discussed below.

In the driving method of FIGS. 33A to 33E, at the ending point of the addressing period, the negative wall charges are stacked on the sides of the column electrode W and the row electrode Y and the positive wall charges are stacked on the side of the row electrode X. In this state, if the potential of the column electrode Wj during the sustain discharge period is set to 0 V, when the first sustain pulse of the sustain discharge period is applied, a discharge induced by a potential of the wall charges on the sides of the column electrode Wj and the row electrode Xi starts before the sustain discharge is established between the row electrodes Xi and Yi. In this case, there is a possibility of no sustain discharge between the row electrodes Xi and Yi. To avoid this situation, in the prior art ①, the potential of each column electrode Wj is set to Vs/2 to cancel the electric field induced by the wall charges on the side of the column electrode Wj.

Also in the prior art ①, it is suggested that the potential of the column electrode Wj is set to Vs/2 only when the first pulse of the sustain discharge period is applied, and then an output end of the driving circuit of the column electrode Wj is brought into a high impedance. In this case, at the initial stage of the sustain discharge period, the sustain discharge can be stably started and then the power to keep an output of the driving circuit of the column electrode Wj to the potential Vs/2 can be reduced, and therefore it is possible to achieve lower power consumption of the driving circuit. Further, there may be another driving method where the output end of the driving circuit of the column electrode Wj is brought into a high impedance before applying the first sustain pulse, to reduce the amount of wall charges to be stacked on the side of the column electrode Wj during the sustain discharge.

These driving methods, which reduce the ions that fly to the side of the column electrode Wj in the sustain discharge, can also produce an effect of preventing deterioration of the phosphor layer due to ion impact and the like.

As to a gradation display on the AC-PDP, one of the driving methods using a plurality of sub-fields into which one frame is divided as above, known is a method to perform the gradation display by changing the number of sustain pulses in each sub-field into, for example, binary. For example, when the binary is weighted with n sub-fields, $2^n$-step gradation is achieved.

Though the AC-PDP of FIG. 32 has a structure to extract a display light (visible light) from the side of the front glass substrate 102C, there may be a structure to extract the display light from the rear glass substrate 103C as shown in FIG. 14.

The prior-art method of driving the surface-discharge type AC-PDP, however, has problems of not sufficiently satisfying a requirement of resolving instability of discharge for further improvement in display quality.

(Problem 1)

First, studying improvement of display quality from the viewpoint of the gradation display, there arises the following problem.

The prior-art method of driving the AC-PDP has a problem that a precise gradation display can not be made, in other words, a precise linearity of gradation display can not be achieved, due to very small light emission such as a full-screen erase discharge during the reset period and the addressing discharge (write discharge) during the addressing period. In a prior-art sub-field gradation for 256-level gradation display, since the very small emitted light in each sub-field is added to the emitted light in the sustain discharge, the obtained gradation varies from the desired precise gradation display.

To resolve this problem, it is considered possible in the prior-art driving method that the number of gradation levels is increased by increasing the number of sub-fields in one frame, to make a fine tune of gradation display. When a TV image display is made, for example, however, it is actually difficult to provide a lot of sub-fields in a limited time since the AC-PDP must be driven to complete the display of one image in one field period (16.6 msec), and naturally the number of gradation levels is limited. In the high definition AC-PDP which has increased number of display lines, particularly, it becomes more difficult to increase the number of gradation levels as the number of display lines increases. Therefore, the prior-art driving method has a problem that it is impossible to improve the display quality of the PDP as the precise linearity of gradation display can not be made.

To solve this problem, one of methods of fine tuning of gradation display is a prior art ② suggested in Japanese Patent Application Laid Open Gazettes 8-314405. The prior art ② suggests a driving method in which the number of discharges is controlled by controlling the width of sustain pulse to give a range of gradation display. Specifically, the driving method controls the number of discharges mainly induced by wall charges on the fall of the sustain pulse. The method is based on a fact that when the width of the sustain pulse is small, no self-erase discharge occurs on the fall of the sustain pulse since sufficient wall charges can not be stacked in a voltage supply period, and when the width of the sustain pulse is sufficiently large, a self-erase discharge can occur since sufficient wall charges can be stacked. If the pulse width can be controlled, however, it is difficult to precisely control the discharge by controlling the pulse width in consideration of "time lag of discharge" in the discharge phenomenon.

The above concept, "time lag of discharge", includes "statistic time lag" representing a time period from a pulse supply to a start of discharge and "formative time lag" representing a time period from the start of the discharge to the end thereof.

One of other methods of fine tune of gradation display is a prior art ③ suggested in Japanese Patent Application Laid Open Gazettes 7-44127. The prior art ③ suggests a driving method using two or more voltage values of sustain pulse according to a display rate, to solve a problem of imprecise gradation display because of deterioration in luminance caused by a voltage drop due to the display rate. Specifically, the driving method is intended to precisely obtain the gradation display that should be originally achieved by providing means for detecting the display rate and means for controlling the potential difference according to the display rate. The prior art ③ seems to be effective for high-definition PDP having a large number of display lines, but has problems of complicate circuit configuration and higher cost when two or more power supplies are provided for supplying a sustain voltage.

(Problem 2)

Next discussion will be made on deterioration in display quality caused by disappearance of the sustain discharge.

As discussed above, even if only the discharge mainly induced by externally-applied voltage is performed as the sustain discharge, since a discharge occurs between the row electrode and the column electrode, not the desired surface discharge between the row electrodes, in the initial stage of the sustain discharge period where few space charges exist, there arises a problem that the sustain discharge becomes unstable and then disappears.

Since it is impossible to obtain the desired luminance if the disappearance of the discharge can not be prevented, there arises a problem of imprecise display of image in the AC-PDP.

(Problem 3)

Further, the prior art ② suggests a driving method in which one frame is divided into seven sub-fields and both the discharge mainly induced by externally-applied voltage and the discharge mainly induced by wall charges are used during the sustain discharge period in the fifth to seventh sub-fields. The driving method, however, has a problem that the discharge intermits when the discharge mainly induced by externally-applied voltage and the discharge mainly induced by wall charges are sequentially performed. The reason of this phenomenon is considered as follows. When the discharge mainly induced by wall charges is performed with an increased amount of wall charges caused by the discharge mainly induced by externally-applied voltage, the discharge becomes so large that the wall charges decrease more than needed. Therefore, in the following stage for discharge mainly induced by externally-applied voltage, the discharge can not start due to lack of the necessary amount of wall charges. Further, when a series of discharges are caused with a small amount of space charges, such as in the initial stage of the sustain discharge, the problem of intermittence of the discharge becomes more pronounced.

Since it is impossible to obtain the desired luminance if the intermittence of the discharge can not be prevented, there arises a problem of imprecise display of image in the AC-PDP.

The above problems 1 to 3 are shackles against the requirement of further improvement in display quality through stable discharge and the above requirement can not be properly satisfied without solving the problems 1 to 3.

The charged particles (referring herein to electrons, ions and excited particles) generated in the discharge space have effects of increasing the discharge probability and lowering the firing voltage of the next discharge. In a DC-PDP, as disclosed in Japanese Patent Application Laid Open Gazette 1-274339, for example, an assistant discharge cell is provided adjacently to a display cell, where an assistant discharge is established, to lower a write voltage of the display cell and increase the discharge probability. Since the sustain discharge occurs immediately after the write discharge, it becomes possible to produce a discharge with a lower applied voltage as the firing voltage is lowered due to existence of the charged particles. To stop the discharge, it is necessary only to provide an idle period of the sustain pulse enough to extinguish the charged particles and not necessary to perform the erase operation to extinguish the wall charges like in the AC-PDP. The lifetime of the charged particles is about 10 $\mu$sec to 20 $\mu$sec, though the lifetime depends on the pressure of filled gas, the kind of gas and the cell structure. Such a memory function of the DC-PDP using the charged particles is referred to as pulse memory function (effect).

FIG. 15 is a timing chart showing voltage waveforms of one sub-field in the prior-art method of driving the plasma display panel disclosed in Japanese Patent Application Laid Open Gazette 7-160218 (the prior art ①). One sub-field consists of the reset period for erasing the display history, the addressing period for selecting a cell to be lighted and the sustain discharge period (display period) performed a specified number of times to obtain a predetermined luminance. FIG. 15 shows the waveforms of voltages applied to a column electrode Wj (j: 1 to m), a first row electrode Xi (i: 1 to n) and second row electrodes Y1, Y2 and Yn in this order from above.

In the reset period, first, a full-screen write pulse Pxp is applied to the first row electrodes X1 to Xn connected in common to the full screen at a time a of FIG. 15. The full-screen write pulse Pxp is referred to as a "priming pulse". Since the full-screen write pulse Pxp is set not less than the firing voltage between the first and second row electrodes Xi and Yi and applied for a sufficiently long time (or a sufficiently large pulse width) of about 10 $\mu$sec, all the cells are discharged to emit a light, regardless of emission or non-emission in the preceding sub-field. Though a voltage pulse Pwp is applied to the column electrode Wj at this time. This is intended to reduce a potential difference between the first row electrode X and the column electrode W so that it may become hard to cause a discharge between the electrodes X and W. The voltage pulse Pwp is set to half of the voltage across the electrodes X and W. When the full-screen write pulse Pxp is applied, a strong discharge occurs between the electrodes Xi and Yi and ends with a large amount of wall charges stacked therebetween. Subsequently, when the full-screen write pulse Pxp falls at a time b of FIG. 15 and no voltage is applied between the first row electrode X and the second row electrode Y, an electric field is generated by the wall charges stacked by that full-screen write pulse Pxp between the electrodes X and Y. Since the electric field exceeds (is larger than) the firing voltage, the self-erase discharge occurs to extinguish the wall charges.

Thus, all the cells are written and then erased, regardless of whether there are any wall charges or no wall charge, to have no wall charge, being reset.

After the reset period, at a time c of FIG. 15, few negative electric charges are left on the first row electrode X and few positive electric charges are left on the second row electrode Y The amount of left electric charges depends on the characteristics of a cell, and specifically a small amount of wall charges are left on a cell having a low firing voltage (easy to light) and a large amount of wall charges are left on a cell having a high firing voltage (difficult to light). This works in a converse direction to relieve variation of the cells in the next light emission. Further, in the discharge space left are a slight amount of charged particles generated through the discharge by the preceding full-screen write pulse Pxp. The charged particles no longer have the effect of lowering the firing voltage and work to ensure a discharge in the next write. In other words, this serves as a priming for the write discharge. This is the reason why the full-screen write pulse Pxp is referred to as a priming pulse. Therefore, this method using a pulse which has both the priming effect and the erasing effect and further has a "self-control function" that relieves the variation of the cells after the erase, is a rather good one for a stable operation of the plasma display panel. Further, since the priming effect has a time constant of several msec, by applying the full-screen write pulse Pxp every several sub-fields and an erase pulse having a narrow width or low voltage value to the remaining sub-fields, only cells lighted in the preceding sub-field may be discharged and erased. The Japanese Patent Application Laid Open Gazette 8-278766 discloses a method utilizing a fact that the cells have different time lags of discharge depending on whether lighted or not in the preceding sub-field, specifically, a method of applying a pulse having the same voltage as the priming pulse and narrower width to reduce the number of full-screen light emissions, thereby improving a contrast.

In the addressing period, a negative scan pulse Scyp is sequentially applied to the second row electrodes Y1 to Yn independently of on another to make a scan. On the other hand, a positive addressing pulse Awp according to image data is applied to the row electrode Wj. With the scan pulse Scyp applied to the second row electrodes Yi and the addressing pulse Awp applied to the column electrode Wj, a predetermined cell on the screen can be selected by matrix. Since the total voltage value of the scan pulse Scyp and the addressing pulse Awp is set not less than the firing voltage between the electrodes Y and W of the cell, a discharge occurs between the electrodes Yi and Wj in the cell to which the scan pulse Scyp and the addressing pulse Awp are simultaneously applied. Further, in the addressing period, the first row electrode X (all the first row electrodes X1 to Xn) is kept positive in voltage value. This voltage value is so set as not to cause any discharge between the electrodes X and Y even together with the voltage value of the scan pulse Scyp but as to cause a discharge between the electrodes X and Y when a discharge occurs between the electrodes Y and W, with this discharge as a trigger. The discharge between the electrodes X and Y using the discharge between the electrodes Y and W as a trigger is referred to as "write sustain discharge". The write sustain discharge causes the wall charges to be stacked on the first and second row electrodes X and Y.

After a full-screen scan in the addressing period, the sustain pulse Sp is applied to the full screen and the sustain discharge is caused only in the cells which are selected in the addressing period and on which the wall charges are stacked. In the next sub-field, the full-screen write pulse Pxp is applied to all the cells in the reset period, to perform a reset.

Such a driving method as above separating a sub-field into the addressing period and the sustain discharge period for image display on the whole screen of the AC-PDP is termed "addressing/sustain separation method", which is a general and well-known technique.

Next, an efficiency of the AC-PDP will be discussed. FIG. 16 is a graph of a relation between a current density and a light-emitting efficiency shown in "The State of The Art in Plasma Display " (by Shigeo Mikoshiba, ED Research, issued in 1996). As shown in FIG. 16, it is well known that the efficiency rises as the current density falls. As a method of lowering the current density known are a method of reducing a driving voltage and that of forcedly falling an externally-applied voltage before the discharge ends (flow of a discharge current is completed). As the former known is a method disclosed in, for example, Japanese Patent Application Laid Open Gazette 3-219528 (see FIGS. 17A and 17B), which uses an assistant electrode 102A before a main electrode 104A and reduces a voltage of the main electrode 104A by using the discharge of the assistant electrode 102A as a trigger. The latter is termed Townsend discharge. In Japanese Patent Application Laid Open Gazette 7-134565, for example, after stabilizing the discharge by increasing the width of only the first pulse in the sustain discharge period, pulses having a very small width, from the second pulse, are applied and fallen before the discharge current is finished, to lower the current density. Further, other than these methods, it may be considered that the self-erase discharge is caused to reduce the wall charges and lower the effective voltage (applied voltage and wall charges). FIG. 18 illustrates a relation between an externally-applied voltage and a light-emitting efficiency. Though the voltage value differs depending on the panel structure, the filled gas and the kind of gas, the PDP having a structure where electrodes are covered with a dielectric obtains the same characteristics line qualitatively. It can be seen that the efficiency falls on the low-voltage side and the efficiency conversely rises on the high-voltage side as the voltage rises. The rise on the high-voltage side is an area where the self-erase occurs.

One of the driving methods using the self-erase discharge in the sustain discharge period is disclosed in, for example, Japanese Patent Application Laid Open Gazette 8-314405. FIG. 24 shows voltage waveforms in this method. This method is used in a stationary state where the firing voltage is not influenced by the charged particles, in which sufficient wall charges higher in voltage than the firing voltage are stacked in the voltage supply period and an interval between consecutive pulses (hereinafter, referred to as "idle period") in the sustain discharge period is brought into a ground potential, to cause the self-erase discharge during the idle period. This method has a characteristic feature that the charged particles are not drawn to the display electrode because of no externally-applied voltage in the idle period, and as a result, there is no ion bombardment and the number of light emission is twice the number of voltage supply. Further, this self-erase discharge does not occur when the pulse width is narrowed to reduce the amount of stacked wall charges nor when the applied voltage is lowered. Thus, controlling the self-erase discharge is helpful for the gradation display.

To enhance the efficiency through improvement of the driving method, it is necessary to use the voltage near the lower limit or upper limit of the margin as shown in FIG. 18. There is a possibility of a problem that a cell which should be lighted can not be lighted in the low-voltage area and a cell which should not be lighted is lighted in the high-voltage (self-erase) area. Considering actual mass productivity of the PDP, to produce a panel having a wide margin (good yield), it is necessary to select the voltage near an intermediate as the operating point, using an area with very poor efficiency.

Furthermore, the self-erase discharge produced by applying a high-voltage pulse, which is high in voltage, causes not only between the electrodes X and Y but also between the electrode W and the electrode X or Y Without the self-erase discharge, even if the discharge between the electrode W and the electrode X or Y is once established, an AC driving can not be achieved as the wall charges on the electrode W work as a mask. Therefore, no discharge occurs again. When the self-erase discharge is used, the wall charges generated by the discharge between the electrode W and the electrode X or Y on the rise induce another discharge on the fall and disappear, sustaining the discharge. The discharge between the electrode W and the electrode X or Y causes not only wrong addressing but also deterioration of the phosphor caused by using it as a cathode (causing a sputter).

The high-voltage driving further has a problem of increasing a circuit loss (power loss) which is in proportion to the square of the voltage relative to a capacitive load like the PDP.

Even if it is intended to actively use the self-erase discharge, since the electrode has the ground potential in the idle period, the discharge taking place on the fall of the applied pulse is induced only by the wall charges and therefore the magnitude of the discharge is necessarily limited.

The prior-art driving method of achieving a high contrast also has a problem. To achieve a high contrast, as discussed earlier, for example, a full-screen light emission is made every several sub-fields, and a cell lighted in the preceding sub-field is lighted and erased in each of the remaining sub-fields. In this case, if the "self-control function" of the self-erase discharge is used, it is necessary to narrow the pulse width. At this time, because of a small margin of the pulse width, a cell not lighted in the preceding sub-field is lighted even if the pulse width slightly exceeds the margin. Further, in some cells that produce an incomplete discharge, the discharge ends before the wall charges enough to perform the self-erase are stacked, to cause a wrong discharge. If the erase without the self-erase discharge (e.g., narrow-width erase) is made, there is a difference in a state of residual wall charges between the sub-field in which a full-screen light emission is made and the sub-field in which it isn't made, and the sub-fields thereby have different margins.

FIG. 25 is a chart showing a prior-art driving method disclosed in Japanese Patent Application Laid Open Gazette 7-134565, where the assistant discharge is established before the sustain discharge. This uses the "addressing/sustain separation method". This method pays attention to the fact that the early stage of the sustain discharge is unstable in a cell having a long time from the end of addressing discharge to the start of sustain discharge, provides the assistant discharge before the sustain discharge. Specifically, considering the time lag of discharge, a pulse immediately before the sustain discharge is set to have a sufficiently large pulse width or a high voltage.

When the discharge mainly induced by wall charges (a second discharge) on the fall of the pulse is used for the sustain discharge, there arises a problem that it becomes hard to cause the next sustain discharge as the wall charges decrease as compared with the sustain discharge using only the discharge mainly induced by externally-applied voltage (a first discharge). In the early stage of the sustain discharge, particularly, the discharge once occurs and then disappears because of few space charges. That needs an unnecessary high sustain voltage and further narrows a voltage margin necessary for stable discharge.

Furthermore, since the last stage of the sustain discharge is mainly induced by wall charges, there arises a problem that it is hard to cause the next erase pulse as there are few wall charges in this state.

SUMMARY OF THE INVENTION

The present invention is directed to a method of driving a plasma display panel.

According to a first aspect of the present invention, in the method of driving the plasma display panel which comprises first and second electrodes both covered with dielectric and a third electrode provided in a direction to cross at least one of the first and second electrodes in a cell, a sustain discharge comprises a first discharge and a second discharge, the first discharge is mainly induced by externally-applied voltage, the second discharge is mainly induced by wall charges generated by the first discharge, the sustain discharge is performed a specified number of times between the first and second electrodes to obtain a predetermined luminance, and the second discharge in the sustain discharge utilizes charged particles generated by the first discharge.

According to a second aspect of the present invention, in the method of the first aspect, the sustain discharge utilizes a memory effect of the charged particles.

According to a third aspect of the present invention, in the method of the first aspect, a sustain discharge pulse has a pulse width of 1.6 $\mu$sec or less.

According to a fourth aspect of the present invention, in the method of the first aspect, an idle period between pulses to obtain the first discharge in the sustain discharge is 0.8 μsec or more.

According to a fifth aspect of the present invention, in the method of the first aspect, a fall of pulse in the sustain discharge is 300 nsec or less.

According to a sixth aspect of the present invention, in the method of the first aspect, an assistant pulse is applied in a direction to actively utilize the second discharge up to a value at which a polarity of residual wall charges is not reversed at the end of the second discharge.

According to a seventh aspect of the present invention, in the method of the sixth aspect, the assistant pulse is generated negatively to a ground potential on a fall of the sustain pulse.

According to an eighth aspect of the present invention, in the method of the sixth aspect, the assistant pulse is generated positively to the ground potential on a fall of the sustain pulse.

According to a ninth aspect of the present invention, in the method of driving a plasma display panel comprising at least one electrode which is covered with dielectric, a sustain discharge comprises a first discharge and a second discharge, the first discharge is mainly induced by externally-applied voltage, the second discharge is mainly induced by wall charges generated by the first discharge, the sustain discharge is performed a specified number of times between the first and second electrodes to obtain a predetermined luminance, and a group of pulses causing a first assistant discharge are applied in a form not to induce the second discharge between an addressing discharge to select a predetermined cell and the sustain discharge.

According to a tenth aspect of the present invention, in the method of the ninth aspect, the group of pulses causing the first assistant discharge each have a pulse width larger than that of a group of pulses causing the sustain discharge.

According to an eleventh aspect of the present invention, in the method of the ninth aspect, the group of pulses causing the first assistant discharge each have an idle period narrower than that of the group of pulses for the sustain discharge.

According to a twelfth aspect of the present invention, in the method of the first aspect, a group of pulses causing a first assistant discharge is applied in a form not to induce said second discharge between an addressing discharge to select a predetermined cell and said sustain discharge, and the group of pulses causing the first assistant discharge each have an idle period narrower than that of the group of pulses for the sustain discharge.

According to a thirteenth aspect of the present invention, in the method of the ninth aspect, the sustain discharge in a sub-field having little luminance information includes only the first assistant discharge.

According to a fourteenth aspect of the present invention, in the method of driving the surface-discharge type AC plasma display panel which comprises: first and second electrodes in a pair; a third electrode provided in a direction to cross the first and second electrodes; and a dielectric layer covering the first and second electrodes to stack wall charges, a sustain discharge period comprises a first period in which a first discharge mainly induced by externally-applied voltage across the first and second electrodes is caused; a second period following the first period; and a third period following the second period, in which the first discharge and a second discharge mainly induced by the wall charges are caused in this order, and a potential of the third electrode is switched between a first potential and a second potential lower than the first potential and higher than a ground potential in the second period.

In the method of driving the plasma display panel of the first aspect, utilizing the charged particles generated in the first discharge makes it possible to cause the second discharge with a low voltage.

In the method of driving the plasma display panel of the second aspect, utilizing the charged particles makes it possible to keep the sustain discharge with a low voltage.

In the method of driving the plasma display panel of the third aspect, specifying that the width of the sustain pulse is 1.6 μsec or less allows better use of the charged particles generated in the first discharge to cause the second discharge, to improve the light-emitting efficiency.

In the method of driving the plasma display panel of the fourth aspect, specifying that the idle period between the sustain pulses is 0.8 μsec or more allows the second discharge to be intensified, to improve the light-emitting efficiency.

In the method of driving the plasma display panel of the fifth aspect, specifying that the fall of pulse is 300 nsec or less allows the second discharge to be intensified, to improve the light-emitting efficiency.

In the method of driving the plasma display panel of the sixth aspect, since the sustain discharge includes the first discharge mainly induced by externally-applied voltage and the second discharge mainly induced by wall charges and the assistant pulse is applied in a direction to actively utilize the second discharge up to the value at which the polarity of residual wall charges is not reversed at the end of the second discharge, the second discharge is intensified, to improve the light-emitting efficiency.

In the method of driving the plasma display panel of the seventh aspect, generating the assistant pulse negatively to the ground potential on the fall of the sustain pulse allows the second discharge to be intensified, to improve the light-emitting efficiency.

In the method of driving the plasma display panel of the eighth aspect, generating the assistant pulse positively to the ground potential on the fall of the sustain pulse allows the second discharge to be intensified, to improve the light-emitting efficiency.

By the method of driving the plasma display panel of the ninth aspect, a large voltage margin can be obtained when the second discharge mainly induced by wall charges is used as the sustain discharge and a stable sustain discharge is achieved with high efficiency.

By the method of driving the plasma display panel of the tenth aspect, a large voltage margin can be obtained when the second discharge mainly induced by wall charges is used as the sustain discharge and a stable sustain discharge is achieved with high efficiency.

By the method of driving the plasma display panel of the eleventh and twelfth aspects, a large voltage margin can be obtained and a stable sustain discharge is achieved with high efficiency when the second discharge mainly induced by wall charges is used as the sustain discharge.

In the method of driving the plasma display panel of the thirteenth aspect, since the sustain discharge in the sub-field having little luminance information includes only the first assistant discharge, the gradation display can be achieved without lengthening any field cycle.

The driving method of the fourteenth aspect, which switches the potential of the third electrode between the first and second potentials, can control the amount of self-erase discharge at the second discharge (the discharge mainly induced by wall charges) in a case where both the first and second discharges are used. Therefore, no excessive self-erase discharge occurs in the transition from the first period to the second period, and it is possible to prevent a disappearance of discharge due to this excessive discharge and achieve a stable discharge. The driving method of the ninth aspect can improve the display quality of the PDP device.

Since the driving method of the fourteenth aspect can prevent the disappearance of discharge due to the excessive self-erase discharge, the method also produces a derivative effect of eliminating the necessity for applying the relatively high sustain voltage between the first and second electrodes to achieve a stable margin of the sustain voltage.

An object of the present invention is to provide a method of driving a plasma display panel which uses a discharge mainly induced by wall charges to enhance the light-emitting (discharge) efficiency and increases a margin of discharge condition to obtain a stable discharge. To achieve this main object, the present invention has the following detailed sub-objects.

The first object of the present invention is to improve the efficiency of the PDP, without increasing the circuit loss or reducing the margin, by producing a discharge mainly induced by wall charges on a fall with a low voltage and to the maximum which has been conventionally caused by applying a high voltage.

The second object of the present invention is to prevent a discharge between the electrode W and the electrode X or Y which is sustained by using a self-erase pulse during the sustain discharge period.

The third object of the present invention is to equalize the operating points of both a sub-field using a full-screen light emission and that not using it by using the discharge mainly induced by wall charges for the erase and relieve the variation of cells by using the "self-control function" of the discharge mainly induced by wall charges.

The fourth object of the present invention is to provide a method of driving a plasma display panel, which can prevent an unnecessary decrease of margin and ensure an erase operation in a case of sustain discharge using the second discharge mainly induced by wall charges.

The fifth object of the present invention is to provide a method of driving a surface-discharge type AC-PDP which achieves a fluent gradation display through fine tune of light-emitting luminance during the sustain discharge period.

The sixth object of the present invention is to provide a method of driving a surface-discharge type AC-PDP, which use both the discharge mainly induced by externally-applied voltage and the discharge mainly induced by wall charges during the sustain discharge period, intended to stabilize both the discharges by controlling the magnitude of discharge mainly induced by wall discharges.

The seventh object of the present invention is to provide a method of driving a surface-discharge type AC-PDP intended to reliably start the discharge in the initial stage of the sustain discharge period and then make a stable transition to the desired surface discharge.

The eighth object of the present invention is to provide a method of driving a surface-discharge type AC-PDP intended to achieve the fifth to seventh objects.

The ninth object of the present invention is to provide a method of driving a surface-discharge type AC-PDP which obtains a markedly-improved display quality through achieving the fifth to seventh objects.

According to a fifteenth aspect of the present invention, in the method of driving the plasma display panel which comprises first and second electrodes both covered with dielectric and a third electrode provided in a direction to cross at least one of the first and second electrodes in a cell, a sustain discharge which is performed a specified number of times between said first and second electrodes to obtain a predetermined luminance includes a first discharge mainly induced by externally-applied voltage and a second discharge mainly induced by generated wall charges.

According to a sixteenth aspect of the present invention, the method of driving the plasma display panel separates a sub-field into the addressing period in which cells to be lighted are optionally selected and the sustain discharge period in which the discharge is established simultaneously on the selected cells a specified number of times.

According to a seventeenth aspect of the present invention, in the method of driving the plasma display panel, the sustain discharge period has a time period in which the third electrode is in a floating state.

According to an eighteenth aspect of the present invention, in the method of driving the plasma display panel, the sustain pulse generated by the first and second discharges is used as an erase pulse.

According to a nineteenth aspect of the present invention, in the method of driving the plasma display panel, the group of pulses for the first assistant discharge each have a falling rate slower than that of the group of pulses for the sustain discharge.

According to a twentieth aspect of the present invention, in the method of driving the plasma display panel comprising at least one electrode which is covered with dielectric, which performs a sustain discharge including the first discharge mainly induced by externally-applied voltage and the second discharge mainly induced by generated wall charges a specified number of times to obtain a predetermined luminance, a group of pulses for a second assistant discharge pulse are applied in a form not to induce the second discharge between the sustain discharge and an erase discharge.

According to a twenty-first aspect of the present invention, in the method of driving the plasma display panel, the group of pulses for the second assistant discharge each have a pulse width larger than that of the group of pulses for the sustain discharge.

According to a twenty-second aspect of the present invention, in the method of driving the plasma display panel, the group of pulses for the second assistant discharge each have an idle period narrower than that of the group of pulses for the sustain discharge.

According to a twenty-third aspect of the present invention, in the method of driving the plasma display panel, the group of pulses for the second assistant discharge each have a falling rate slower than that of the group of pulses for the sustain discharge.

According to a twenty-fourth aspect of the present invention, in the method of the sixth aspect, the sustain discharge in a sub-field having little luminance information includes only a second assistant discharge.

According to a twenty-fifth aspect of the present invention, in the method of driving the surface-discharge type AC plasma display panel which comprises first and second electrodes in a pair; a third electrode provided in a direction to cross the first and second electrodes; and a dielectric layer covering the first and second electrodes to stack wall charges, a potential of the third electrode is switched between a ground potential and a first potential which is predetermined during a sustain discharge period.

According to a twenty-sixth aspect of the present invention, in the method of driving the surface-discharge type AC plasma display panel which comprises first and second electrodes in a pair; a third electrode provided in a direction to cross the first and second electrodes; and a dielectric layer covering the first and second electrodes to stack wall charges, a potential of the third electrode is switched between a ground potential and a first potential which is predetermined in a first period which is an initial stage of a sustain discharge period, and a potential of the third electrode is set to a second potential lower than the first potential in a second period of the sustain discharge period following the first period.

The present invention is directed to a driving circuit for a surface-discharge type AC plasma display panel. According to a twenty-seventh aspect of the present invention, the driving circuit for the surface-discharge type AC plasma display panel comprises a driving circuit for the third electrode generating a driving signal for driving the third electrode and outputting the driving signal to the third electrode by the method of driving the surface-discharge type AC plasma display panel.

According to a twenty-eighth aspect of the present invention, the driving circuit for the surface-discharge type AC plasma display panel further comprises a resistor connected in parallel to the driving circuit for the third electrode.

According to a twenty-ninth aspect of the present invention, the surface-discharge type AC plasma display panel is driven by the method of driving the surface-discharge type AC plasma display panel.

In the method of driving the plasma display panel of the fifteenth aspect, since the sustain discharge which is performed a specified number of times between the first and second electrodes to obtain a predetermined luminance includes the first discharge mainly induced by externally-applied voltage and the second discharge mainly induced by generated wall charges, it is possible to improve a light-emitting efficiency.

In the method of driving the plasma display panel of the sixteenth aspect, by separating the sub-field into the addressing period in which cells to be lighted are selected and the sustain discharge period in which the discharge is established simultaneously on the selected cells the specified number of times, the sustain pulse in the sustain discharge period can be changed easily and independently of the addressing period.

In the method of driving the plasma display panel of the seventeenth aspect separating the sub-field into the addressing period and the sustain discharge period, since the sustain discharge period has the time period in which the third electrode is in a floating state, it is possible to prevent an unnecessary discharge between the third electrode and the first or second electrode.

In the method of driving the plasma display panel of the eighteenth aspect, by using the sustain pulse generated by the first and second discharges as the erase pulse, a stable display can be achieved without any additional erase operation.

By the method of driving the plasma display panel of the nineteenth aspect, a large voltage margin can be obtained and a stable sustain discharge is achieved with high efficiency when the second discharge mainly induced by wall charges is used as the sustain discharge.

The method of driving the plasma display panel of the twentieth aspect achieves a reliable erase when the second discharge mainly induced by wall charges is used as the sustain discharge.

The method of driving the plasma display panel of the twenty-first aspect achieves a reliable erase when the second discharge mainly induced by wall charges is used as the sustain discharge.

The method of driving the plasma display panel of the twenty-second aspect achieves a reliable erase when the second discharge mainly induced by wall charges is used as the sustain discharge.

The method of driving the plasma display panel of the twenty-third aspect achieves a reliable erase when the second discharge mainly induced by wall charges is used as the sustain discharge.

In the method of driving the plasma display panel of the twenty-fourth aspect, since the sustain discharge in the sub-field having little luminance information includes only the second assistant discharge, the gradation display can be achieved without lengthening any field cycle.

The driving method of the twenty-fifth aspect can control the magnitude of the sustain discharge, i.e., a light-emitting intensity of the PDP, only by switching the potential of the third electrode between the ground potential and the predetermined first potential in the sustain discharge period. Two kinds of light emissions of different intensities are thereby produced and the number of light emissions is controlled for each kind to make a fine tune of luminance. Therefore, the driving method of the twenty-fifth aspect can precisely realize a linearity of display gradation of the PDP, to achieve a fluent gradation display.

Further, the driving method of the twenty-fifth aspect can reduce the number of supplies of the sustain discharge pulse, as compared with the prior-art driving method of the gradation display of the same level. That produces a time surplus in one frame or one sub-field. When this time surplus is allocated to an increase of the addressing period (write period), the width of the write pulse can be increased, to avoid a write failure and the like due to the time lag of discharge.

From the fact that the time surplus is produced, it is found that the driving method of the twenty-fifth aspect achieves a faster driving than the prior-art driving method. In a case of TV display, for example, where it is required to display an image in a constant time period, i.e., one field (=16.6 msec), the driving method of the twenty-fifth aspect, which performs a faster driving, can achieve an image display in the above time period even if the number of display lines increases. Therefore, the driving method of the twenty-fifth aspect produces an effect of driving a PDP device having more display lines (of higher definition) than the prior-art PDP.

Furthermore, the driving method of the twenty-fifth aspect can optionally set the total number of sustain discharge pulses as compared with the prior-art driving method. Therefore, the method achieves the maximum luminance in an available time length (one field) without deteriorating gradation, as compared with the prior-art driving method.

Thus, the driving method of the twenty-fifth aspect can improve the display quality of the PDP device.

The driving method of the twenty-sixth aspect, which controls the discharge in detail at the initial stage (the first period) of the sustain discharge period, can prevent the disappearance of discharge and the like, to achieve a stable discharge. Specifically, the discharge is actively caused between the third electrode and the first or second electrode for the charge distribution condition at the ending point of the immediately preceding addressing period in the first period, to generate a large amount of space charges. After that, by making a transition to the surface discharge between the first and second electrodes, it becomes possible to perform a stable sustain discharge. Therefore, the driving method of the twenty-sixth aspect can improve the display quality of the PDP device.

The driving circuit of the twenty-seventh aspect produces an effect of improving the display quality.

The driving circuit of the twenty-eighth aspect produces an effect of improving the responsivity at the switching of the potential of the third electrode by discharging the electric charges of the third electrode through the resistor.

The surface-discharge type AC plasma display panel of the twenty-ninth aspect produces the same effect as the fifteenth, twenty-fifth and twenty-sixth aspects.

These and other objects, features, aspects and advantages of the present invention will become more apparent from the following detailed description of the present invention when taken in conjunction with the accompanying drawings.

BRIEF DESCRIPTION OF THE DRAWINGS

FIG. 10 is a graph showing a relation between a voltage and a light-emitting efficiency with the assistant pulse for self-erase discharge applied;

FIGS. 11A to 11C are enlarged timing charts showing voltage waveforms and a light-emitting waveform in the sustain discharge period in the method of driving a plasma display panel in accordance with a third preferred embodiment of the present invention;

DESCRIPTION OF THE PREFERRED EMBODIMENTS

The First Preferred Embodiment

Figures 1A, 1B, 1C:
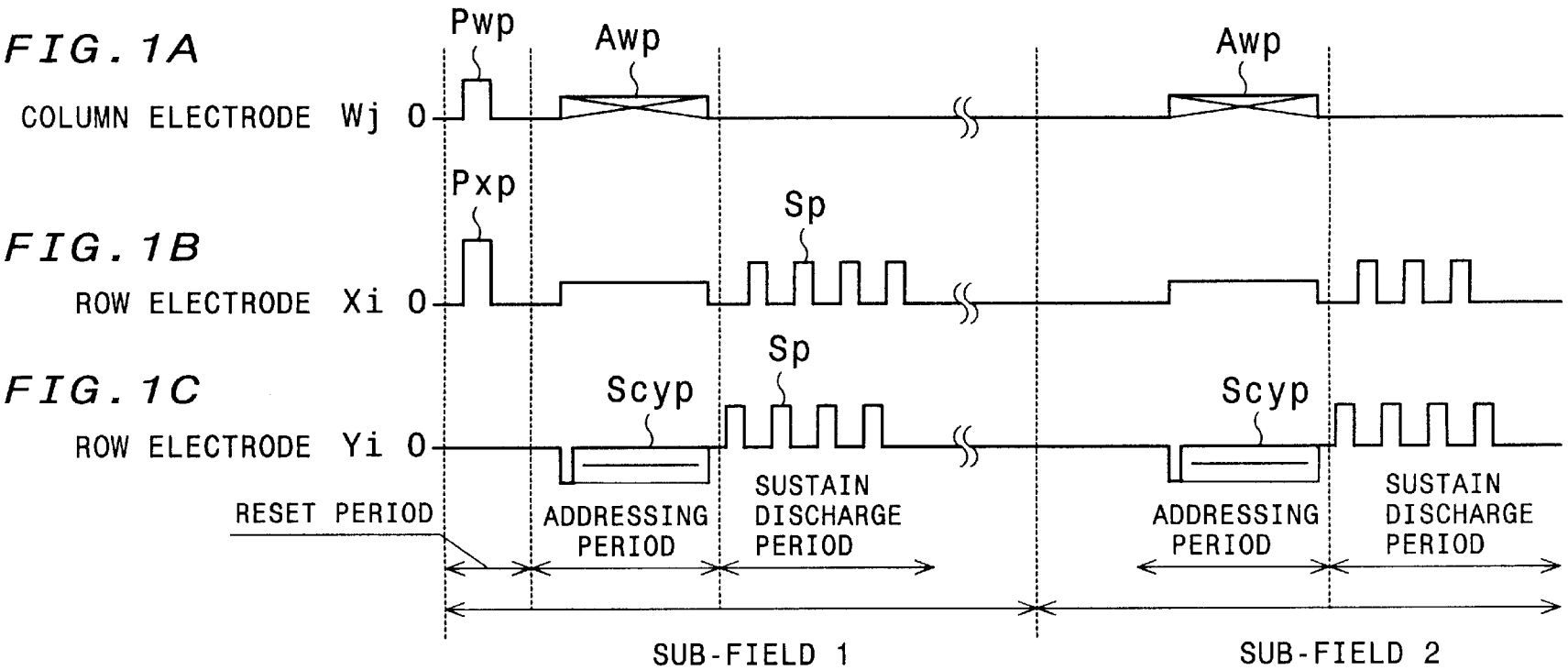
FIGS. 1A to 1C are voltage waveform charts showing a method of driving a plasma display panel in accordance with a first preferred embodiment of the present invention.
Figure 32:
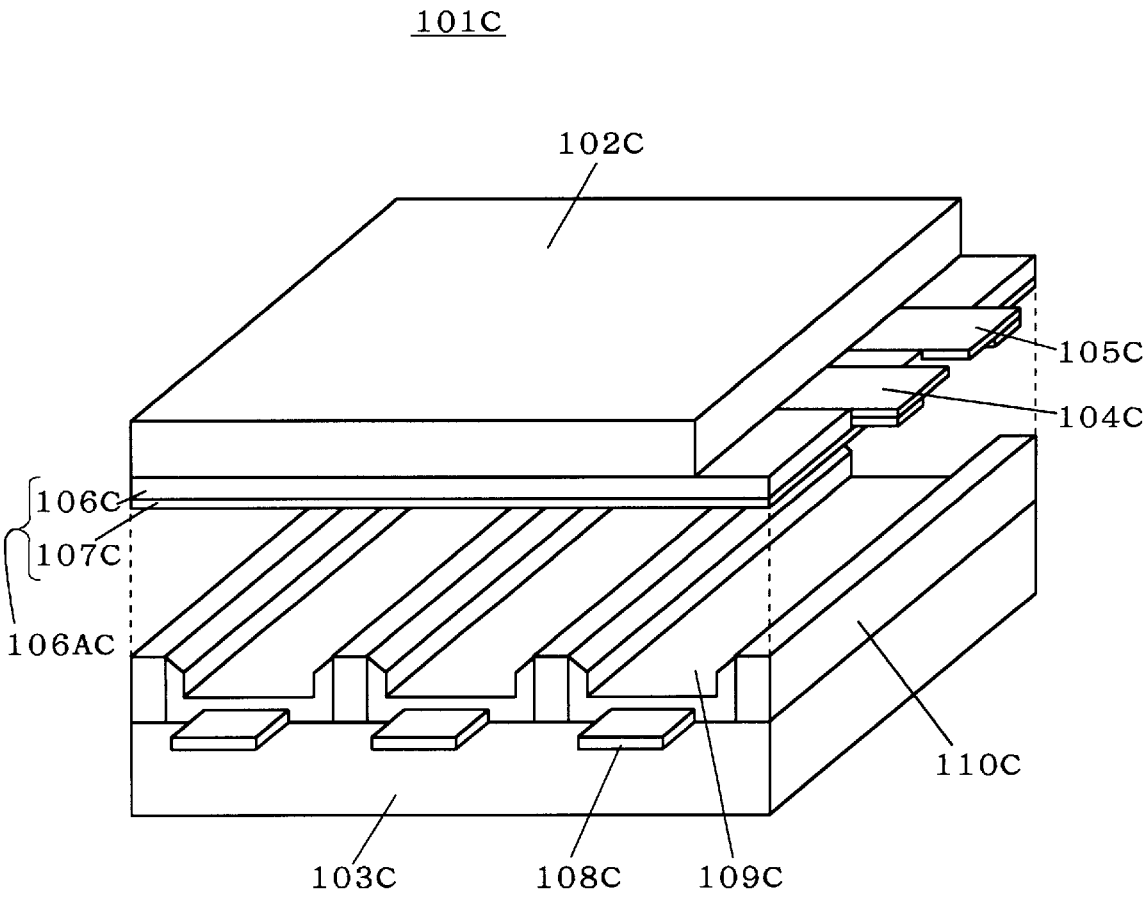
FIG. 32 (PRIOR ART)
FIG. 32 is a perspective view showing a structure of a surface-discharge type AC plasma display panel in the prior art.

Now, the first preferred embodiment will be discussed. The same panel as the prior-art one shown in FIG. 32 may be used. FIGS. 1A to 1C are voltage waveform charts (timing charts) showing a method of driving a plasma display panel in accordance with the first preferred embodiment of the present invention. FIGS. 1A to 1C show the waveforms of voltages applied to the column electrode Wj, the first row electrode Xi and the second row electrode Yi, respectively. The priming pulse (full-screen write pulse) Pxp is applied to the electrode Xi to cause a full-screen write and a full-screen erase and the pulse Pwp is applied to the electrode Wj at the same timing. These pulses may be each applied every several sub-fields and may be also applied every sub-field. The sustain pulse Sp causes the sustain discharge, the scan pulse Scyp is used for scanning and the addressing pulse Awp is applied according to the display data. In the first preferred embodiment, the priming pulse Pxp is set to have a pulse with of 7 μsec and a voltage of 310 V, the pulse Pwp is set to have a voltage of 150 V, the sustain pulse Sp is set to have a voltage of 180 V, the scan pulse Scyp is set to have a voltage of −180 V and the addressing pulse Awp is set to have a voltage of 60 V. Though no additional pulse is applied for the erase, the erase may be caused by applying a narrow pulse and so on like the prior-art driving method.

Next, an operation will be discussed. In the reset period at the start of a sub-field, first, the full-screen write pulse Pxp is applied to the first row electrode X (all the first row electrodes X1 to Xn) connected in common to the full screen. Since the pulse has a high voltage of 310 V, a discharge occurs between the first row electrode X and the second row electrode Y to generate a large amount of wall charges. After that, on the fall of the pulse Pxp, another discharge is induced only by the stacked wall charges. Since there is no externally-applied voltage, however, no electric charge of reverse polarity is generated only to reduce the amount of wall charges after the discharge. After the reset period, the addressing period starts. Simultaneously with sequential supply of the negative scan pulses Scyp to the second row electrodes Y1 to Yn which are driven independently of one another, the addressing pulse Awp according to the image data is applied to the column electrode Wj, to discharge the cell to be lighted in a matrix. At this time, a discharge is also caused between the electrodes Xi and Yi by using the discharge between the electrodes Yi and Wj as a trigger, to generate the wall charges on the electrodes Xi and Yi.

Figures 2A, 2B, 2C:
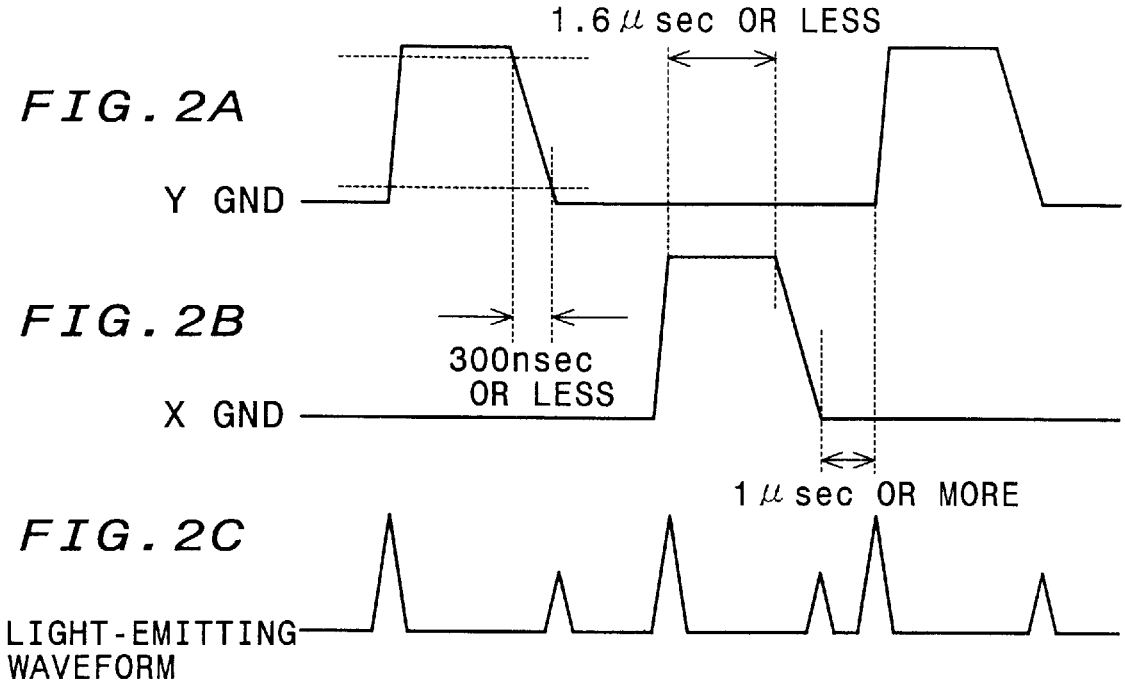
FIGS. 2A to 2C are timing charts showing voltage waveforms and a light-emitting waveform in a sustain discharge period in the method of driving a plasma display panel in accordance with the first preferred embodiment of the present invention.
Figure 3:
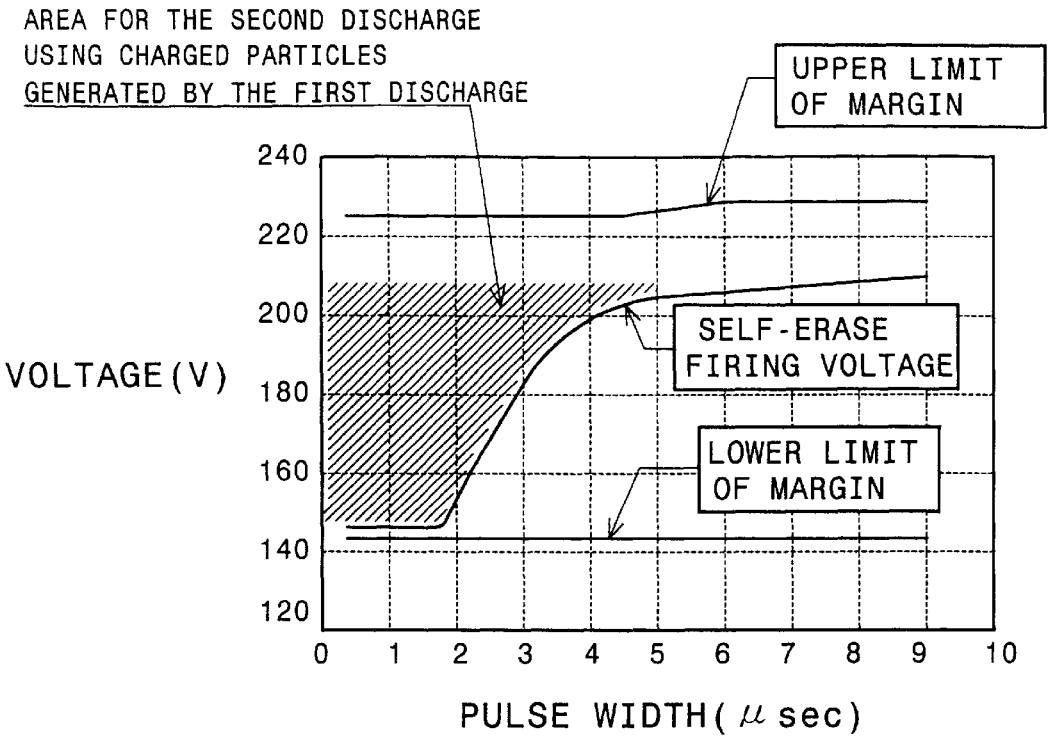
FIG. 3 is a graph showing a relation between a pulse width and a sustain voltage value at the start of a self-erase discharge.
Figure 18:
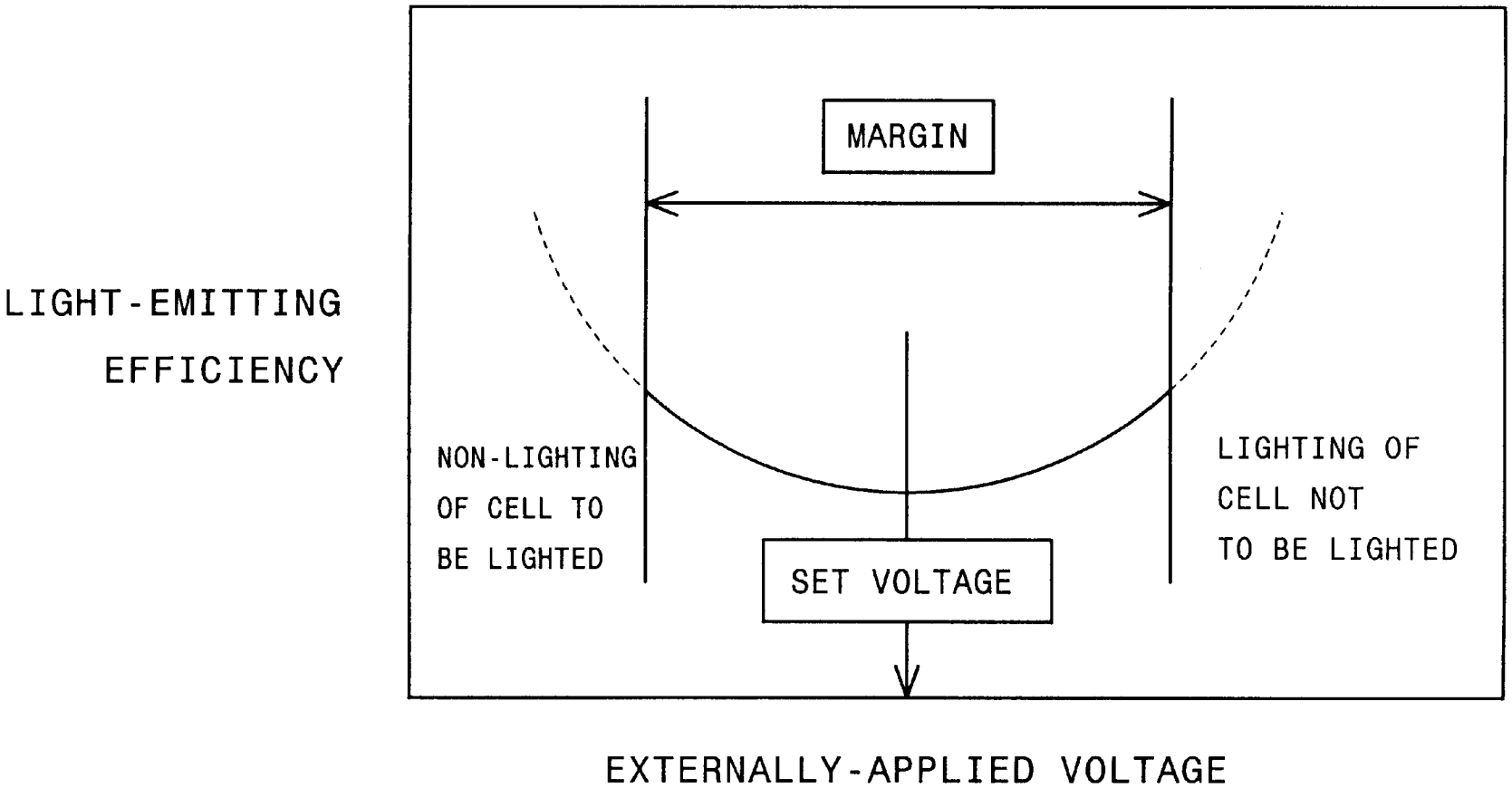
FIG. 18 is a graph showing a relation between an externally-applied voltage and a light-emitting efficiency.

In the sustain discharge period, the display cell selected in the addressing period is discharged a specified number of times, to obtain a predetermined display luminance. The voltage of the sustain pulse Sp is set less than the firing voltage of a cell which is not discharged between the first row electrode X and the second electrode Y in the addressing period and not less than the sustain discharge voltage of a cell which is discharged in the addressing period. FIGS. 2A to 2C are timing charts showing voltage waveforms and a light-emitting waveform in a sustain discharge period. All the conditions shown in FIGS. 2A to 2C do not necessarily have to be satisfied and each have an independent meanings. On the rise of the applied pulse, the effective voltage which is a sum of the voltage by the wall charges and the externally-applied voltage is not less than the firing voltage, to cause a discharge. At this time, the discharge ends with the wall charges of reverse polarity stacked. The amount of wall charges in this case depends on the externally-applied voltage and does not exceed the externally-applied voltage. On the fall of the pulse, the externally-applied voltage becomes 0 V and an electric field induced by the wall charges is left in the discharge space. Setting the wall charges in voltage not less than the firing voltage causes another discharge. Different from the first discharge on the rise of the pulse, the second discharge on the fall of the pulse does not cause the wall charges of reverse polarity to be stacked but just reduce the amount of wall charges to the firing voltage or less. FIG. 3 is a graph showing a relation between a pulse width and a sustain voltage value to start the second discharge. In an area of wide pulse, the applied voltage necessary to cause the second discharge is about 210 V. In an area of narrow pulse, it can be seen that the self-erase discharge is easy to produce since the charged particles generated by the first discharge lowers the firing voltage. For example, when the pulse width is set to 3 μsec, the self-erase discharge can be caused by applying a voltage of 185 V or higher, and when the pulse width is set to 2 μsec, the self-erase discharge can be caused by applying a voltage of 150 V or higher. Thus, in an area where the charged particles generated by the first discharge can be used, i.e., on the left side of a self-erase firing voltage curb, the self-erase discharge can be caused in a transition period before the firing voltage Vf comes in a stationary state, not in the high-voltage self-erase area shown in FIG. 18 of the prior art. Further, the self-erase discharge with a low voltage using the charged particles after the first discharge eliminates the possibility of causing an unnecessary discharge between the electrode W and the electrode X or Y and increasing the circuit loss (power loss).

Furthermore, using a wider pulse at the same driving voltage makes it sure that the self-erase discharge of the present invention is different from that of the prior art. For example, in the first preferred embodiment, the light emission on the fall which can be observed when it is driven by the sustain pulse Sp having a voltage value of 180 V and a pulse width of 1.6 μsec can not be observed when driven by the pulse having the same voltage and a pulse width of 4 μsec.

Observing the light emission on the fall also makes it sure that the self-erase discharge of the first preferred embodiment is different from the narrow-pulse sustain discharge such as Townsend discharge suggested in the prior art. As discussed above, since the pulse is fallen before flow of the discharge current is completed (the wall charges are completely generated) in the narrow-pulse sustain discharge, it is impossible to cause another discharge on the fall.

In an area of pulse width not more than 1.6 μsec of FIG. 3, as the second discharge already occurs near the lower limit of the sustain voltage margin, it is impossible to independently produce only the first discharge. Since it is difficult to fabricate a panel having no variation of operating points of cells, it is preferable to select an area to surely cause the second discharge through the whole range of the margin. Though this condition slightly varies with the filled-gas pressure and the kind of gas as well as the panel, a uniform result can be achieved in the discharge area available for the PDP. FIG. 3 shows that it is 1.6 μsec or less. An observation shows that this value is a critical point on whether the second discharge occurs or not near the lower limit of the margin.

Figure 4:
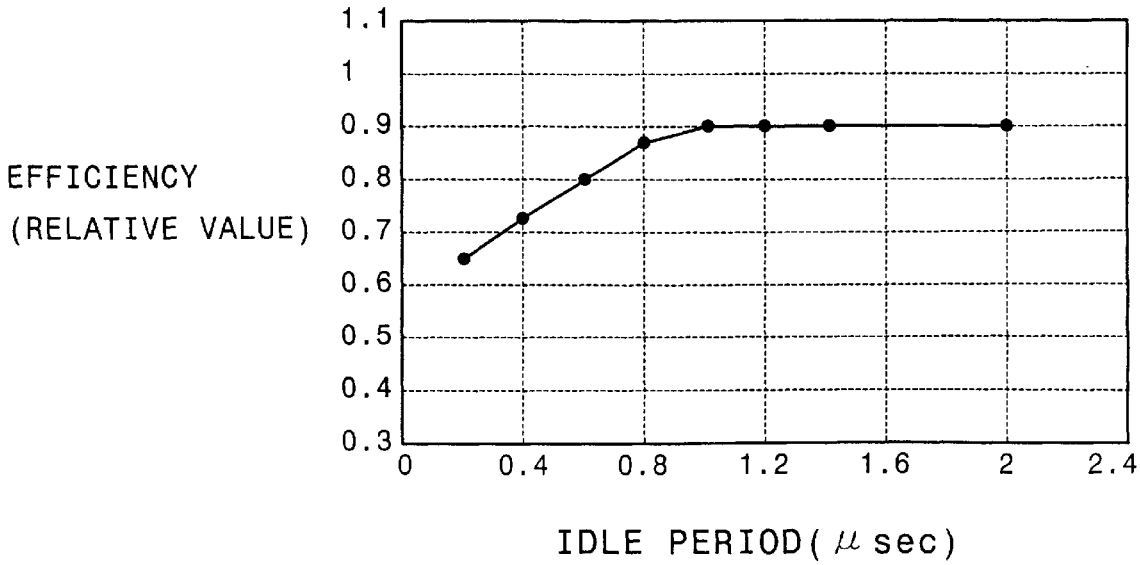
FIG. 4 is a graph showing a relation between an idle period and a light-emitting efficiency.

FIG. 4 is a graph showing a relation between an idle period between one pulse and the following one and a light-emitting efficiency with the pulse width of 1 μm. The second discharge on the fall of the pulse is influenced by the idle period, and under the condition of almost no idle period, the discharge on the rise of the next pulse is superposed on the second discharge on the fall. Though a wider idle period is preferable in consideration of the time lag of the discharge on the fall, a high voltage is needed for sustaining the discharge. Considering the statistic time lag until the start of the discharge and the formative time lag from the start to the end of the discharge, the idle period of 0.8 μsec or more is needed. The value slightly varies depending on the cell structure, like FIG. 3, a uniform result can be achieved in the discharge area available for the PDP. This value can be obtained as a saturation point, for example, as the idle period increases with a constant pulse width.

Figure 5:
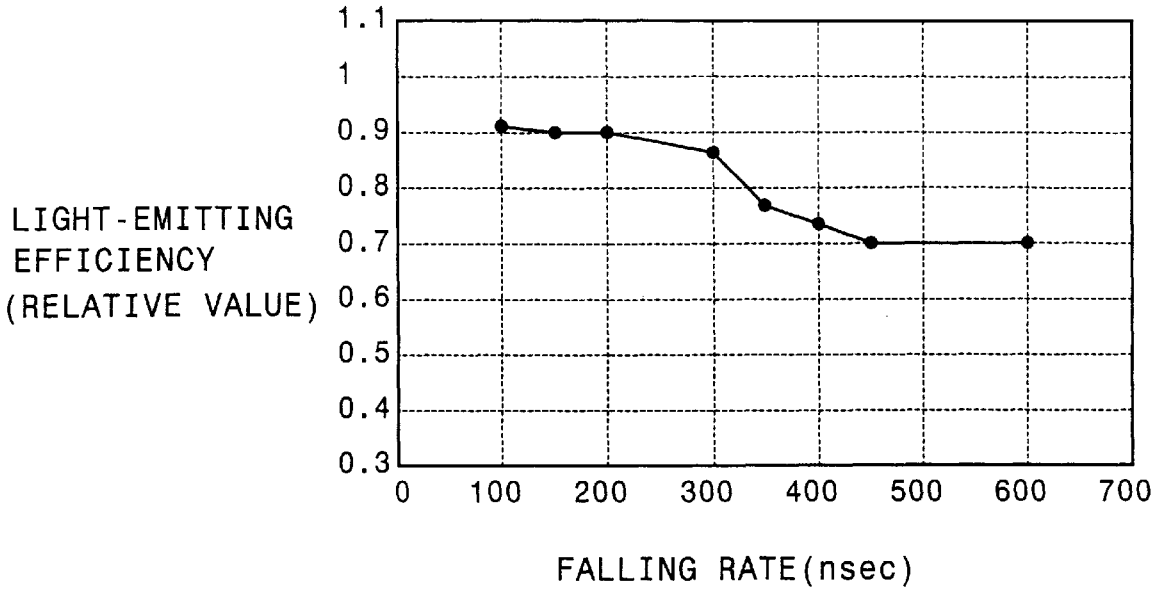
FIG. 5 is a graph showing a relation between a falling rate and a light-emitting efficiency.

FIG. 5 is a graph showing a relation between a falling rate of a pulse and a light-emitting efficiency. The falling rate refers to a time period needed for a pulse to vary from 90% voltage value to 10% voltage value. The second discharge on the fall of a pulse depends on the falling rate and it is necessary to fallen the pulse earlier than the statistic time lag of discharge. If the second discharge occurs at some mid-point in the fall of the pulse, the second discharge decreases as the applied voltage works in a direction to lower the effective voltage, to makes it impossible to effectively use the second discharge. FIG. 5 shows that this value is 300 nsec or less. This value also slightly varies depending on the cell structure, a uniform result can be achieved in the area available for the PDP. The characteristic value can be obtained as a changing point by changing the falling rate.

Figure 6:
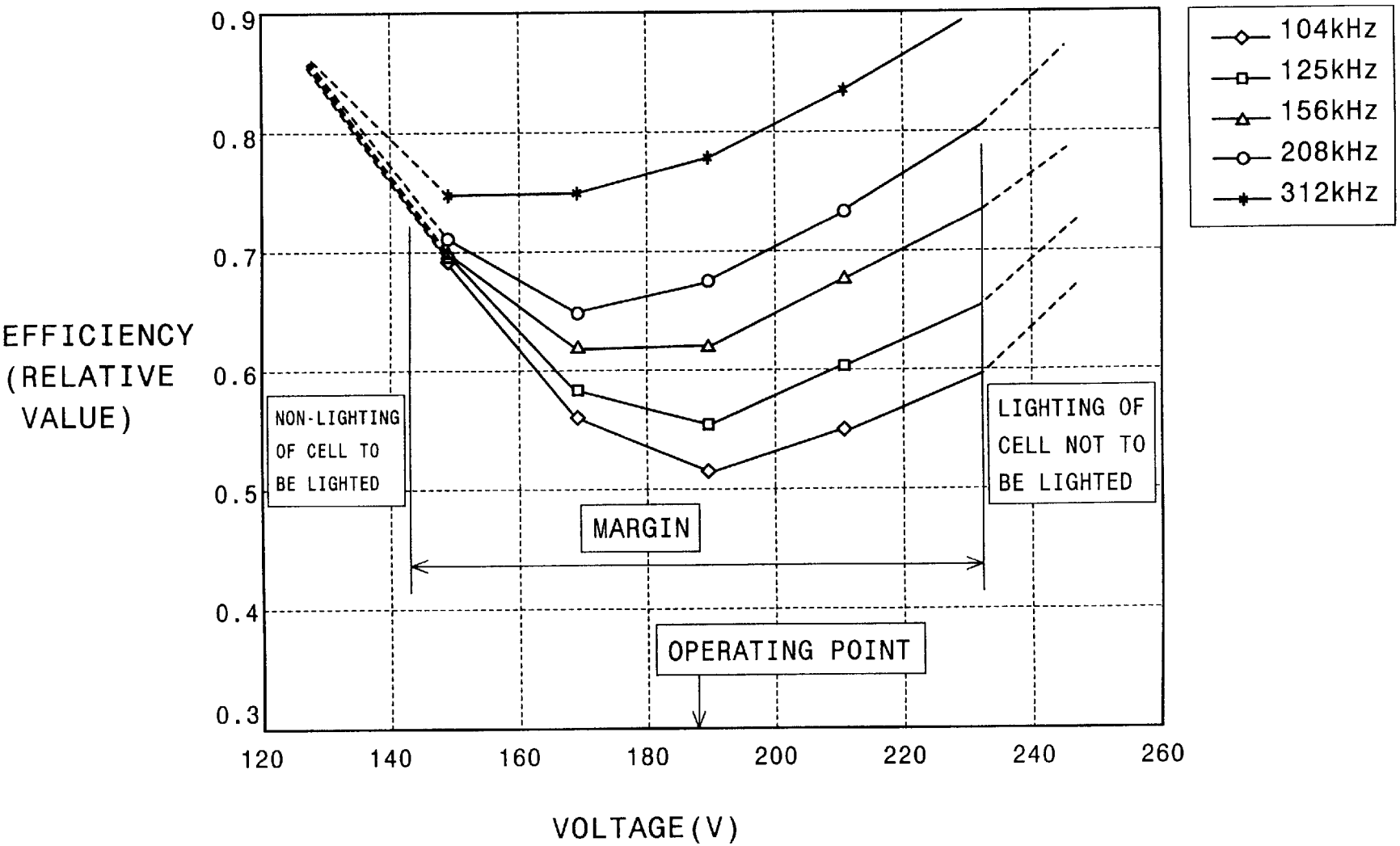
FIG. 6 is a graph showing a relation between a voltage and an efficiency with variation in frequency.

FIG. 6 is a graph showing a relation between a voltage and an efficiency with variation of frequency based on the above knowledge. Like FIG. 18, a lower voltage can reduce the current density to increase the efficiency and a higher voltage can reduce the effective voltage through the self-erase discharge to produce the same effect as the low voltage. From FIG. 6, it can be seen that a higher frequency increases the efficiency for the same voltage. This means that the effect of the self-erase which has been obtained with a high voltage can be obtained with a lower voltage. Further, since the margin hardly varies with variation of frequency, the light-emitting efficiency can be improved through the self-erase discharge with the operating point selected at the center of the margin. Since a large amount of wall charges are left on a cell that is hard to discharge after the self-erase discharge and a small amount of wall charges are left on a cell that is easy to discharge, it is possible to uniform a firing condition for the first discharge of the next pulse and thereby stabilize the discharge.

Furthermore, a driving condition to cause the sustain discharge by using the memory effect of the changed particles may be adopted. Specifically, there is an area where the discharge can not be sustained if the idle period is set longer under the condition of the same voltage, the same pulse width and the same falling rate, and this is because the effect of lowering the firing voltage by the charged particles is lost during the idle period. FIG. 3 shows the variation of the firing voltage for the second discharge affected by the first discharge on the rise, and this fact also means that a sustain discharge affects variation of the firing voltage of the next sustain discharge. From FIG. 3, the effect can be estimated to last about 4 μsec. Like the pulse memory of the DC-PDP, the memory effect of the charged particles allows the discharge to be sustained with a low voltage. Conversely, the discharge can not be sustained when the supply of the pulse is stopped, and that eliminates the need for the erase operation which has been needed in the prior-art method of driving the AC-PDP in order to stop the discharge. Further, though it has been difficult in the prior art to use the same operating point for both the sub-field in which a full-screen light-emission pulse is applied and the sub-field in which the pulse is not applied by utilizing the self-control function of the self-erase discharge, the sustain pulse further having an erase function using the second discharge, which performs the same self-erase both after the sustain pulse and after the full-screen light-emission pulse, can achieve such action and effect as replaces the full-screen light-emission pulse.

Though the first preferred embodiment is concerned with the pulse applied during the sustain discharge period in the "addressing/sustain separation method", naturally, the same effect can be produced in not the addressing/sustain separation method. In the addressing/sustain separation method, however, it is easy to select the condition of the sustain pulse (pulse width, idle period and falling rate).

The Second Preferred Embodiment

Figures 7A, 7B, 7C:
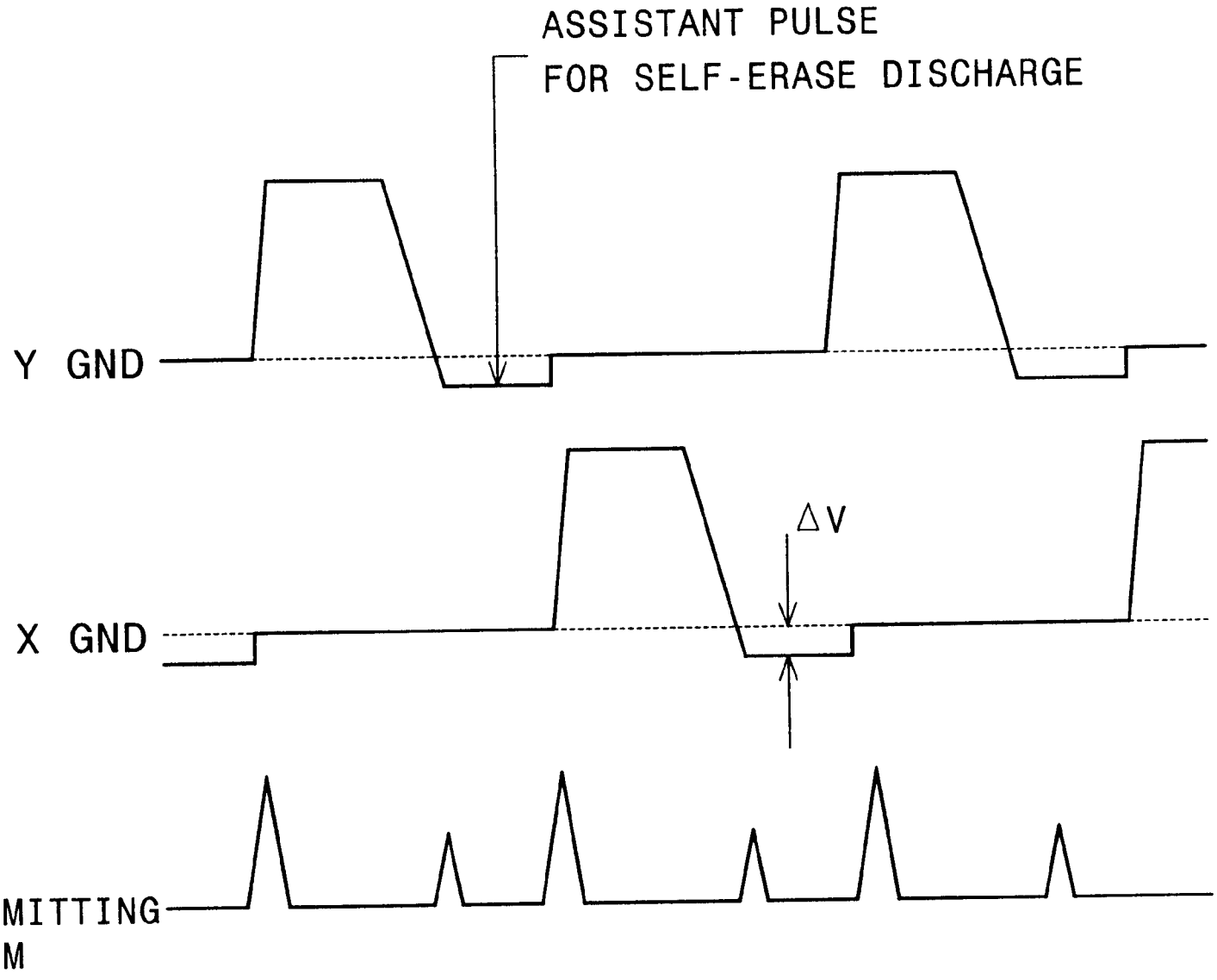
FIGS. 7A to 7C are enlarged timing charts showing voltage waveforms and a light-emitting waveform of a sustain discharge period in the method of driving a plasma display panel in accordance with a second preferred embodiment of the present invention.

Now, the second preferred embodiment of the present invention will be discussed. FIGS. 7A to 7C are enlarged timing charts showing voltage waveforms and a light-emitting waveform of the sustain discharge period in the method of driving a plasma display panel in accordance with the second preferred embodiment of the present invention. The reset period and the addressing period are the same as those of the first preferred embodiment. In FIGS. 7A and 7B, the positively-applied sustain pulse is fallen to a minus level on its fall. The self-erase discharge of the first preferred embodiment is a discharge caused by the electric field induced by the wall charges when the externally-applied voltage is 0 V. Therefore, no wall charges of reverse polarity is generated after the discharge and the wall charges of the same polarity are left. In the second preferred embodiment, superposing the externally-applied voltage in a direction of the electric field induced by the wall charges on the fall of the pulse produces more effect of the self-erase discharge. Herein, the pulse superposed on the self-erase discharge is referred to as "an assistant pulse for the self-erase discharge". Though it is preferable that the voltage of the assistant pulse for self-erase discharge be high, the wall charges of reverse polarity must not be stacked because of a side effect of reducing the margin. Preferably, the voltage should be set so that the wall charges may have a voltage of 0 V after end of the discharge by the assistant pulse for self-erase pulse.

Figure 8A:
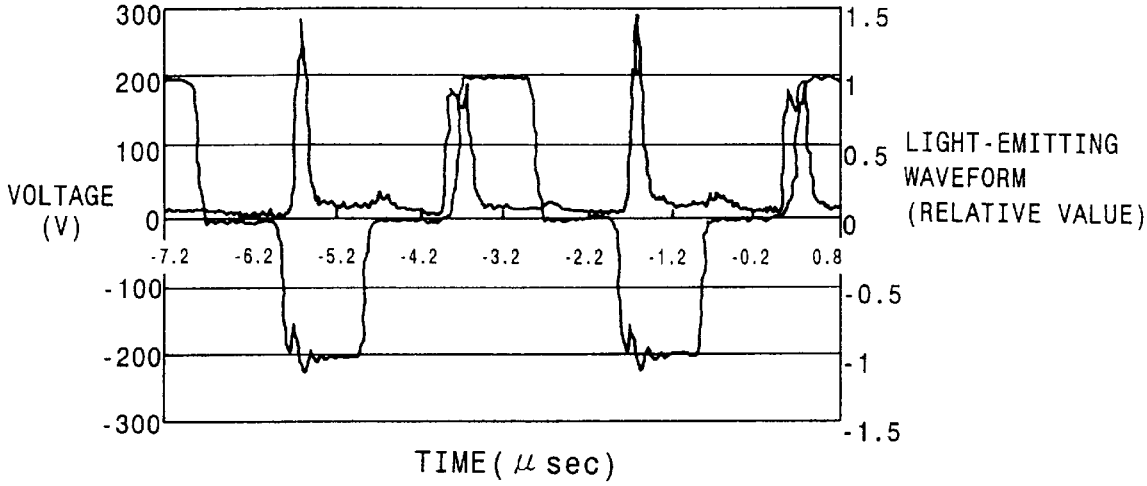
FIGS. 8A and 8B are timing charts showing voltage waveforms and light-emitting waveforms with an assistant pulse for self-erase discharge applied.
Figure 8B:
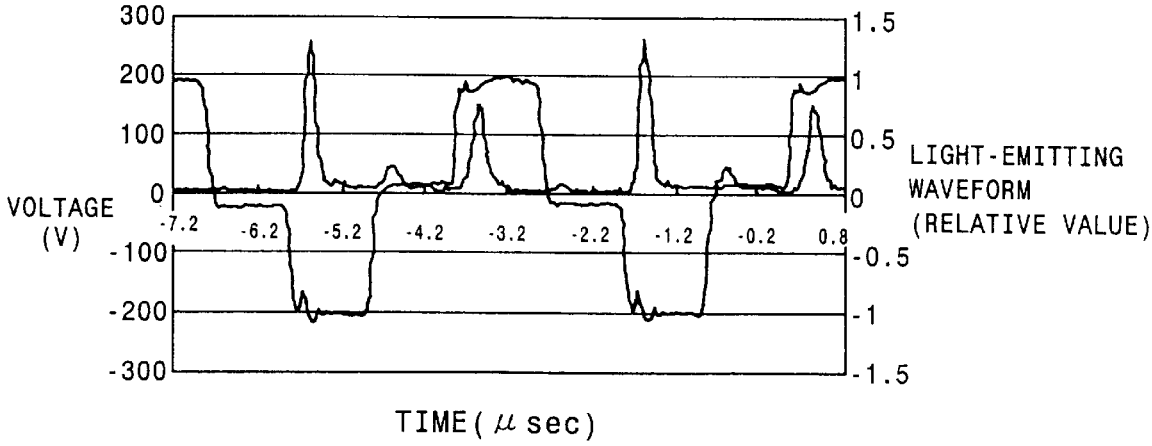
Figure 9A:
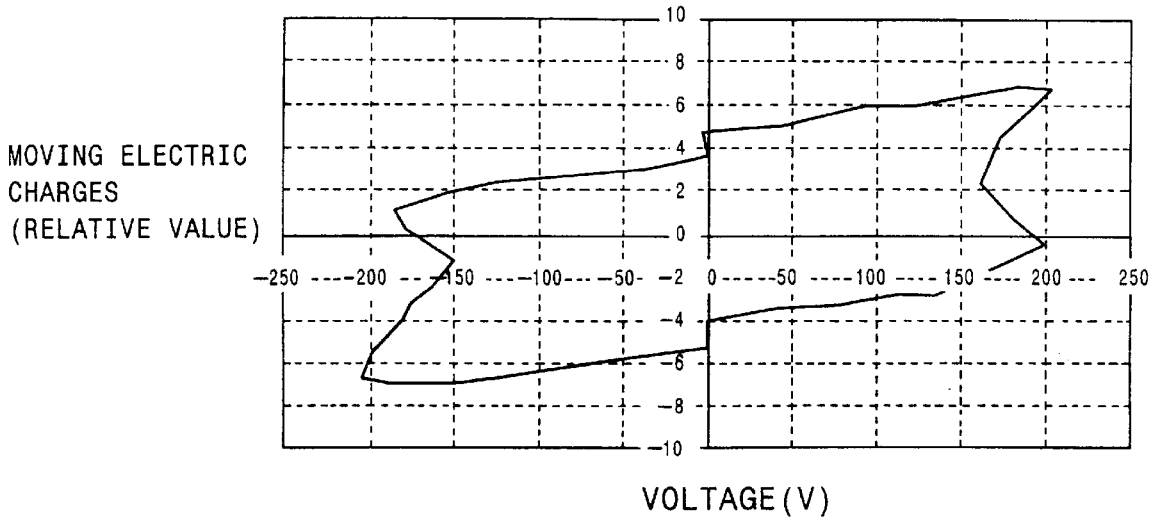
FIGS. 9A and 9B are Lissajous figures with the assistant pulse for self-erase discharge applied.
Figure 9B:
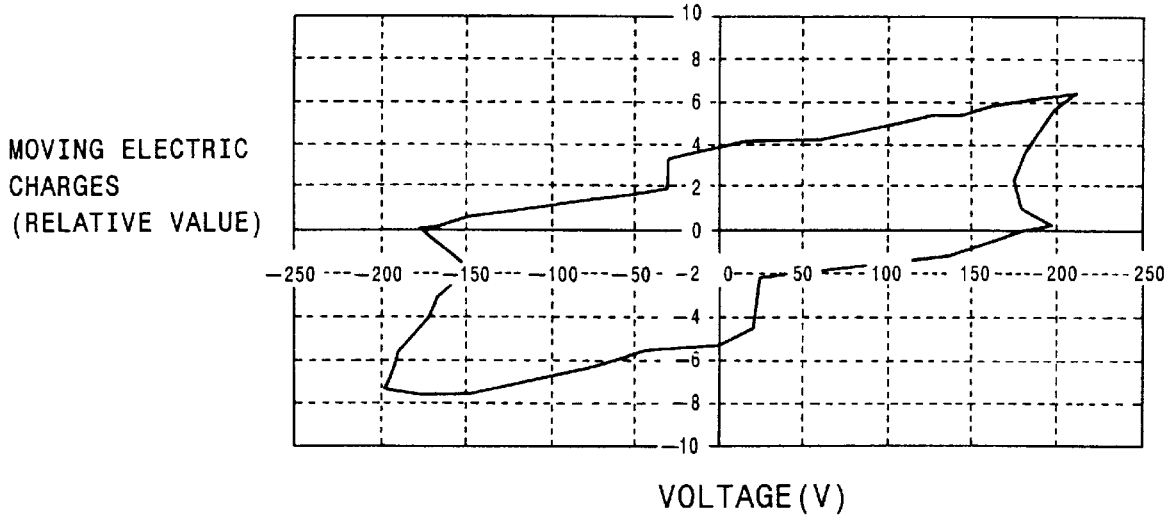

FIGS. 8A and 8B are timing charts showing voltage waveforms and light-emitting waveforms with an assistant pulse for self-erase discharge applied, and FIGS. 9A and 9B are Lissajous figures with the assistant pulse for self-erase discharge applied. The Lissajous figures can be obtained by connecting, for example, a measuring capacitor to the AC-PDP in series and show how much the electric charges move between before and after the discharge with horizontal axis of externally-applied voltage and vertical axis of the amount of electric charges. From FIGS. 8A, 8B, 9A and 9B, it can be seen that the light emission is stronger on the fall than a normal condition and the amount of the wall charges after the discharge is thereby reduced. Since an area of the Lissajous figure corresponds to a supplied power, in order to achieve a smaller supplied power for a discharge and higher light-emitting efficiency which is the object of the present invention, it is preferable that the area of the Lissajous figure is made as small as possible. In FIGS. 9A and 9B, since the externally-applied voltage is equal, it is clear that the assistant pulse for self-erase discharge further has an effect of reducing the effective voltage. Furthermore, though the luminance is lowered by reducing the supplied power, it is possible to achieve a desired luminance by increasing the number of discharges by the sustain pulse (increasing the average frequency).

FIG. 10 is a graph showing a relation between the voltage and the light-emitting efficiency with the assistant pulse for self-erase discharge applied under the condition of the sustain pulse for the highest light-emitting efficiency achieved in the first preferred embodiment. As compared with FIG. 4, it can be seen that this driving method achieves a higher efficiency than the driving with the self-erase discharge.

The Third Preferred Embodiment

FIGS. 11A to 11C are timing charts showing voltage waveforms and a light-emitting waveform in applying the assistant pulse for self-erase discharge of the second preferred embodiment to other electrode. The third preferred embodiment achieves an improvement in efficiency of the self-erase discharge like the second preferred embodiment.

The second preferred embodiment has an advantage of relatively easy change of the falling rate and less wrong discharges in discharge design since the voltage-applied electrode is fallen to a minus level. The third preferred embodiment has an advantage of simple circuit configuration without a minus power supply since an electrode corresponding to the voltage-applied electrode is brought into a plus level.

The Fourth Preferred Embodiment

Figures 12A, 12B, 12C:
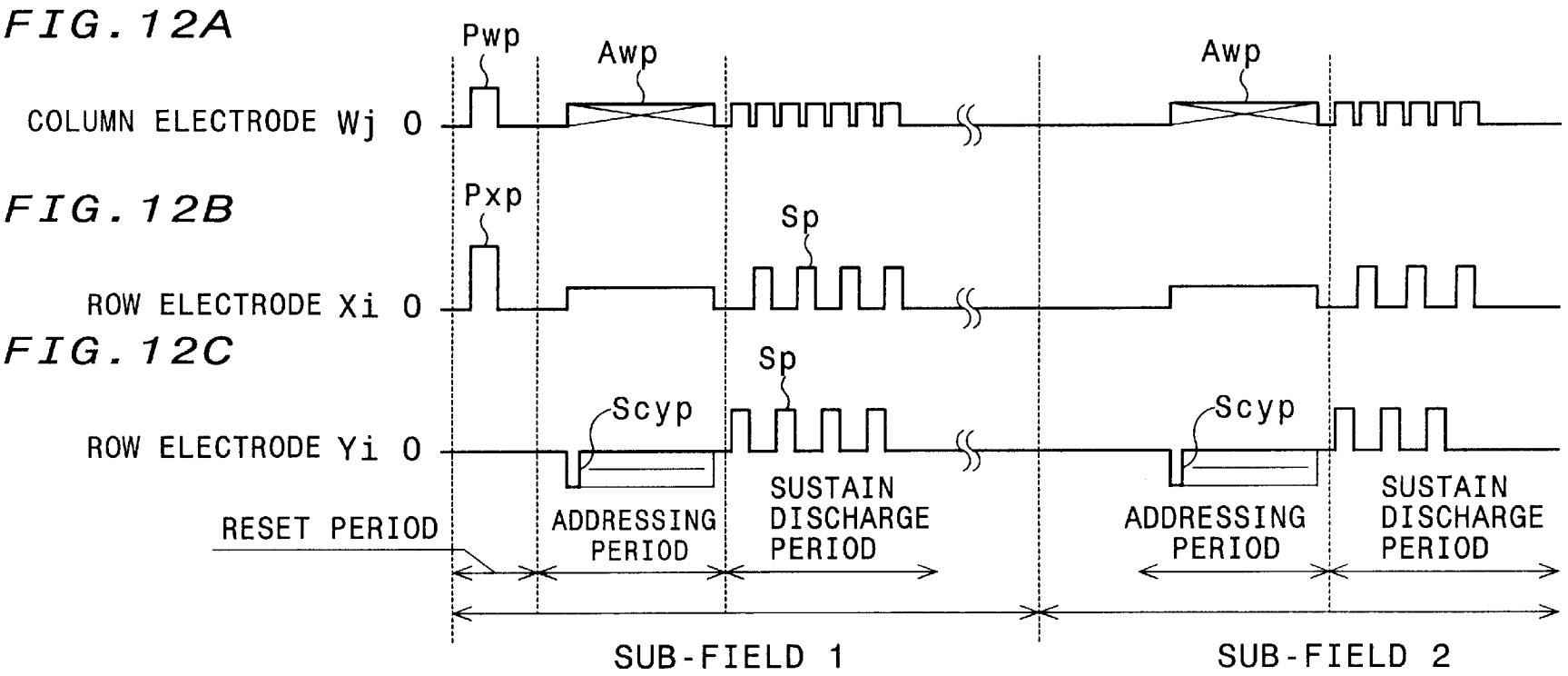
FIGS. 12A to 12C are timing charts showing voltage waveforms in the method of driving a plasma display panel in accordance with a fourth preferred embodiment of the present invention.
Figure 13:
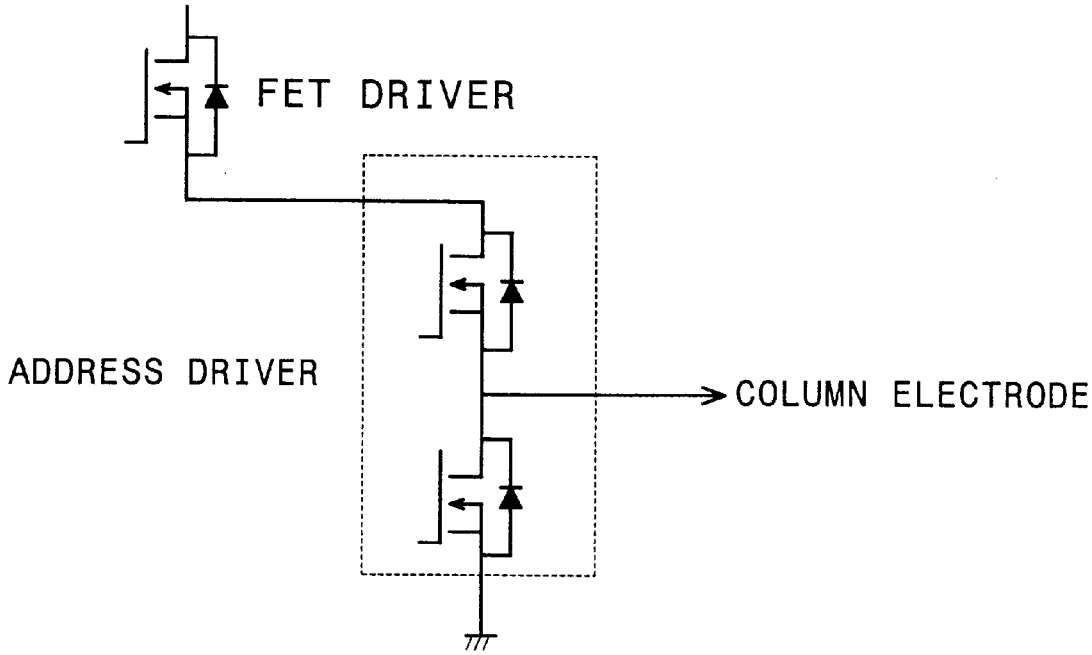
FIG. 13 is circuit configuration showing a column electrode of a plasma display panel for discussion of the fourth preferred embodiment of the present invention.
Figure 14:
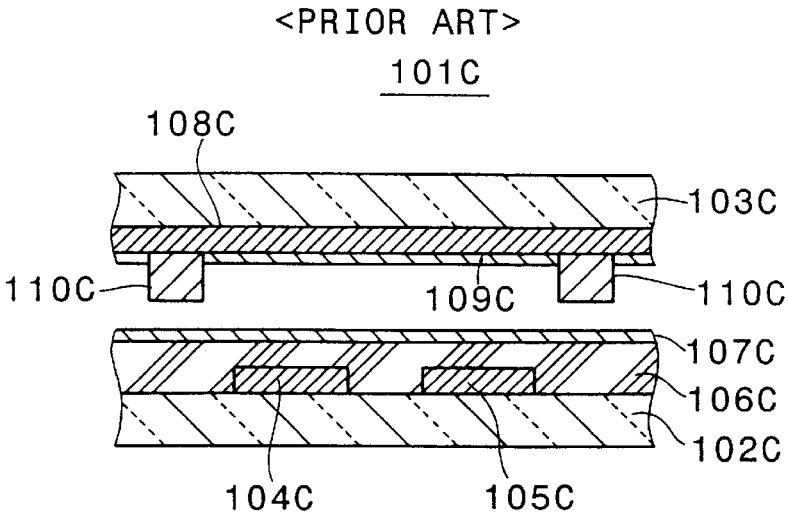
FIG. 14 is a cross section showing a cell of an AC-PDP.
Figure 15:
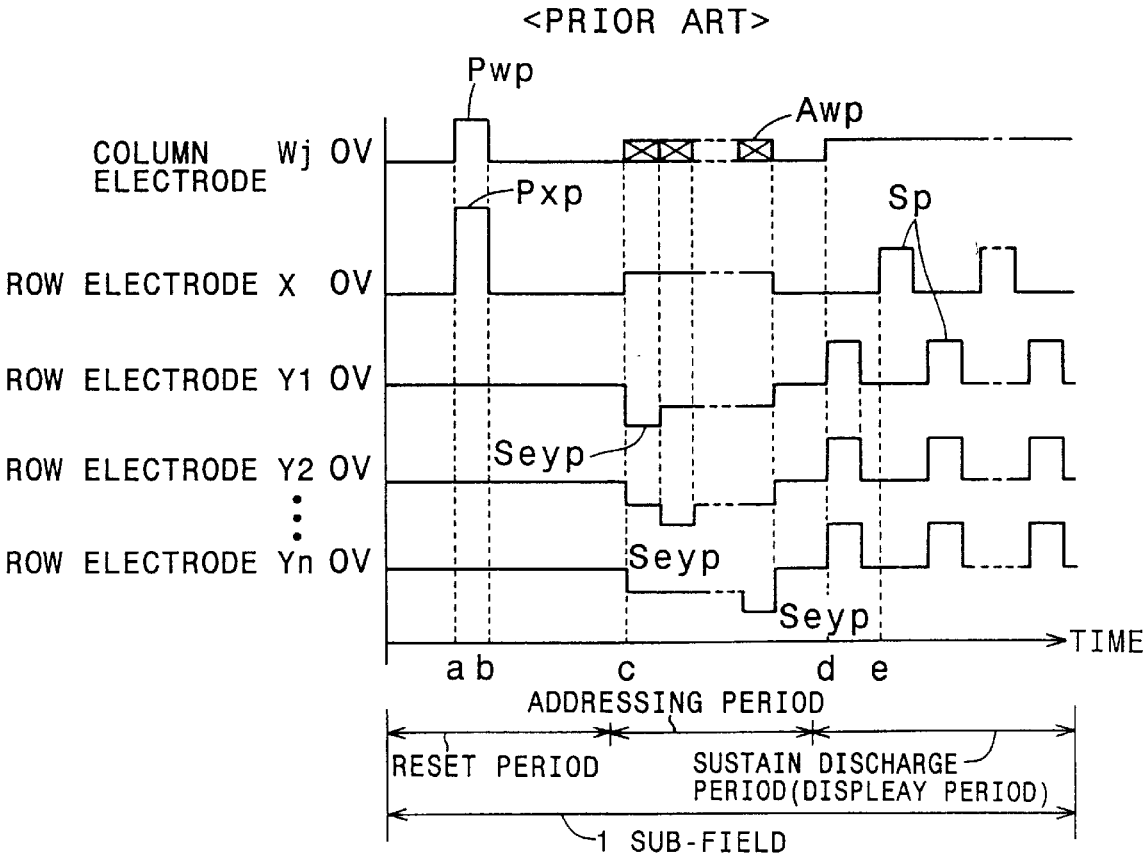
FIG. 15 is a timing chart showing voltage waveforms in one sub-field of a prior-art method of driving a plasma display panel disclosed in Japanese Patent Application Laid Open Gazette 7-160218.
Figure 16:
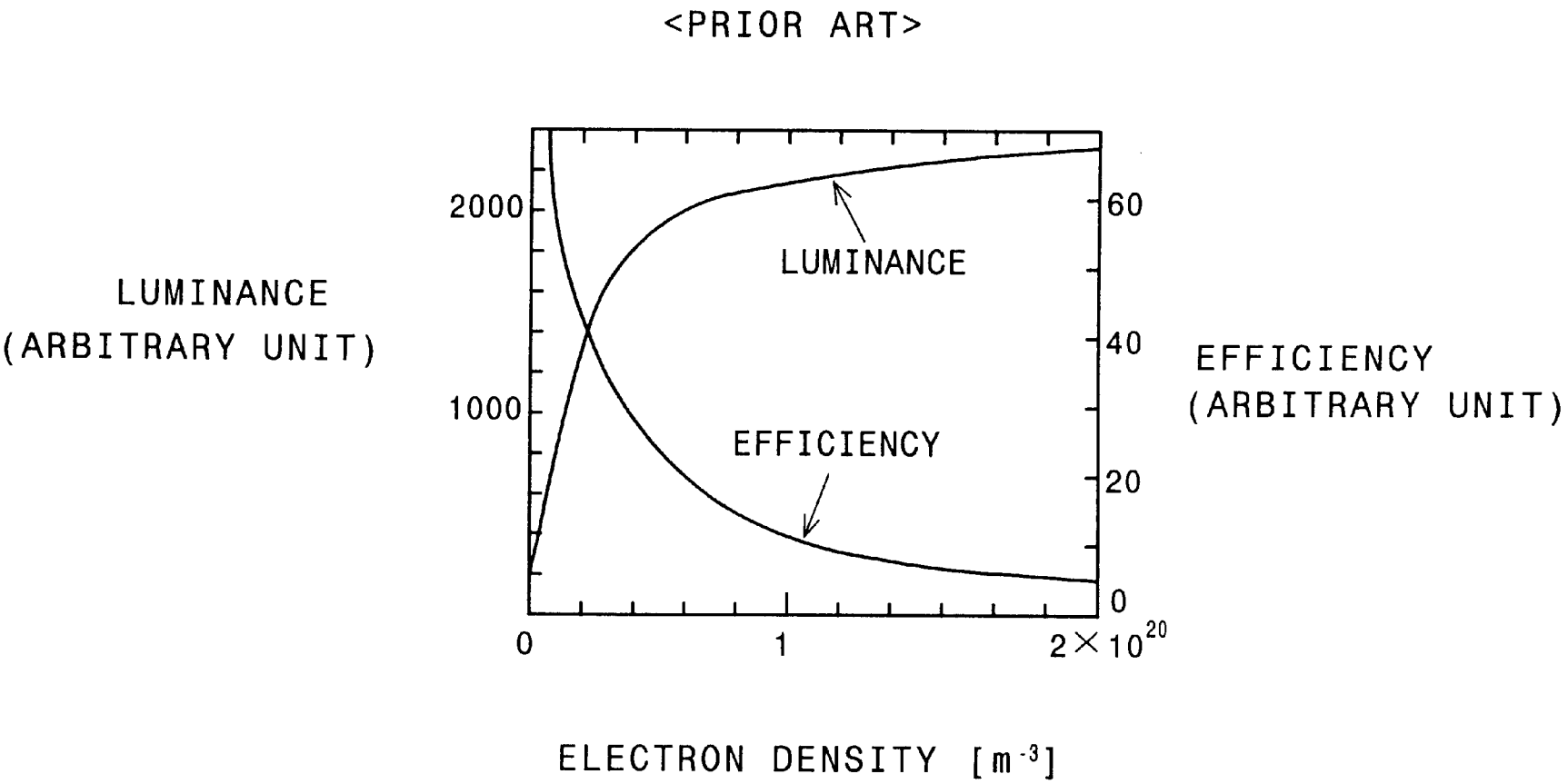
FIG. 16 is a graph showing a relation between a current density and a light-emitting efficiency.
Figure 17A:
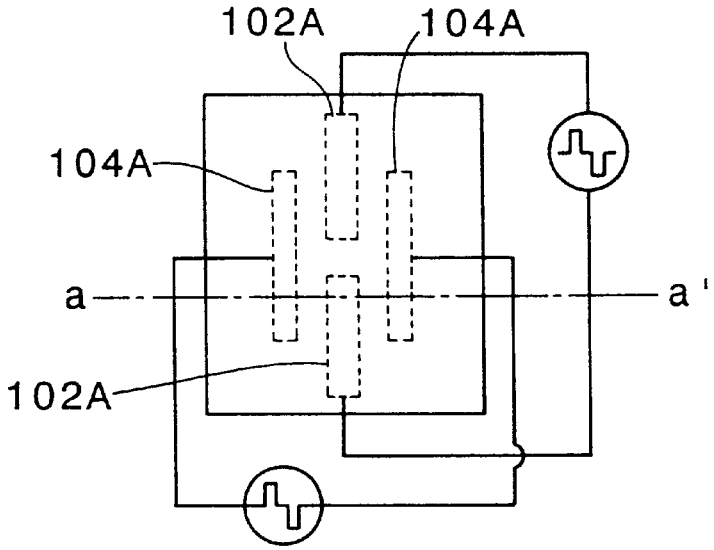
FIGS. 17A and 17B illustrate configuration and structure of an AC-PDP disclosed in Japanese Patent Application Laid Open Gazette 3-219528.
Figure 17B:
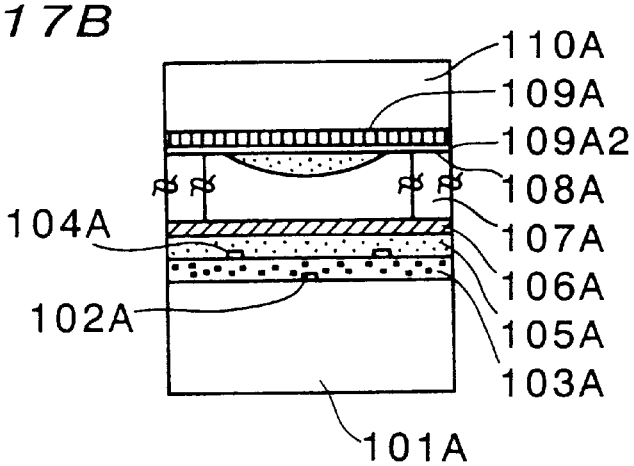

FIGS. 12A to 12C are timing charts of the fourth preferred embodiment of the present invention, showing the potential of the electrode W during the sustain discharge period in the addressing/sustain separation method. When the potential of the electrode W is fixed, there is a possibility that a discharge occurs between the electrode W and the electrode X or Y, depending on the determined voltage value of the electrode W. When no self-erase discharge is caused on the fall of the pulse, even if a discharge occurs between the electrode W and the electrode X or Y, the wall charges are stacked to mask the electrode W and the following discharges are not affected. On the other hand, when the self-erase discharge occurs, since the wall charges stacked on the electrode W on the rise of the pulse are extinguished in the discharge on the fall of the pulse, the discharge between the electrode W and the electrode X or Y is sustained. Therefore, to suppress the discharge towards the electrode W, it is only necessary to bring the electrode W into a floating state, not to fix it. This state is easily achieved, for example, by making a gate signal of an FET off in the circuit configuration of FIG. 13. Naturally, it is also achieved by applying a pulse giving an intermediate potential between the electrodes X and Y. Since the fourth preferred embodiment can prevent the discharge between the electrode W and the electrode X or Y even if a driving is made by using both the discharge mainly induced by externally-applied voltage and that mainly induced by wall charges during the sustain discharge period, it stabilizes the discharge, not reducing the margin.

Though the electrode W is in the floating state in the whole sustain discharge period in the fourth preferred embodiment, there may be a case where the electrode W is fixed to stabilize the discharge in the early stage (for several pulses) of the sustain discharge period and thereafter brought into the floating state.

The Fifth Preferred Embodiment

Figures 19A, 19B, 19C:
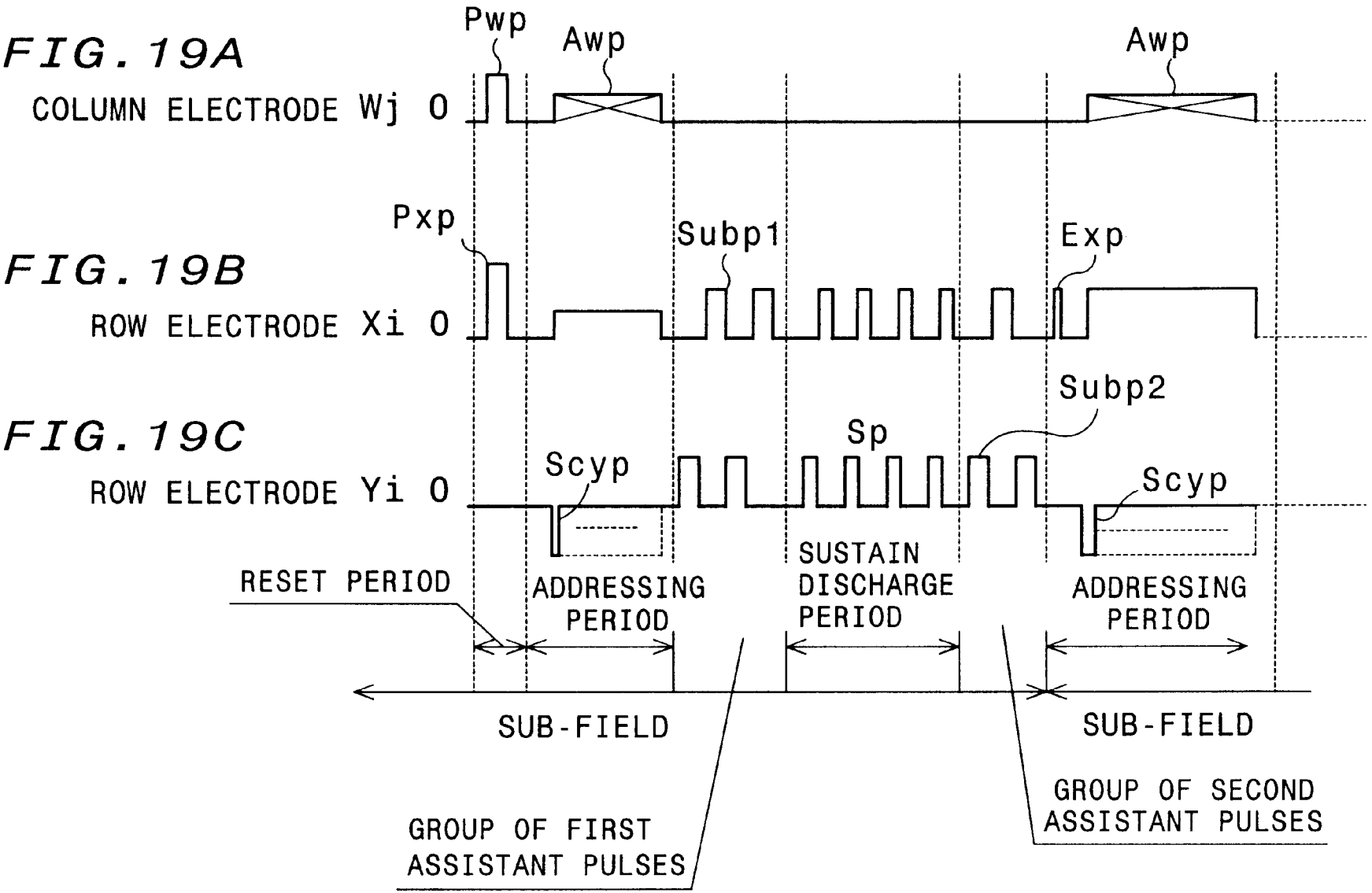
FIGS. 19A to 19C are voltage-waveform charts showing a method of driving a plasma display panel in accordance with a fifth preferred embodiment of the present invention.

Now, the fifth preferred embodiment will be discussed. The prior-art panel of FIG. 32 may be also used. FIGS. 19A to 19C are voltage-waveform charts (timing charts) showing a method of driving a plasma display panel in accordance with the fifth preferred embodiment of the present invention. FIGS. 19A to 19C shows the waveforms of voltages applied to the column electrode Wj, the first row electrode Xi and the second row electrode Yi, respectively. The priming pulse (full-screen write pulse) Pxp is applied to the electrode Xi to perform the full-screen write and the full-screen erase and the pulse Pwp is applied to the electrode Wj at the same timing as the pulse Pxp. These pulses may be applied every several sub-fields or every sub-field. When the pulse Pxp is applied every several sub-fields, an erase pulse Exp is applied in the remaining sub-fields. Though a narrow erase pulse is used as the erase pulse Exp in the fifth preferred embodiment, a wide erase pulse and a round pulse may be used. The sustain pulse Sp is applied to cause the sustain discharge, an assistant pulse Subp1 is applied before the sustain discharge, an assistant pulse Subp2 is applied after the sustain discharge, the scan pulse Scyp is applied to perform a scan and the addressing pulse Awp is applied according to the display data. In the fifth preferred embodiment, for example, the priming pulse Pxp is set to have a pulse width of 7 μsec and a voltage of 310 V, the pulse Pwp is set to have a voltage of 150 V, the sustain pulse Sp is set to have a pulse width of 1.5 μsec and a cycle of 4 μsec (an idle period of 0.5 μsec), a voltage of 180 V, a falling rate of 200 μsec, the scan pulse Scyp is set to have a voltage of −180 V, the addressing pulse Awp is set to have a voltage of 60 V, the erase pulse Exp is set to have a voltage of 180 V and a pulse width of 0.5 μsec, and the assistant pulses Subp1 and Subp2 are each set to have a voltage of 180 V, a pulse width of 4 μsec, a falling rate of 200 μsec and an idle period of 1 μsec.

Next, an operation will be discussed. In the reset period at the start of a sub-field, first, the full-screen write pulse Pxp is applied to the first row electrode X (all the first row electrodes X1 to Xn) connected in common to the full screen. Since the pulse has a high voltage of 310 V, a discharge occurs between the first row electrode X and the row second electrode Y to generate a large amount of wall charges. After that, on the fall of the pulse Pxp, another discharge is induced only by the stacked wall charges. Since there is no externally-applied voltage, however, no electric charge of reverse polarity is generated only to reduce the amount of wall charges after the discharge. After the reset period, the addressing period starts. Simultaneously with sequential supply of the negative scan pulses Scyp to the second row electrodes Y1 to Yn which are driven independently of one another, the addressing pulse Awp according to the image data is applied to the column electrode Wj, to discharge the cell to be lighted in a matrix. At this time, a discharge is also caused between the electrodes Xi and Yi by using the discharge between the electrodes Yi and Wj as a trigger, to generate the wall charges on the electrodes Xi and Yi.

In the sustain discharge period, the display cell selected in the addressing period is discharged a specified number of times, to obtain a predetermined display luminance. The sustain pulse Sp in the sustain discharge period is set so as to cause a discharge induced by wall charges on its fall. Specifically, the control is made at a point of 1.5 μsec to fall the voltage where there are a large amount of space charges and the firing voltage is low, a point after an idle period of 0.5 μsec to actively cause the discharge mainly induced by wall charges and a point where the fall time is sufficiently shorter than the time lag of discharge. Though the discharge is sustained by the memory effect using the wall charges in the prior-art sustain discharge, the discharge is sustained by the memory effect using the space charges since the amount of the wall charges is reduced on the fall of the pulse. In the early stage of the sustain discharge period, it is difficult to sustain the discharge because of a small amount of space charges. Therefore, in the early stage of the sustain discharge period, it is necessary to generate a large amount of space charges and stabilize the wall charges. For this, the assistant pulse Subp1 which does not cause a discharge on its fall is applied before the sustain discharge period using the discharge on the fall. Since the assistant pulse Subp1 is wide, having a pulse width of 4 μsec, the space charges generated by the discharge on the rise of the pulse are reduced by the fall. Therefore, the assistant pulse Subp1 does not have any effect of lowering the firing voltage nor causing any discharge on the fall even if it has the same amount of wall charges as the sustain pulse.

The assistant pulse Subp1 of the fifth preferred embodiment has a principal purpose of preventing the discharge on the fall, different from the pulse in relief of the time lag of discharge disclosed in Japanese Patent Application Laid Open Gazette 7-134565. Therefore, it does not have to be a long pulse, and it may be a pulse of any waveform only if it prevents the discharge on the fall.

After the sustain discharge period, the reset period starts again. Since the erase pulse Exp is narrow in width, it is necessary to eliminate the time lag of discharge as much as possible. A time lag as long as or longer than the pulse supply period causes an incomplete erase, and even if a discharge occurs during the pulse supply period, the amount of residual wall charges varies after the erase because of large variation of the cells. The variation in the amounts of residual wall charges leads to a decrease of the addressing margin. To avoid this, the second assistant pulse Subp2 is applied between the sustain discharge period and the reset period. A pulse having a waveform not to cause a discharge on the fall can be used as the second assistant pulse Subp2, like the first assistant pulse Subp1.

Applying the second assistant pulse Subp2 allows the wall charges which decreases during the sustain discharge period to increase. Since the time lag of discharge is generally reduced when a high voltage is applied, a reliable erase can be achieved with the voltage across the discharge gap which is apparently high as the amount of wall charges increases though the erase pulse Exp is equivalent in voltage to the sustain pulse. To eliminate the time lag of discharge as much as possible, as mentioned above, it is desirable that an interval between the second assistant pulse Subp2 and the erase pulse Exp should be as short as possible.

As shown in the fifth preferred embodiment, applying the assistant pulses Subp1 and Subp2 prevents a decrease of the margin that the driving method combining the discharge mainly induced by externally-applied voltage and that mainly induced by wall charges potentially has, to achieve a stable discharge.

Figures 20A, 20B, 20C:
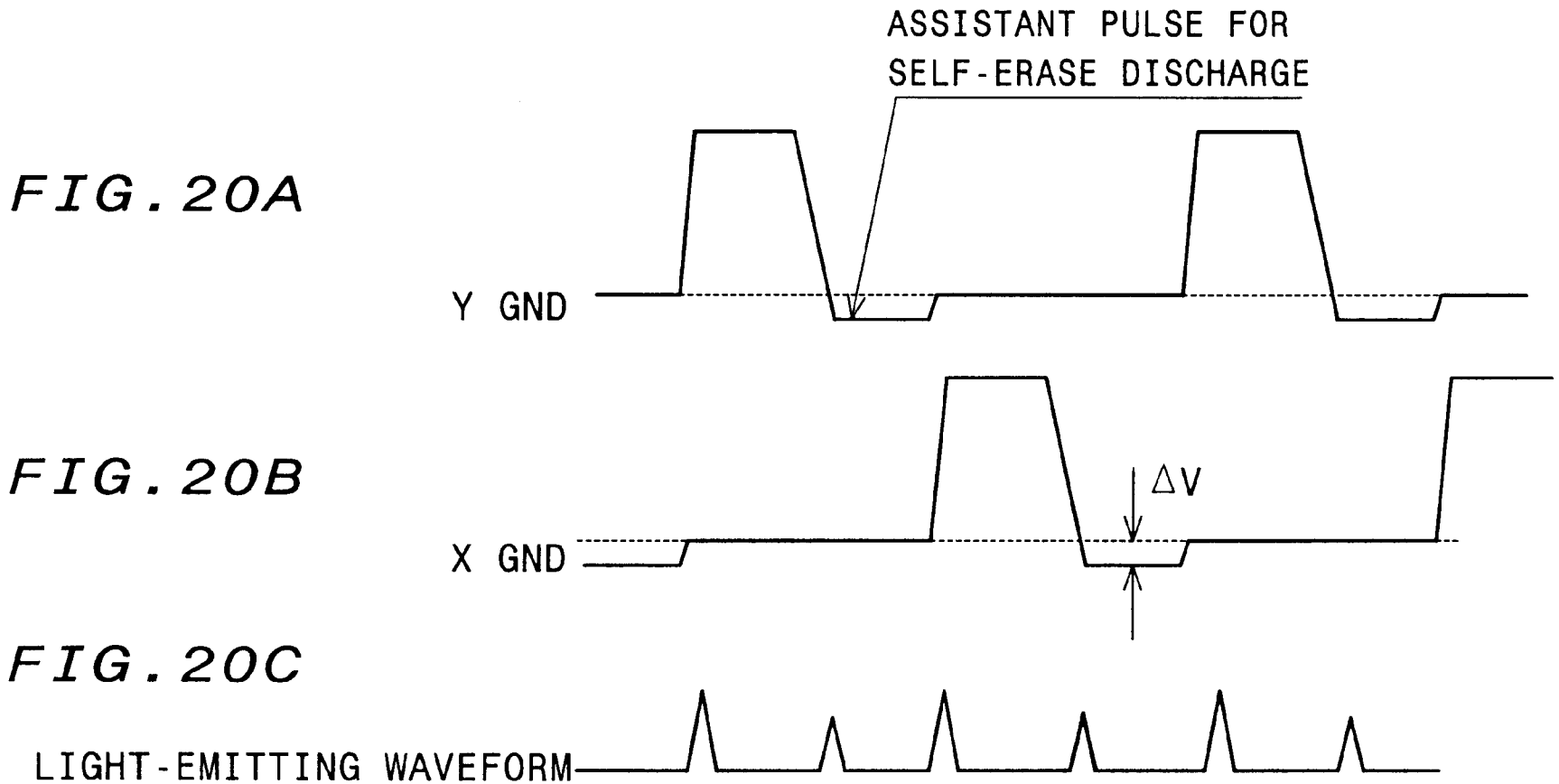
FIGS. 20A to 20C are timing charts showing voltage waveforms and a light-emitting waveform with an assistant pulse for self-erase discharge applied.

The sustain discharge using the discharge on the fall of the fifth preferred embodiment is different from the self-erase discharge by applying a high voltage disclosed in Japanese Patent Application Laid Open Gazette 8-314405, and is intended to reduce the current density for higher efficiency by preventing an increase of the required sustain voltage and to increase the voltage margin. Further, the second discharge mainly induced by wall charges of the fifth preferred embodiment can be achieved by applying the assistant pulse for self-erase discharge of FIGS. 20A to 20C. This further increases the discharge on the fall, to ensure high efficiency.

The Sixth Preferred Embodiment

Figures 21A, 21B, 21C:
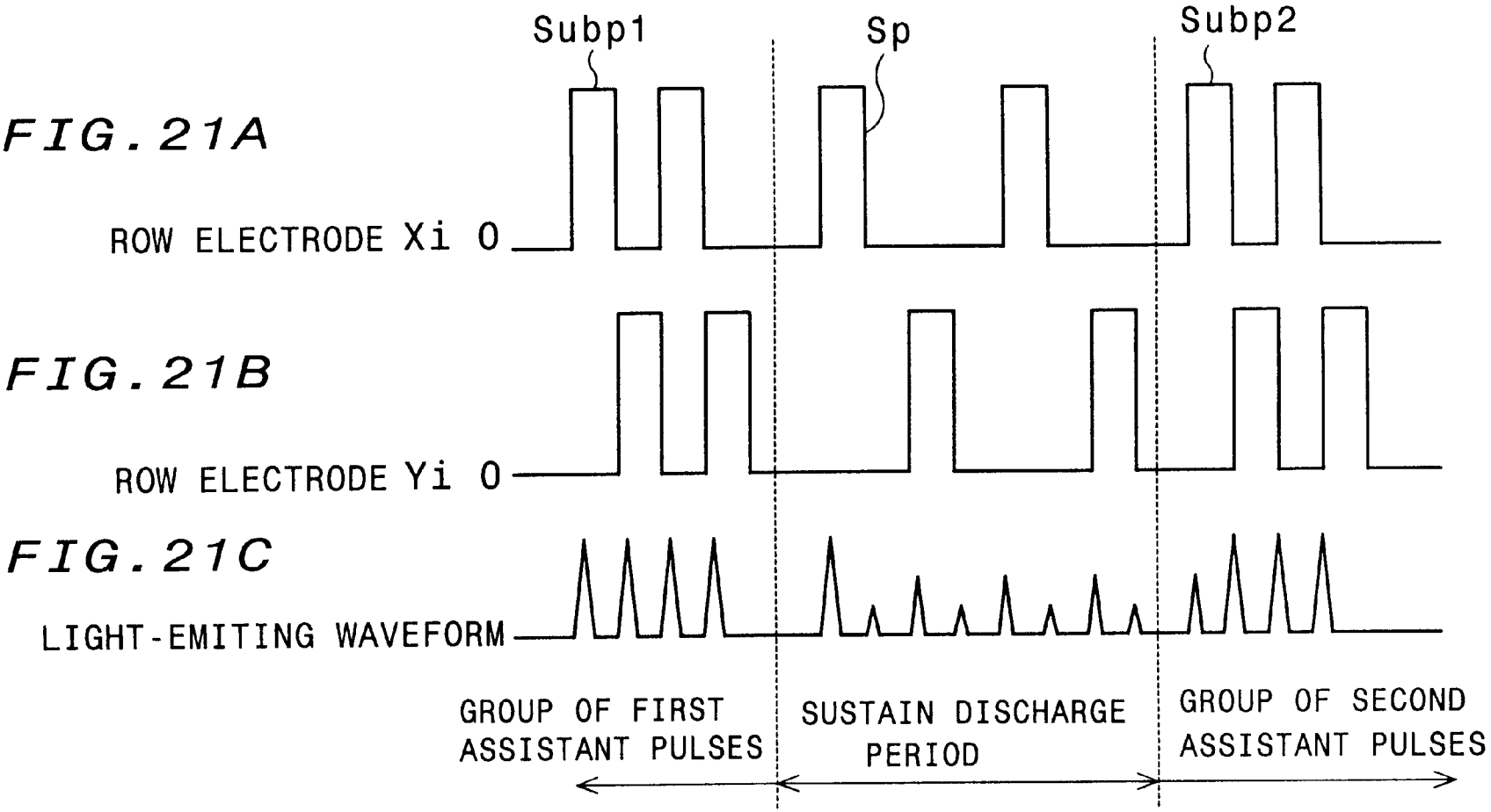
FIGS. 21A to 21C are timing charts of voltage waveforms and a light-emitting waveform showing a form of an assistant pulse in a method of driving a plasma display panel in accordance with a sixth preferred embodiment of the present invention.

Now, the sixth preferred embodiment will be discussed. FIGS. 21A to 21C are timing charts of voltage waveforms and a light-emitting waveform showing a form of an assistant pulse in a method of driving a plasma display panel in accordance with the sixth preferred embodiment of the present invention. In FIGS. 21A to 21C, the sustain pulse Sp is set to have a voltage of 180 V, a pulse width of 1.5 μsec and a cycle of 4 μsec like the fifth preferred embodiment, and the first and second assistant pulses Subp1 and Subpp2 are each set to have a voltage of 180 V, a pulse width of 1.5 μsec and a cycle of 3 μsec (an idle period of 0 μsec).

With no idle period, the sixth preferred embodiment can prevent the discharge on the fall in the assistant discharge, to produce a stable sustain discharge and a stable erase discharge, like the fifth preferred embodiment. Therefore, it is possible to prevent a decrease of the margin that the driving method combining the discharge mainly induced by externally-applied voltage and that mainly induced by wall charges potentially has and achieve a stable discharge. Though the idle period is 0 μsec in the sixth preferred embodiment, an idle period can be provided within a range not to cause the discharge on the fall.

The Seventh Preferred Embodiment

Figures 22A, 22B, 22C:
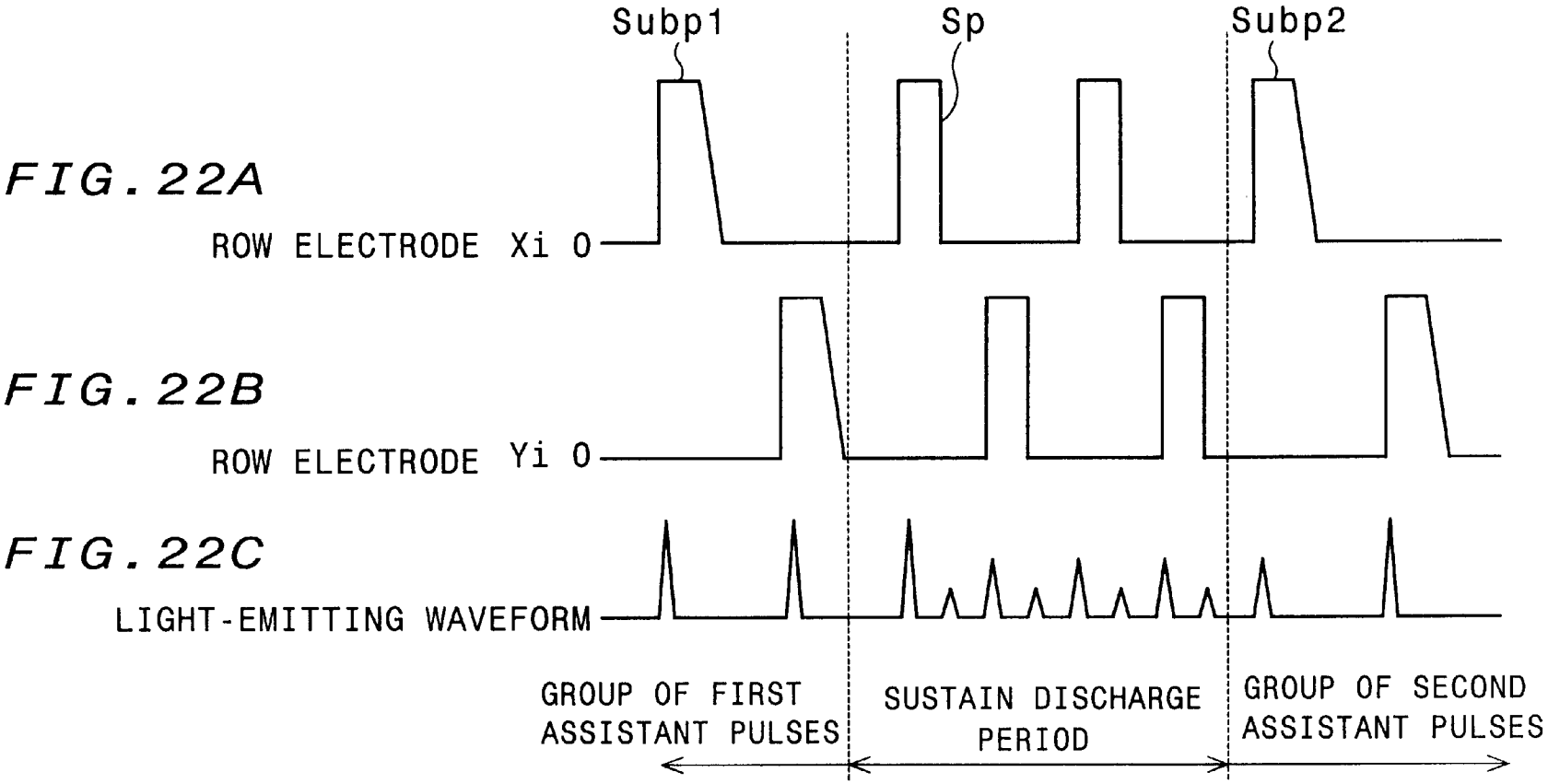
FIGS. 22A to 22C are timing charts of voltage waveforms and a light-emitting waveform showing a form of an assistant pulse in a method of driving a plasma display panel in accordance with a seventh preferred embodiment of the present invention.

Now, the seventh preferred embodiment will be discussed. FIGS. 22A to 22C are timing charts of voltage waveforms and a light-emitting waveform showing a form of an assistant pulse in a method of driving a plasma display panel in accordance with the seventh preferred embodiment of the present invention. In FIGS. 22A to 22C, the sustain pulse Sp is set to have a voltage of 180 V, a pulse width of 1.5 μsec and a cycle of 4 μsec like the fifth preferred embodiment, and the first and second assistant pulses Subp1 and Subp2 are set to have the same values as those of the fifth preferred embodiment. In the seventh preferred embodiment, the sustain pulse Sp has a falling time of 200 nsec and the first and second assistant pulses Subp1 and Subp2 each have a falling time of 600 nsec.

With the falling time of the assistant pulses sufficiently longer than the time lag of the discharge on the fall, like the fifth preferred embodiment, it is possible to prevent the discharge on the fall in the assistant discharge for stable sustain discharge and stable erase discharge. Therefore, it is possible to prevent a decrease of the margin that the driving method combining the discharge mainly induced by externally-applied voltage and that mainly induced by wall charges potentially has and achieve a stable discharge.

Though the first and second assistant pulses Subp1 and Subp2 have the same condition in the fifth to seventh preferred embodiments, these pulses can have individual conditions.

The Eighth Preferred Embodiment

Figure 23:
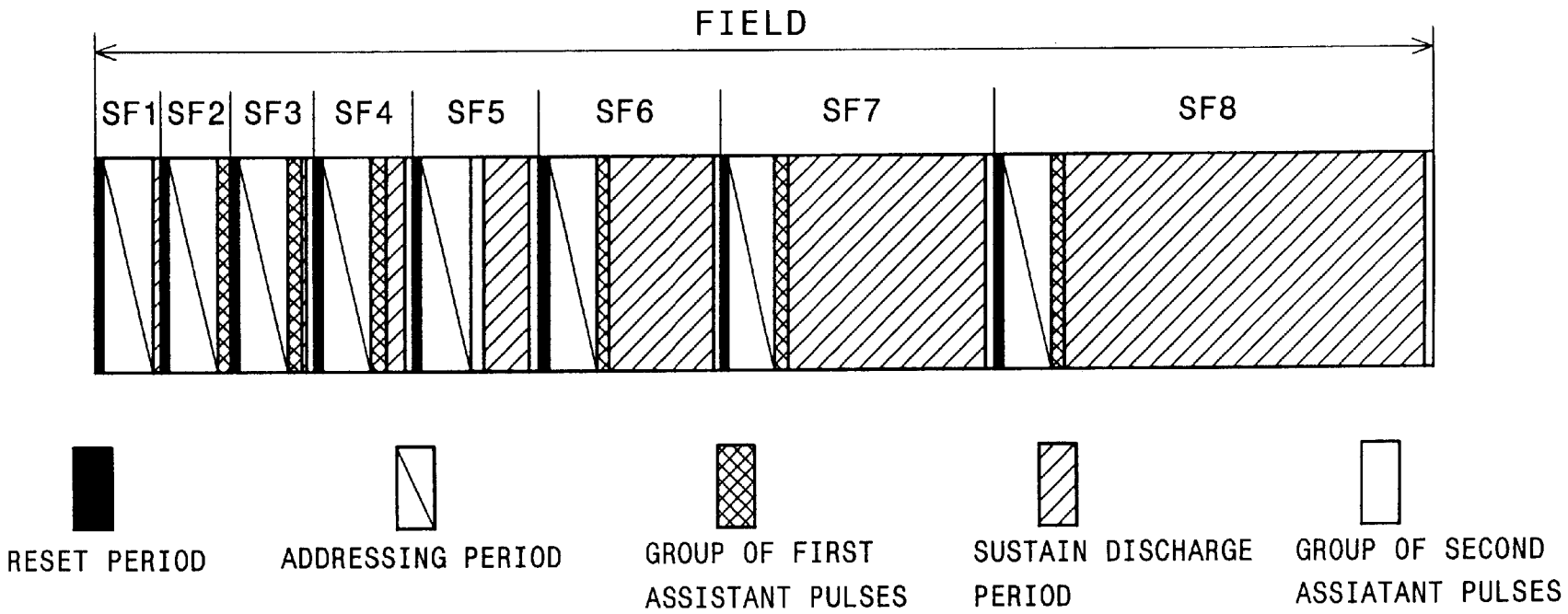
FIG. 23 illustrates a constitution of sub-fields in one field used for a method of driving a plasma display panel in accordance with an eighth preferred embodiment of the present invention.
Figure 24:
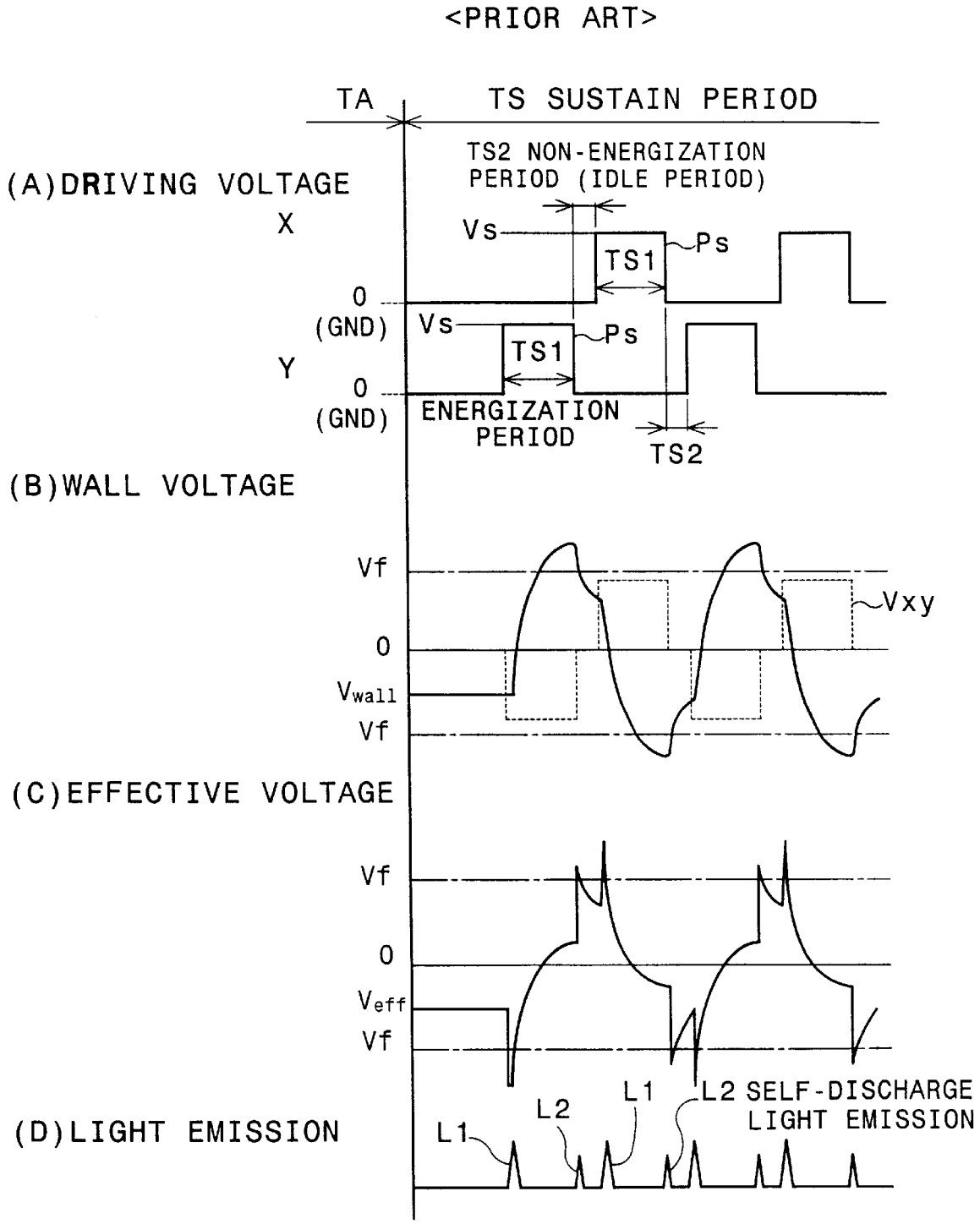
FIG. 24 is a chart showing a prior art disclosed in Japanese Patent Application Laid Open Gazette 8-314405.
Figure 25:
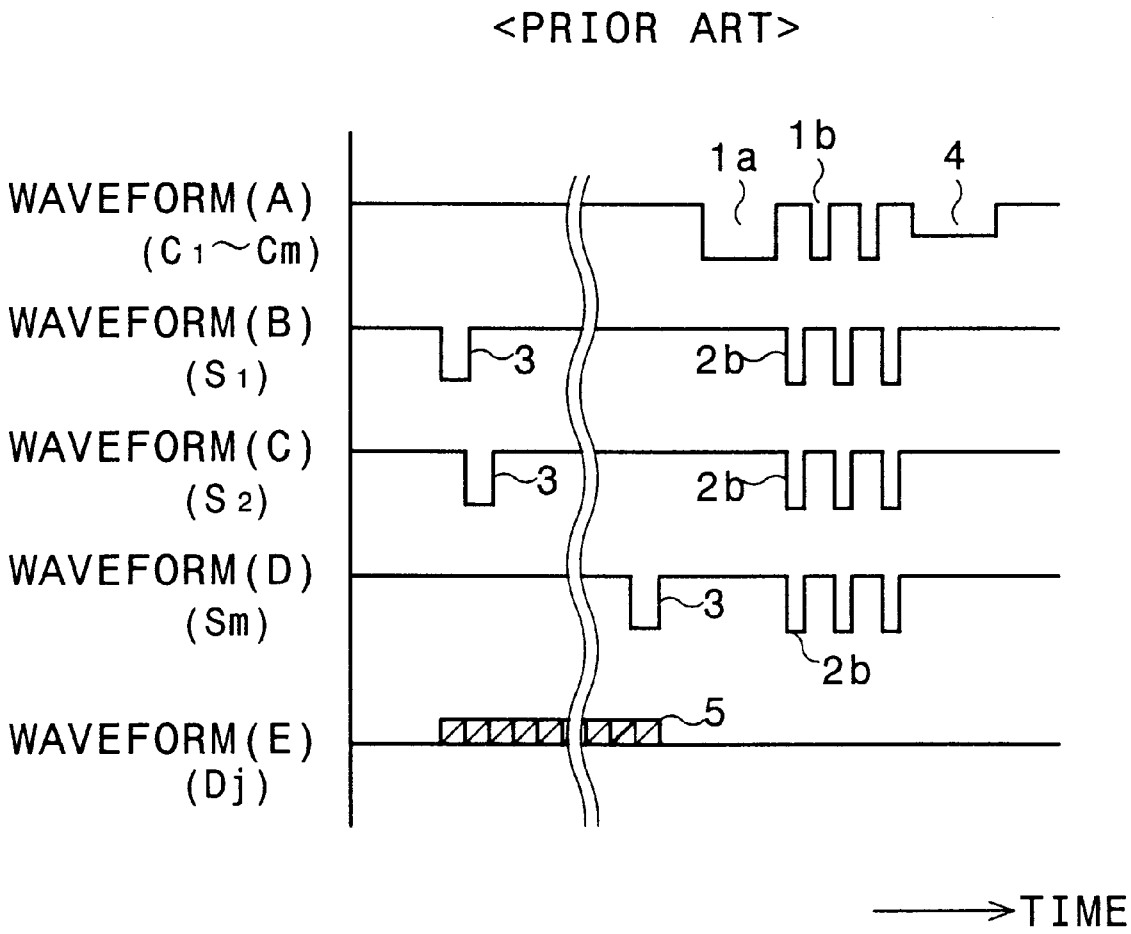
FIG. 25 is a chart showing a prior art disclosed in Japanese Patent Application Laid Open Gazette 7-134565.

Now, the eighth preferred embodiment will be discussed. FIG. 23 illustrates a constitution of sub-fields in one field used for a method of driving a plasma display panel in accordance with the eighth preferred embodiment of the present invention. One field consists of eight sub-fields and in each sub-field, binary is weighted with the sustain pulse. The sub-field having the least information is generally termed "LSB" and those having the second least information, the third least information . . . are termed "2LSB", "3LSB" . . . , respectively. On the other hand, the sub-field having the most information is generally termed "MSB" and those having the second most information, the third most information . . . are termed "2MSB", "3MSB" . . . , respectively. In the eighth preferred embodiment, the total of pulse cycles is 255 and from the LSB, binary is sequentially weighted to 1, 2, 4, 8, 16, 32, 64 and 128. In the eighth preferred embodiment, only the first assistant pulse Subp1 is applied in each of the LSB and 2LSB and the first assistant pulse Subp1 is applied for two cycles and the second assistant pulse Subp2 is applied for one cycle in each of the sub-fields from the 3LSB on. The sustain pulse Sp is applied for the remaining of the allocated pulse cycles. For example, the sustain pulse Sp is applied for one cycle in the 3LSB and for 125 cycles in the MSB. A pulse of any form shown in the fifth to seventh preferred embodiments may be used as the assistant pulse in the eighth preferred embodiment. In particular, the discharge mainly induced by wall charges which easily causes a decrease of margin is not used in a low-level tone bit where few space charges exist and the growth of the wall charges is not expected, but actively used only in a high-level tone bit where it is relatively easy to stably sustain the discharge, to prevent the decrease of margin and achieve a stable discharge.

It is difficult to insert the first and second assistant pulses Subp1 and Subp2 in all the sub-fields in performing the gradation display. Therefore, in the eighth preferred embodiment, the sustain discharge using the discharge on the fall is not performed in a sub-field having little luminance information. It is natural that this constitution can be made of only the LSB or the LSB to the 2LSB or to 3LSB. Considering the improvement in efficiency by using the discharge on the fall in the sustain discharge period, this constitution can be used.

In the eighth preferred embodiment, the number of the first assistant pulses Subp1 is set larger than the number of the second assistant pulses Subp2. This is because there are a small amount of space charges in a period for applying the first assistant pulse Subp1 and there are a large amount of space charges in a period for applying the second assistant pulse Subp2.

The Ninth Preferred Embodiment

Figure 26:
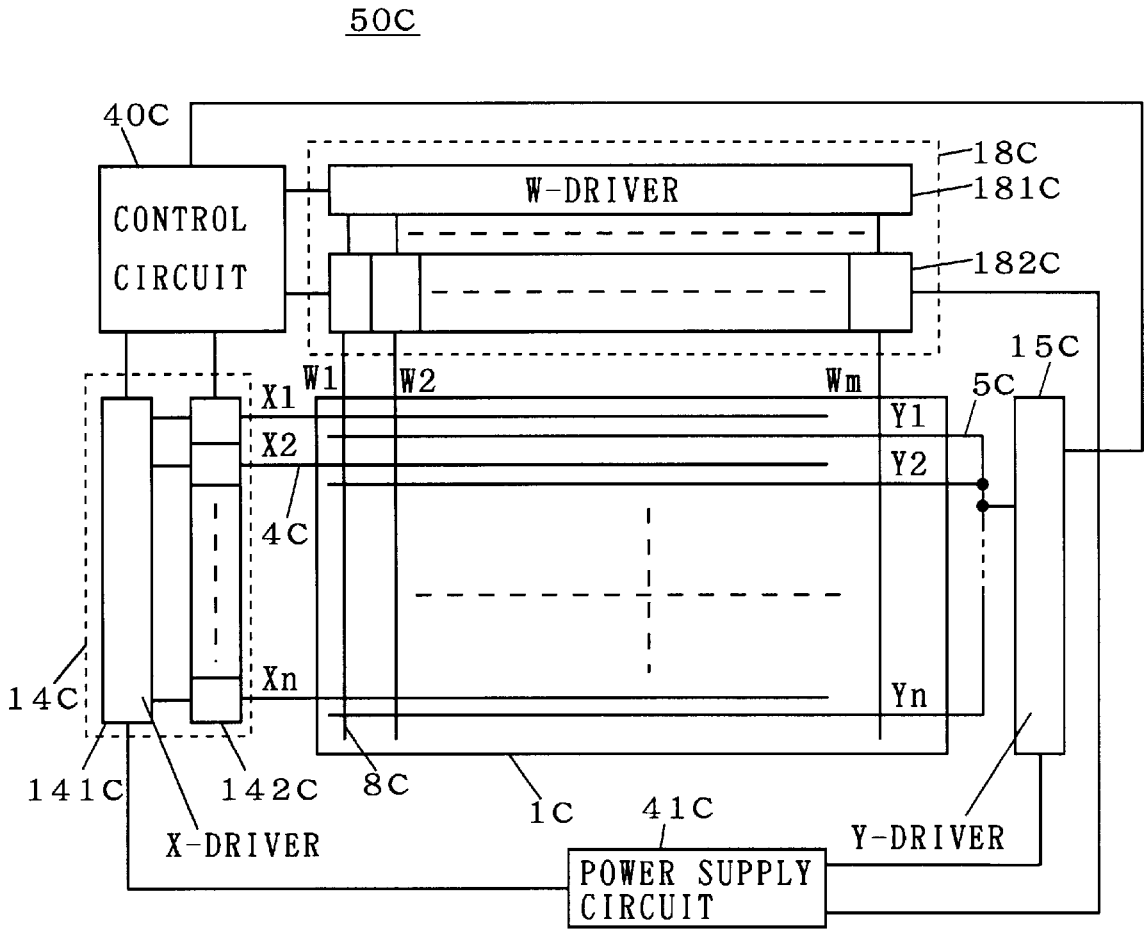
FIG. 26 is a block diagram showing an overall configuration of a surface-discharge type AC plasma display panel device in accordance with a ninth preferred embodiment of the present invention.

FIG. 26 is a block diagram showing an overall configuration of a surface-discharge type AC PDP (Plasma Display Panel) device 50C in accordance with the ninth preferred embodiment of the present invention, which is basically equivalent to the configuration disclosed in Japanese Patent Application Laid Open Gazette 7-160218. As discussed later, a driving circuit 18C for the column electrode Wj is a heart of the ninth preferred embodiment and is not included in the prior-art circuit. As a surface-discharge type AC PDP 1C of FIG. 26, the prior-art AC-PDP 101C of FIG. 32 can be used.

In FIG. 26, the PDP 1C comprises n first electrodes 4C and n second electrodes 5C in pairs and m third electrodes 8C crossing the first and second electrodes 4C and 5C. In the following discussion, the first and second electrodes 4C and 5C are termed "row electrode 4C" and "row electrode 5C", respectively, and the third electrode 8C is termed "column electrode 8C". Further, as necessary, each of the n row electrodes 4C is termed "row electrode Xi (i: 1 to n), each of the n row electrodes 5C is termed "row electrode Yk (k: 1 to n) and each of the m column electrodes 8C is termed "column electrode Wj (j: 1 to m) for distinction. Further, the row electrodes X1 to Xn are termed "row electrode X" as a single unit, the row electrodes Y1 to Yn are termed "row electrode Y" as a single unit and the column electrodes W1 to Wm are termed "column electrode W" as a single unit. In the PDP device 50C, the n row electrodes 5C are driven by a single driving signal connected in common to their one ends, as shown in FIG. 26, but may be naturally driven separately.

The PDP device 50C further comprises a driving circuit 14C for the row electrode X, a driving circuit 15C for the row electrode Y and the driving circuit 18C for the column electrode W. Respective voltages are supplied for the electrodes 4C, 5C and 8C from a power-supply circuit 41C through the driving circuits 14C, 15C and 18C in response to a video signal, a control signal generated by a control circuit 40C and the like.

The method of driving the PDP device 50C will be discussed below.

Figures 27A, 27B, 27C, 27D:
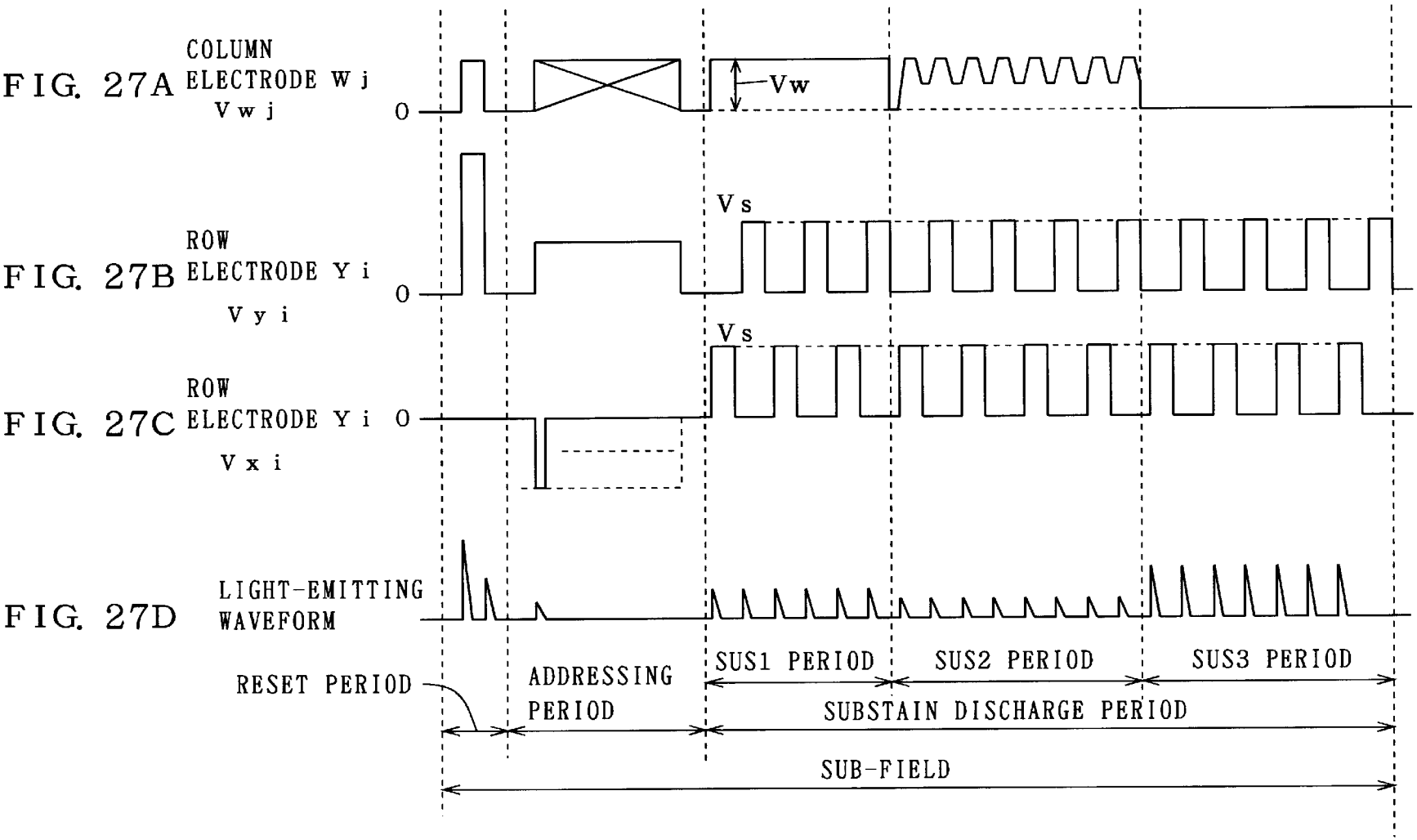
FIGS. 27A to 27D are timing charts showing driving waveforms and a light-emitting waveform of the surface-discharge type AC plasma display panel in accordance with the ninth preferred embodiment of the present invention.

FIGS. 27A to 27D are timing charts showing driving waveforms and a light-emitting waveform of the PDP device 50C. These figures show the driving waveforms of one sub-field period in a sub-field (SF) driving method. FIGS. 27A to 27C show the waveforms of voltages applied to the column electrode Wj, the row electrode Yi and the row electrode Xi, respectively, and FIG. 27D shows the light-emitting waveform of a cell positioned at a matrix (i, j). Though the PDP device 50C is driven mainly with positive pulses as shown in FIGS. 27A to 27D in the ninth preferred embodiment, it can be naturally driven with the pulses of reverse polarity.

In this driving method, one frame (F) for image display is divided into a plurality periods as shown in FIGS. 27A to 27D, and further one sub-field period is divided into three periods, i.e., the "reset period", the "addressing period" and the "sustain discharge period (display period)". The characteristic feature of the ninth preferred embodiment lies in the driving method in the sustain discharge period, and the prior-art driving method of FIGS. 33A to 33E can be used in the reset period and the addressing period. Hereafter, the methods of driving the PDP device 50C in those periods will be discussed, to clarify the essence of the driving method of the ninth preferred embodiment.

(Reset Period and Addressing Period)

In the "reset period", first, the full-screen write pulse is applied between the column electrode W (all the column electrodes W1 to Wm) and the row electrode Y, to erase the display history at the ending point of the immediately preceding sub-field and the priming particles are supplied.

In the "addressing period", secondly, the addressing discharge (write discharge) is produced selectively for a cell to be lighted. Then, with this discharge as a trigger, the discharge is immediately caused between the row electrodes Xi and Yi. Therefore, the wall charges are stacked on a surface of a dielectric layer 6C or 6AC (which corresponds to the dielectric layer 106C or 106AC of FIG. 32, see FIG. 28A) on the row electrodes Xi and Yi of that cell and a surface of a phosphor layer 9C (which corresponds to the phosphor layer 109C of FIG. 32, see FIG. 28A) which is a dielectric layer on the column electrode Wj.

(Sustain Discharge Period)

In the "sustain discharge period", finally, by applying the sustain pulse to the row electrodes Xi and Yi, the sustain discharge in this sub-field is produced on the cell in which a write is made in the addressing period.

The sustain discharge period of the ninth preferred embodiment is further divided into three periods, i.e., an SUS1 period which is the first period, an SUS2 period which is the second period following the SUS1 period and an SUS3 period which is the third period following the SUS2 period, as shown in FIGS. 27A to 27D. As discussed later, the potential of the column electrode Wj is switched in each period to make a fine tune of luminance for fluent gradation display. The sustain discharge during this sustain discharge period includes only the discharge mainly induced by externally-applied voltage.

(SUS1 Period)

Figures 28A, 28B, 28C:
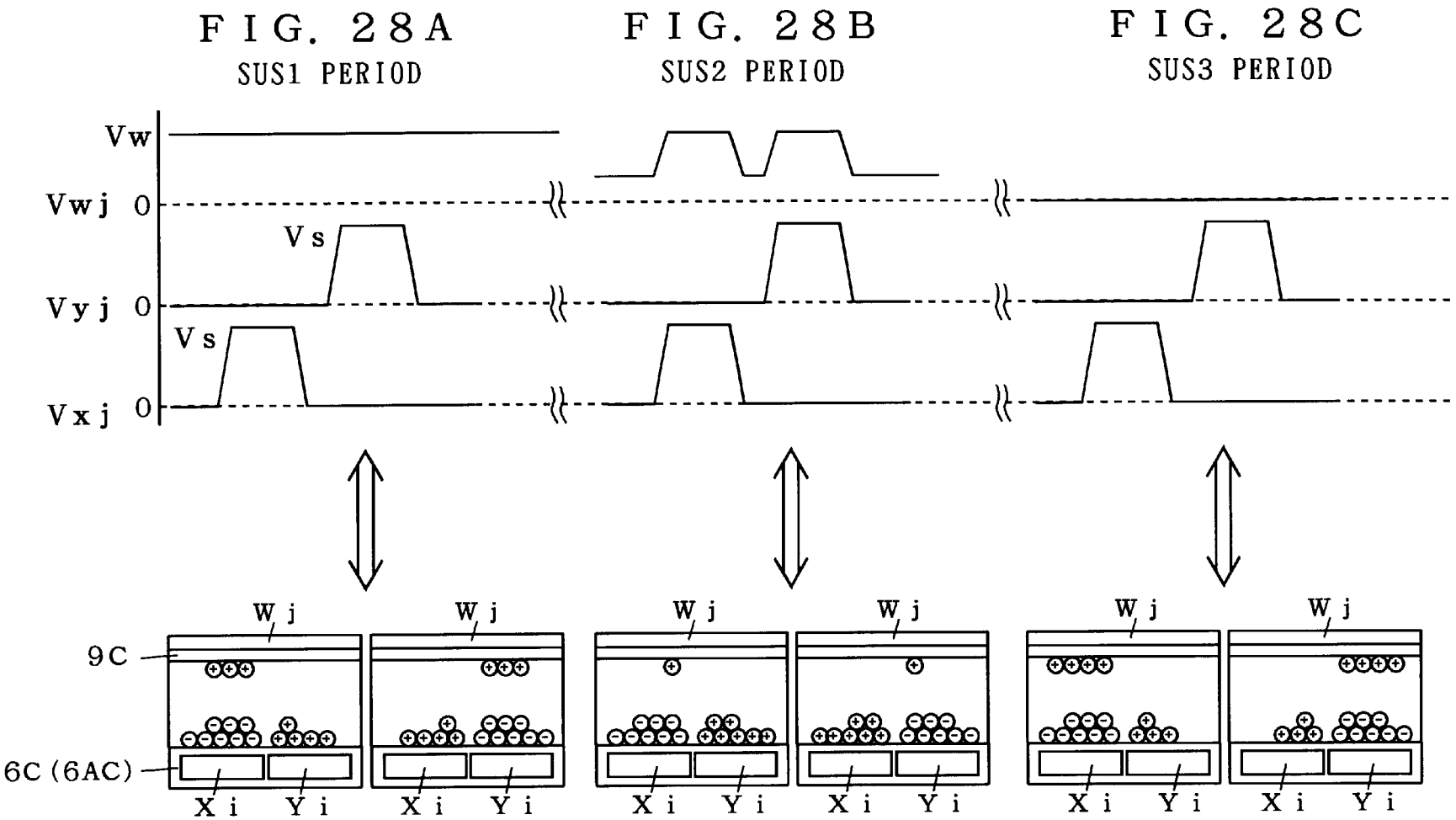
FIGS. 28A to 28C are schematic views showing charge distribution during a sustain discharge period in a driving method in accordance with the ninth preferred embodiment of the present invention.

FIGS. 28A to 28C are schematic views showing a relation between voltages applied to the electrodes Xi, Yi and Wj in each period of the sustain discharge period shown in FIGS. 27A to 27C and the wall charges stacked above each of these electrodes. FIG. 28A shows the relation in the SUS1 period.

As shown in FIG. 28A, when a voltage Vxi=Vs (sustain voltage) is applied to the row electrode Xi, a voltage Vyi=0 V (ground potential) is applied to the row electrode Yi and a voltage Vwj=Vw (0<Vw<Vs) is applied to the column electrode Wj, after the sustain discharge stacked are a certain amount of wall charges according to the respective potentials of the electrodes 4C, 5C and 8C. Specifically, negative charges are stacked on the surface of the dielectric layer 6C or 6AC on the row electrode Xi, positive charges are stacked on the surface of the dielectric layer 6C or 6AC on the row electrode Yi and positive charges are stacked on the surface of the phosphor layer 9C on the column electrode Wj facing the row electrode Xi. Therefore, there arises a non-uniform charge distribution between a region (hereinafter, referred to as "Xij region") facing the row electrode Xi and a region (hereinafter, referred to as "Yij region") facing the row electrode Yi on the surface of the phosphor layer 9C of the column electrode Wj.

Subsequently, when a voltage Vxi=0 and a voltage Vyi=Vs are applied, the discharge occurs between the row electrode Xi or Yi and the column electrode Wj, which are caused by the above charge distribution, as well as between the row electrodes Xi and Yi. At this time, due to the potential Vwj=Vw, no charge exists on the Xij region and the positive charges are stacked on the Yij region. In this state, when the next sustain pulse is applied, the discharge also occurs between the row electrode Xi or Yi and the column electrode Wj.

The magnitude of the discharge between the row electrode Xi or Yi and the column electrode Wj depends on the amount of wall charges on the column electrode Wj, in other words, the non-uniform charge distribution between the Xij region and the Yij region. The charge distribution depends on the potential difference between the voltages Vs and Vw, as well as varies with the potential Vxi or Vyi of the row electrode Xi or Yi, respectively, and therefore it is possible to control the magnitude of the discharge with the potential Vwj (=Vw) of the column electrode Wj. Specifically, when the voltage Vs of the sustain pulse is a constant value, as the potential Vw increases from 0 V, the discharge between the row electrode Xi or Yi and the column electrode Wj decreases and reaches the minimum value when the potential Vw=Vs/2. Further, when the potential Vw increases, the above discharge increases again. This is because when the potential Vw>Vs, the column electrode Wj works as an anode to cause a discharge between the row electrodes Xi and Yi.

In the SUS1 period, the magnitude of the discharge between the row electrodes Xi and Yi is minimum with the potential Vw=Vs/2 which is applied to the potential of the column electrode Wj. In the ninth preferred embodiment, as the desired light-emitting intensity (luminance) in the SUS1 period chosen is the luminance with the potential Vw=Vs/2 and the potential Vw can take other value. Since the effect in the prior-art ① can be achieved by setting the potential Vw=Vs/2, as discussed earlier, this driving method in the SUS1 period is regarded as preferable one.

Further, it is possible to control the amount of wall charges to be stacked above the column electrode Wj to be constant by setting the potential Vw to a constant value (=Vs/2). For example, even if excess negative wall charges are stacked in the phosphor layer 9C on the column electrode Wj at the ending point of the addressing period and the column electrode Wj works as a cathode to generate a large amount of positive charges when the first sustain pulse of the sustain discharge period, in other words, the first sustain pulse of the SUS1 period is applied, unnecessary wall charges are not stacked on the side of the column electrode Wj since the discharge can be produced again during the idle period (while both the row electrodes Xi and Yi are in ground potential).

(SUS2 Period)

In the SUS2 period following the SUS1 period, no discharge occurs between the row electrode Xi or Yi and the column electrode Wj. The light emission of this case will be discussed. Specifically, in this period, by bringing an output end of the driving circuit 18C for the column electrode Wj of FIG. 26, i.e., an output end of a data W-driver IC 182C into high impedance, the potential Vwj of the column electrode Wj follows the variation of the potential Vxi or Vyi of the row electrode Xi or Yi as shown in FIG. 27A. Thus, when the potential Vwj follows the potential Vxi or Vyi, as shown in FIG. 28B, few wall charges are stacked in the Xij region and the Yij region and most of the wall charges are stacked above the dielectric layer on the row electrodes Xi and Yi. Therefore, since the substantial potential difference between the row electrode Xi or Yi and the column electrode Wj never exceeds the firing voltage, no discharge occurs between the row electrode Xi or Yi and the column electrode Wj and the discharge occurs only between the row electrodes Xi and Yi. The potential Vwj also depends on the width of the sustain pulse applied to the row electrodes Xi and Yi, the idle period and the sustain voltage Vs.

Next discussion will be presented on a driving method of bringing the output end of the driving circuit 18C for the column electrode Wj into high impedance.

Figure 29:
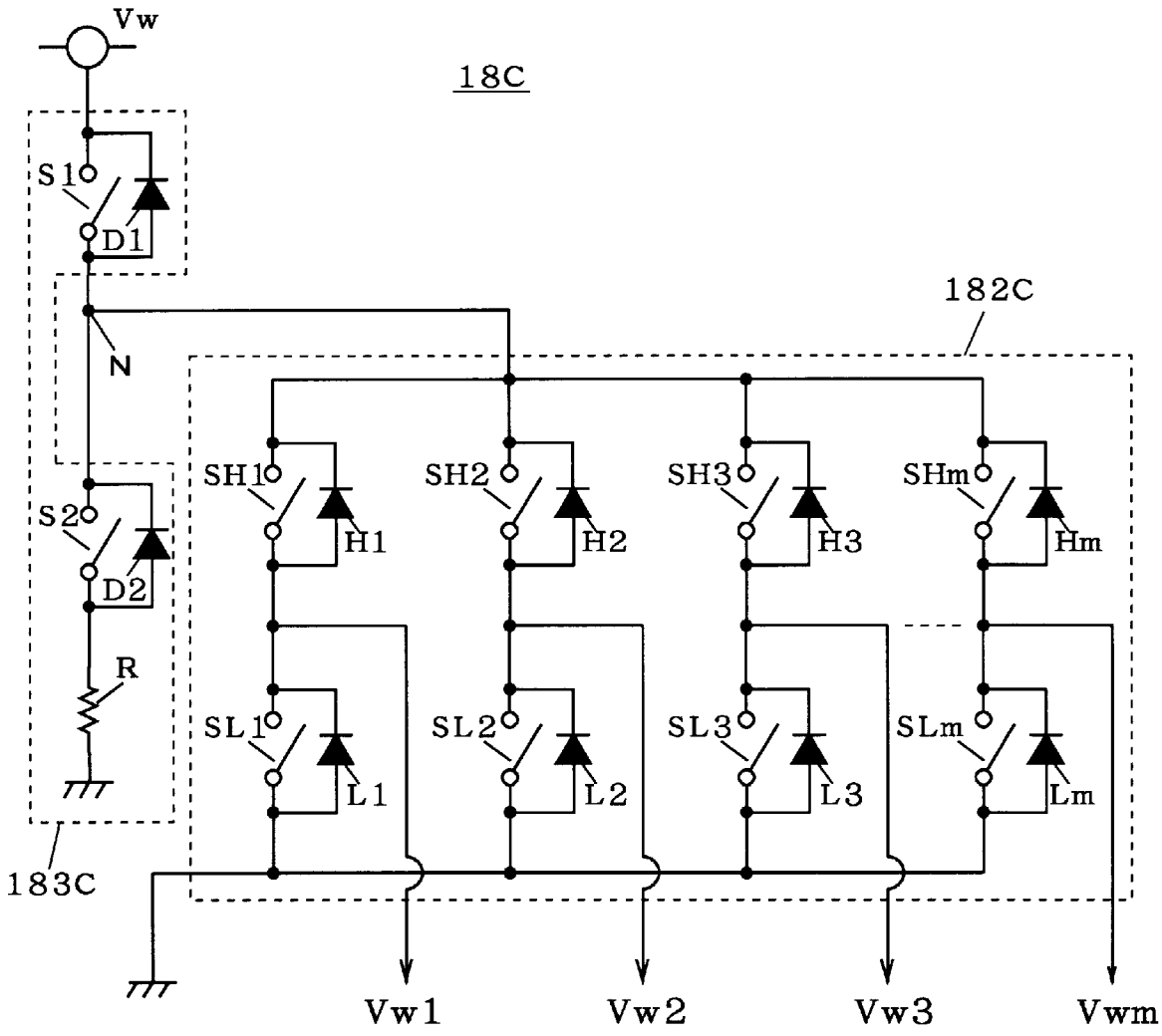
FIG. 29 is a circuit diagram showing a driving circuit for a column electrode in accordance with the ninth preferred embodiment of the present invention.

FIG. 29 illustrates a configuration of the driving circuit 18C for the column electrode Wj of FIG. 26 comprising the data W-driver IC 182C which is a circuit for generating an output potential Vwj (j: 1 to m) of each column electrode Wj (j: 1 to m). In the data W-driver IC 182C of a column electrode W1, for example, a power supply Vw is connected to a cathode of body diode H1 (a switch S1 is an element included in a circuit 183C as discussed later and herein regarded as closed (shorted)), an anode of the diode H1 is connected to a cathode of a diode L1 and an anode of the diode L1 is grounded. A switch SH1 is connected in parallel to the diode H1 and a switch SL1 is connected in parallel to the diode L1. The output potential Vwj is outputted as a potential of the anode of the diode H1. Switches SH1 to SHm and SL1 to Lm are controlled by the W-driver 181C of FIG. 26.

Opening all the switches SH1 to SHm and SL1 to Lm brings the output end of the driving circuit 18C for the column electrode Wj into high impedance. In this state, when the sustain pulse Vs is applied to the row electrodes Xi and Yi, the potential Vwj of the column electrode Wj varies, following (pumped with) the variation of the potential Vxi or Vyi of the row electrode Xi or Yi since the row electrode Xi or Yi and the column electrode Wj are capacity coupled. At this time, even if the potential Vwj becomes very high as the result of following the potential Vxi or Vyi, the potential Vwj does not become higher than the potential Vw since a current flows through the body diode H1.

Conversely, on the fall of the sustain pulse applied to the row electrode Xi or Yi, the potential Vwj follows the variation of the potential Vxi or Vyi to fall. At this time, even if the potential Vwj becomes very low as the result of following the potential Vxi or Vyi, the potential Vwj does not become lower than the ground potential since a current flows through the body diode L1.

The data W-driver IC 182C has the above function of making a high-impedance state. There is usually few cases, however, where an IC is used with its output end in a high-impedance state. This SUS2 period has an essential feature of actively using the high-impedance state and thereby produces an effect of reducing power consumption of the driving circuit 18C for the column electrode Wj.

The essential feature of the SUS2 period lying in that no discharge occurs between the row electrode Xi or Yi and the column electrode Wj can be achieved by changing the potential Vwj to follow the variation of the potential Vxi or Vyi, instead of bringing the output end of the driving circuit 18C for the column electrode Wj into high impedance. Hence, there may be a driving method of applying a pulse in synchronization with the sustain pulse applied to the row electrode Xi or Yi to the column electrode Wj, but the method has a disadvantage of needing a complicate circuit configuration. For this reason, the driving method of bringing the output end of the driving circuit 18C for the column electrode Wj into the high-impedance state, like the SUS2 period of this preferred embodiment, is preferable.

Further, there can be a case where a circuit 183C of FIG. 29 is provided to enhance the responsivity of potential variation of the column electrode Wj. The circuit 183C has a configuration where one end of a switch S2 and one end of a diode D2 are connected in common to a side of the power supply Vw in parallel to the data W-driver IC 182C, and the other ends of the switch S2 and the diode D2 are connected in common to one end of a resistor R and the other end of the resistor R is grounded. Further, the circuit 183C comprises the switch S1 and the diode D1 connected in parallel to the switch S1 (the cathode of the diode L1 is connected to the side of the power supply Vw and the anode thereof is connected to a side of a junction point (node) N) between the power supply Vw and the junction point N.

Since the output end of the data W-driver IC 182C is brought into high impedance and at the same time the switch S1 is opened and the switch S2 is closed in the circuit 183C to ground the diodes H1 to Hm through the resistor R, the responsivity of potential variation of the column electrode Wj becomes higher than that without the circuit 183C. It is naturally that the resistor R connected in parallel to the data W-driver IC 182C, i.e., the driving circuit 18C for the column electrode Wj is an indispensable element in the circuit 183C since the above effect is caused by the resistor R.

When the switch S1 is opened, the potential Vwj of the column electrode Wj does not become higher than the potential Vw since the circuit 183C comprises the diode D1.

(SUS3 Period)

In the SUS3 period following the SUS2 period, the potential Vwj of the column electrode Wj is switched from a potential following the potential Vxi or Vyi to the ground potential and thereafter kept at the ground potential. Therefore, as shown in FIG. 28C, since the amount of wall charges stacked in the Xij region or the Yij region becomes almost the same as the amount of charges on the side of the row electrode in the ground potential among the row electrodes Xi and Yi, the column electrode Wj is more related to the discharge between the row electrodes Xi and Yi in this SUS3 period than in the SUS1 and SUS2 periods when the sustain pulse is applied to the row electrodes Xi and Yi. In the SUS3 period, as shown in FIG. 27D, it is possible to obtain a higher light-emitting intensity than that in the SUS1 and SUS2 periods. It is natural that if the potential Vwj can become negative, a still higher light-emitting intensity can be thereby obtained.

In a period following the SUS3 period, i.e., the reset period (addressing period in some cases) of the next subfield, when a large amount of positive charges are needed on the Xij region or the Yij region, it is possible to use the wall charges on the Xij region or the Yij region at the ending point of the SUS3 period by setting the SUS3 period in the last stage of the sustain discharge period.

Since the discharge between the row electrodes Xi and Yi is mainly established during the sustain discharge period, there are few cases where the phosphor layer is deteriorated by sputtering and the like with ions generated by the discharge.

(Light Emission during Sustain Discharge Period)

Now, a light emission of the PDP achieved by the driving method in the SUS1 to SUS3 periods will be discussed below.

The light-emitting intensity (luminance) is highest in the SUS3 period, lower in the SUS2 period and lowest in the SUS1 period. Moreover, the luminance difference can be obtained in each period only by switching the potential Vwj of the column electrode Wj, and this is an essential feature of the method of driving the AC-PDP of the ninth preferred embodiment. Therefore, since the potential Vwj of the column electrode Wj is switched to make a fine tune of luminance during the sustain discharge period and combining the different luminances allows precise linearity in display gradation of the PDP, the driving method of the ninth preferred embodiment can achieve a more fluent gradation display than the prior-art driving method.

Further, in a surface-discharge type AC PDP for color display, using three driving circuits for the column electrode Wj dedicated for read (R), green (G) and blue (B) makes it possible to make a fine tune of luminance for RGB by switching the potential Vw in each of the driving circuits, and therefore still more fluent gradation display can be obtained.

Though the sustain discharge period is divided into three periods to combine the light emissions having three kinds of intensities in the ninth preferred embodiment, a method using two kinds of light-emitting intensities is possible. Combining only the SUS1 period and the SUS2 period of FIGS. 27A to 27D in this method, however, is not sufficient to improve the linearity of display gradation. When the light emission having two kinds of intensities are used, it is necessary to use at least the luminance of the SUS3 period which can be the highest one. From this point of view, the luminance of the SUS1 or SUS2 period lower than that of the SUS3 period is combined with the luminance of the SUS3 period and in the transition to the SUS3 period (at a predetermined timing), the potential of the column electrode Wj is switched from the first potential (>ground potential) which is predetermined to the ground potential. For example, when the SUS3 period follows the SUS1 period, the first potential is (potential Vs of sustain pulse)/2. On the other hand, when the SUS2 period is combined with the following SUS3 period, the first potential follows the potential Vxi or Vyi of the sustain pulse during the SUS2 period and is a potential immediately before the potential of the output end of the driving circuit 18C for the column electrode Wj in the high-impedance state reaches the ground potential.

Further, there can be a case where another SUS1 or SUS2 period follows the SUS3 period, and in this case, the potential Vwj of the column electrode Wj is switched from the ground potential to the first potential not only in the transition to the SUS3 period but also in the transition from the SUS3 period to the SUS1 or SUS2 period (at a predetermined timing). With this considered, the characteristic feature of the ninth preferred embodiment lies in that the potential Vwj is switched between the ground potential and the first potential at the predetermined timing during the sustain discharge period.

Furthermore, combination of luminances can be changed by sub-field. For example, a method seems possible where the relatively lower luminance of the SUS2 period is mostly used near the least significant bit (LSB) in the initial stage of the frame and the high luminance of the SUS3 period is mostly used near the most significant bit (MSB) when one-frame (F) period is divided into a plurality of sub-fields and the binary is weighted in each sub-field period. The driving method can reduce the number of sustain pulses to achieve the same luminance near the MSB where relatively large number of pulses are needed. Therefore, a time surplus created in one frame period or one sub-field period can be effectively used. For example, when the time surplus is allocated to an increase of the addressing period, it is possible to increase the width of the write pulse and that produces an effect of preventing a write failure and the like caused by the time lag of discharge as compared with the prior-art driving method.

Creating the time surplus means that this driving method achieves a faster driving than the prior-art driving method. Therefore, allocating the time surplus to the addressing period for more display lines allows driving of the PDP device having a larger number of pixels (of higher definition) than the prior-art one.

In the 256-level (8 SF) gradation display, the weighting of the luminance in each sub-field of one frame in the prior-art driving method (sub-field gradation) is 1:2:4:8:16:32:64:128. Therefore, the total number of pulses for the desired luminance must be a multiple of 255, i.e., 255, 510, 765 . . . in a small range of choices. If the total number of pulses is 600, at least two values must be prepared as the sustain voltage, and the driving circuit has a complicate configuration and becomes costly. Moreover, the prior-art driving method achieves a predetermined gradation display by providing a period with a limited number of pulses.

By contrast, in the driving method of the ninth preferred embodiment, since the total number of pulses can be chosen optionally to some extent and a desired gradation display can be produced by combining different luminances, it is possible to achieve the maximum luminance with available time length (1 field=16.6 msec in TV display) without breaking gradation as compared with the prior-art driving method.

The Tenth Preferred Embodiment

Figures 31A, 31B, 31C, 31D:
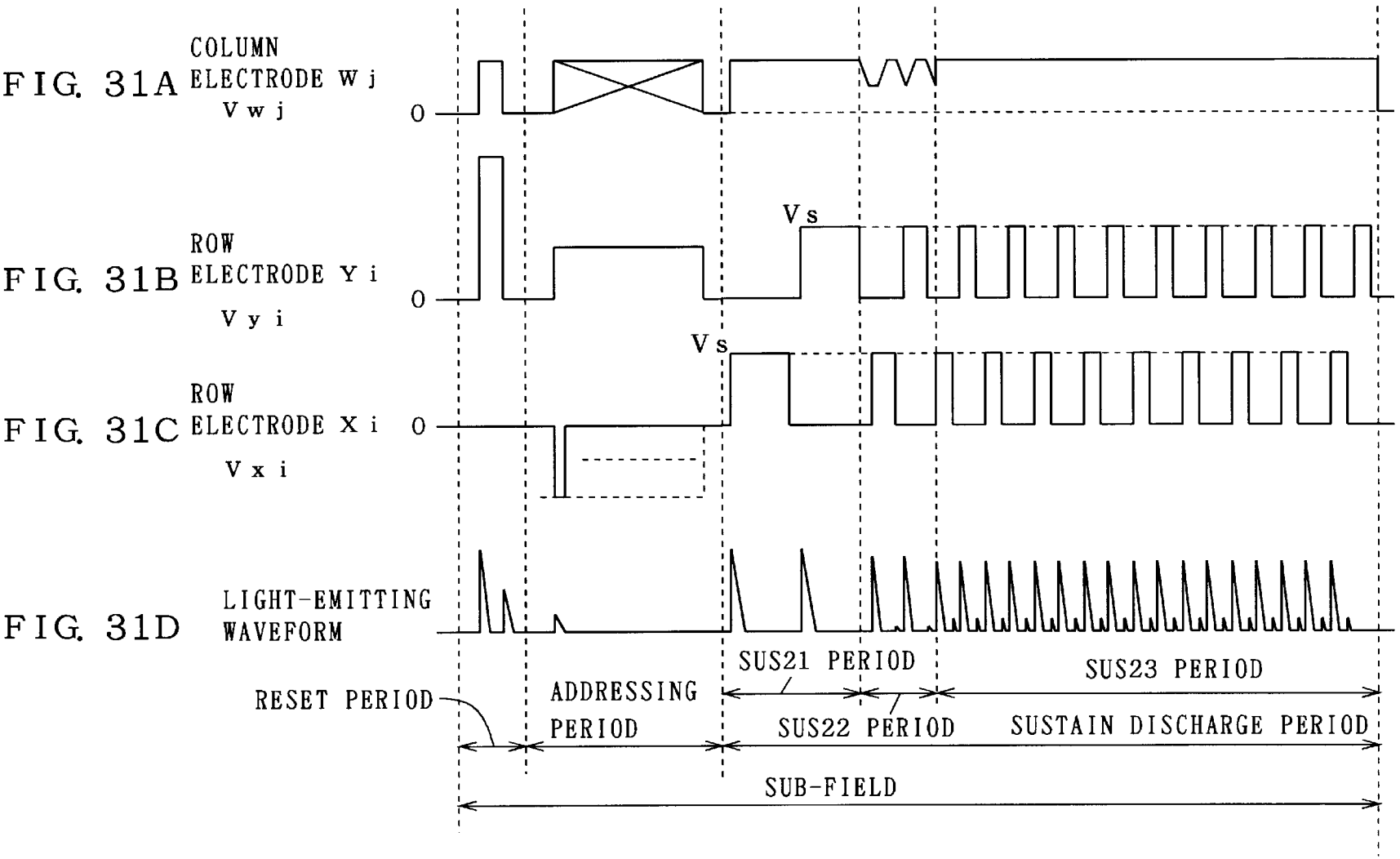
FIGS. 31A to 31D are timing charts showing driving waveforms and a light-emitting waveform of the surface-discharge type AC plasma display panel in accordance with a tenth preferred embodiment of the present invention.

FIGS. 31A to 31D are timing charts showing driving waveforms and a light-emitting waveform of the surface-discharge type AC plasma display panel in accordance with the tenth preferred embodiment, which show the driving waveforms during one sub-field period, like FIGS. 27A to 27D. FIGS. 31A to 31C show the waveforms of voltages applied to the column electrode Wj, the row electrode Yi and the row electrode Xi, respectively, and FIG. 31D shows the light-emitting waveform of a cell positioned at a matrix (i, j). Since the characteristic feature of the tenth preferred embodiment lies in a driving method in the sustain discharge period shown in FIGS. 31A to 31D, a PDP device driven by the present driving method is the same as the PDP device 50C of FIG. 26. Further, the reset period and the addressing period of FIGS. 31A to 31C are the same as those of the driving method of the ninth preferred embodiment (see FIGS. 27A to 27C), in other words, those of the prior-art driving method (see FIGS. 33A to 33E). For this reason, no discussion will be made on the PDP device and the reset and addressing periods of the present driving method.

The essential feature of the driving method of the tenth preferred embodiment lies in that the sustain discharge period is characteristically divided into an SUS21 period, an SUS22 period and an SUS23 period as shown in FIGS. 31A to 31D, and accordingly three different driving methods are performed in these periods. The three periods will be discussed below in detail.

Though the PDP device 50C is driven mainly with positive pulses as shown in FIGS. 31A to 31C in the tenth preferred embodiment, it can be naturally driven with pulses of reverse polarity.

(SUS21 Period)

In the SUS21 period which is the first period of the sustain discharge period, the PDP 1C (see FIG. 26) is driven only by the discharge mainly induced by externally-applied voltage (hereinafter, referred to as "the first discharge"). Since there are few wall charges and space charges in this period at the initial stage of the sustain discharge period, the discharge mainly induced by externally-applied voltage is produced by using the wall charges generated during the immediately preceding addressing period. In other words, the discharge in this period works to generate the wall charges and the space charges. If there are a large amount of wall charges when the self-erase discharge is triggered, an excessive self-erase discharge is likely to occur and the excessive self-erase discharge, which reduces the amount of wall charges more than required, does not cause the following discharge mainly induced by externally-applied voltage and sometimes extinguishes the discharge. In this period with few space charges, particularly, this tendency is strong.

Therefore, the driving method which prevents the excessive self-erase discharge is performed in this period. Specifically, as shown in FIGS. 31A to 31C, a positive pulse having a pulse width of 5.0 μsec and a sustain voltage Vs of 180 V is applied alternately to the row electrodes Xi and Yi, and a time period from the fall of a pulse to the rise of the next pulse, i.e., the idle period is set to 1.0 μsec. A voltage having a potential Vwj of 90 V is applied to the column electrode Wj. Thus, when the pulse width is set to about 4 μsec to 5 μsec at the relatively low voltage level, Vs=180 V, no self-erase discharge occurs since the space charges have been almost reduced on the fall of the sustain pulse.

(SUS22 Period)

The discharge in the SUS22 period (the second period) following the SUS21 period works to make a smooth transition from the discharge of the SUS21 period to that of the SUS23 period discussed later, gradually causing the self-erase discharge which is the discharge mainly induced by wall charges (hereinafter, referred to as "the second discharge") in the SUS23 period. In other words, by adjusting the width and idle period of the sustain pulse and the potential Vwj of the column electrode Wj, an intermediate pulse between the pulses of the SUS21 and SUS23 periods is applied to the row electrodes Xi and Yi, to control the amount of self-erase discharge and gradually cause the self-erase discharge.

Though it seems from the above discussion that the width and the idle period of the sustain pulse has just to be controlled, actually, it is difficult to control the variation of the voltages applied to the cells only by time setting such as setting of the width of the sustain pulse. The present driving method also adjust the potential Vwj of the column electrode Wj, however, and it thereby becomes possible to make a control in accordance with the variation of the voltages applied to the cells.

In the present driving method, specifically, a positive pulse having the width of 2.0 μsec and the sustain voltage Vs of 180 V is applied alternately to the row electrodes Xi and Yi and the idle period is set to 0.7 μsec. Further, the output end of the driving circuit 18C for the column electrode Wj (see FIG. 26) is brought into high impedance. As discussed earlier, since the wall charges above the column electrode Wj are not involved in the surface discharge between the row electrodes Xi and Yi when the output end of the driving circuit 18C for the column electrode Wj is brought into high impedance, the discharge mainly induced by externally-applied voltage is slightly weaken and the self-erase discharge becomes smaller than that of the SUS23 period, and therefore the intermediate pulse between the pulses of the SUS21 and SUS23 periods can be obtained.

Therefore, the driving method in the SUS22 period can effectively prevent the disappearance of discharge due to the excessive self-erase discharge in the immediate transition from the discharge mainly induced by externally-applied voltage (in the SUS21 period) to the discharge combining the discharge mainly induced by externally-applied voltage and that mainly induced by wall charges (in the SUS23 period). Though it is necessary in the prior-art driving method to apply the sustain pulse of relatively high voltage between the row electrodes Xi and Yi, the driving method in the SUS22 period has no necessity for changing the sustain voltage Vs as discussed above in the same period since it can prevent the disappearance of the discharge. Therefore, it is possible to increase a margin of the sustain voltage (sustain pulse) for sustaining the discharge without disappearance, i.e., a margin of the sustain voltage for achieving a stable discharge.

(SUS23 Period)

In the SUS23 period (the third period) following the SUS22 period, a driving method of sequentially causing the first discharge and the second discharge, in other words, a driving method of combining the discharge mainly induced by externally-applied voltage and that mainly induced by wall charges. Specifically, a pulse having a width of 1.3 μsec and voltage Vs of 180C is applied to the row electrodes Xi and Yi and the idle period is set to 0.7 μsec. A voltage Vwj of 90 V is applied to the column electrode Wj.

First, the discharge (self-erase discharge) on the fall of the sustain pulse for the row electrodes Xi and Yi during the SUS23 period will be discussed.

This self-erase discharge is caused by using the space charges generated by the discharge mainly induced by externally-applied voltage on the rise of the sustain pulse for the row electrodes Xi and Yi. Specifically, by quickly falling the sustain pulse in a state where the firing voltage is lowered by a relatively large amount of space charges after the discharge mainly induced by externally-applied voltage, the self-erase discharge is easily induced by the wall charges above the row electrodes Xi and Yi. For this reason, the width of the sustain pulse and the like are set to have the above values in this period.

Next, the discharge on the rise of the sustain pulse for the row electrodes Xi and Yi in this period will be discussed.

In a case of combining the discharge mainly induced by externally-applied voltage and that mainly induced by wall charges, there are few wall charges due to the immediately preceding self-erase discharge on the rise of the sustain pulse. Therefore, the idle period of the sustain pulse is set short in order to surely cause the sustain discharge between the row electrodes Xi and Yi even under this condition. Opposite to the above case, this uses the space charges generated by the immediately preceding discharge mainly induced by wall charges (self-erase discharge). If the idle period is shorter than the time lag of the discharge mainly induced by wall charges (self-erase discharge), no discharge occurs. Therefore, the idle period is so set as to satisfy the relation that (the time lag of the discharge mainly induced by wall charges)<(the idle period of this period)<(the time for extinguishing the space charges generated by the discharge mainly induced by wall charges).

Though the self-erase discharge in this period is discussed on the case of the discharge only induced by wall charges, the externally-applied voltage may be applied supplementally in a direction to increase the discharge during the self-erase discharge only if the discharge is mainly induced by wall charges. For this reason, the definition of "the discharge mainly induced by wall charges" herein includes the supply of the external voltage.

(Light Emission during Sustain Discharge Period)

Now, a light emission of the PDP achieved by the driving method in the SUS21 to SUS23 periods will be discussed below.

In the driving method of the tenth preferred embodiment, as discussed above, a transition from a light emission of the SUS21 period to a light emission of the SUS23 period is made while maintaining the light emission of the SUS21 period by controlling the discharge during the SUS22 period in the sustain discharge period.

In this regard, if a driving circuit having two or more different sustain voltage values is used, in a period to cause the self-erase discharge, by giving a low voltage value to the sustain pulse at the initial stage to cause a relatively small self-erase discharge and gradually giving a higher voltage value in accordance with the following sustain pulse, it is possible to make a stable transition to the discharge combining the discharge mainly induced by externally-applied voltage and the discharge mainly induced by wall charges. To ensure the stable transition, however, it is necessary in general to provide a large number of sustain voltage values, and in such a case, a circuit configuration for generating the sustain pulse becomes complicate and costly.

As compared with the above general driving method, the driving method of the tenth preferred embodiment can make a stable transition from the SUS21 period for producing the first discharge (the discharge mainly induced by externally-applied voltage) to the SUS23 period for sequentially producing the first discharge and the second discharge (the discharge mainly induced by wall charges) by switching the potential Vwj of the column electrode Wj between the first potential for supply of the sustain pulse and the second potential for the idle period of the sustain pulse, as shown in FIG. 31A, as well as controlling the pulse width and the idle period of the sustain pulse in the SUS22 period which is the second period of the sustain discharge period. It can be seen from FIG. 31A that the second potential is lower than the first potential and higher than the ground potential, but considering the driving method using the pulses of reverse polarity to the driving waveforms shown in FIGS. 31A to 31C, the high-and-low relation of the first and second potentials is defined with absolute value.

The present driving method prevents the light-emission failure of cells due to the disappearance of discharge by switching the potential of the column electrode Wj, to improve and further enhance the display quality of the PDP device.

Though the potential Vwj of the column electrode Wj is switched by bringing the output end of the driving circuit 18C for the column electrode Wj into high impedance in the driving method of the tenth preferred embodiment, the switching of the potential Vwj may be achieved by applying the pulse in synchronization with the sustain pulse applied to the row electrode Xi or Yi to the column electrode Wj. It is preferable for the same reason, however, to adopt the driving method in the SUS22 period of the tenth preferred embodiment.

The Eleventh Preferred Embodiment

A method of driving the surface-discharge type AC-PDP of the ninth preferred embodiment has a characteristic feature that the pulse in synchronization with (on the same rise timing and the same fall timing as) the sustain pulse (whose potential is desired to be higher than the pulse potential applied to the column electrode Wj after the initial stage) applied to one of the row electrodes Xi and Yi is applied also to the column electrode Wj when only the discharge mainly induced by externally-applied voltage is produced in the initial stage of the sustain discharge. That actively causes a discharge between the row electrode Xi or Yi and the column electrode Wj as well as between the row electrodes Xi and Yi to stably start the sustain discharge and remove the light-emission failure due to disappearance of the discharge in the initial stage. It is thereby possible to achieve a precise image display of the PDP (to further improve display quality). The driving method of the eleventh preferred embodiment will be discussed below in detail.

Figures 30A, 30B, 30C, 30D:
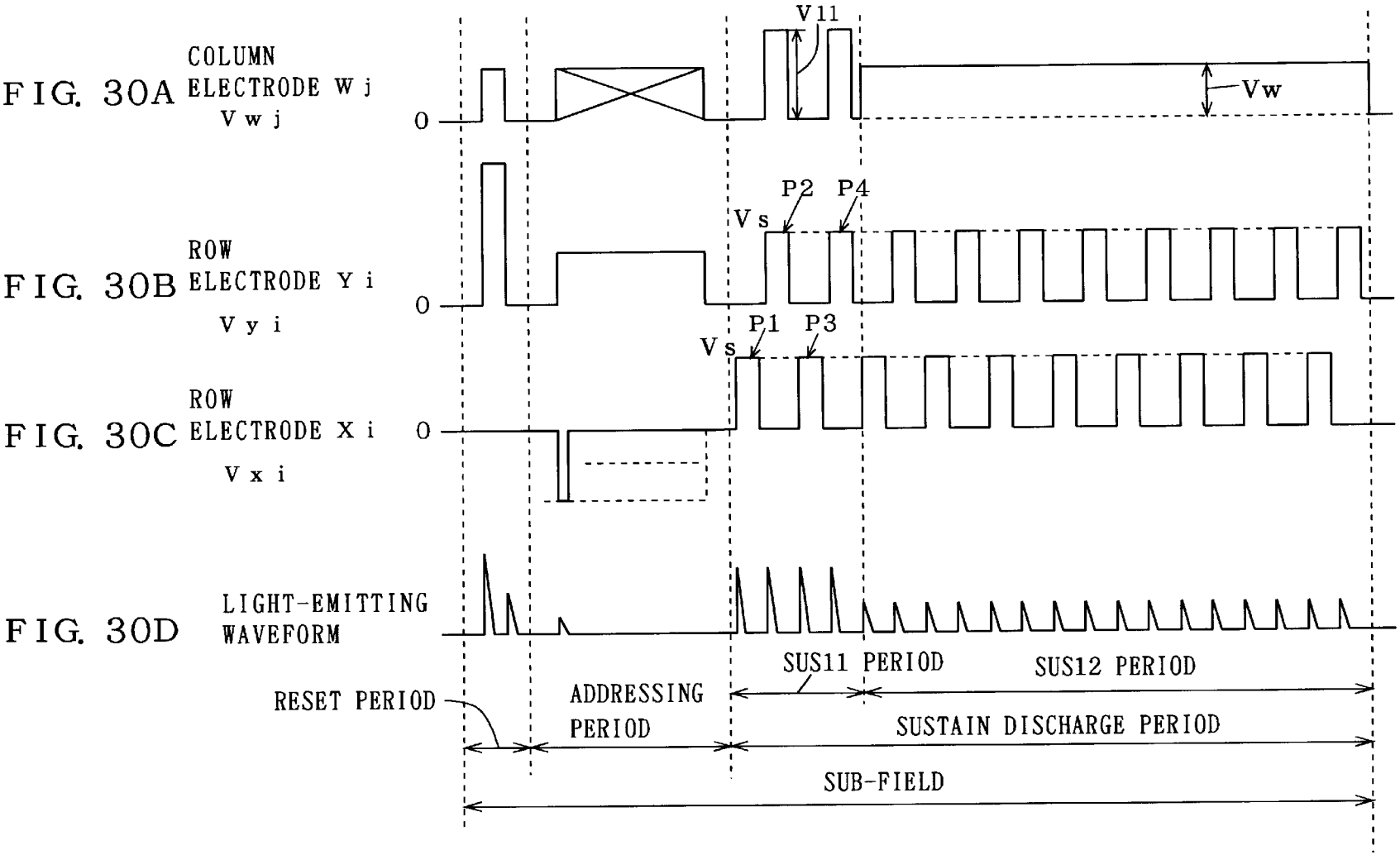
FIGS. 30A to 30D are timing charts showing driving waveforms and a light-emitting waveform of the surface-discharge type AC plasma display panel in accordance with an eleventh preferred embodiment of the present invention.

FIGS. 30A to 30D are timing charts showing driving waveforms and a light-emitting waveform of the PDP in accordance with the eleventh preferred embodiment, which show the driving waveforms in one sub-field period, like FIGS. 27A to 27D. FIGS. 30A to 30C show the waveforms of voltages applied to the column electrode Wj, the row electrode Yi and the row electrode Xi, respectively, and FIG. 30D shows the light-emitting waveform of a cell positioned at a matrix (i, j). Since the method of driving the PDP device of the eleventh preferred embodiment has a characteristic feature in a driving method in the sustain discharge period shown in FIGS. 30A to 30D, the PDP device driven by the present driving method is the same as the PDP device 50C of FIG. 26. Further, the reset period and the addressing period of FIGS. 30A to 30D are the same as those of the ninth preferred embodiment (see FIGS. 27A to 27C), in other words, those of the prior-art driving method (see FIGS. 33A to 33D). For this reason, no discussion will be made on the PDP device and the reset and addressing periods of the present driving method.

In the driving method of the eleventh preferred embodiment, as shown in FIGS. 30A to 30C, the sustain discharge period is divided into an SUS11 period and an SUS12 period.

Though the PDP device 50C is driven mainly with positive pulses as shown in FIGS. 30A to 30C in the eleventh preferred embodiment, it may be naturally driven by pulses of reverse polarity.

(SUS11 Period)

Figures 33A, 33B, 33C, 33D, 33E:
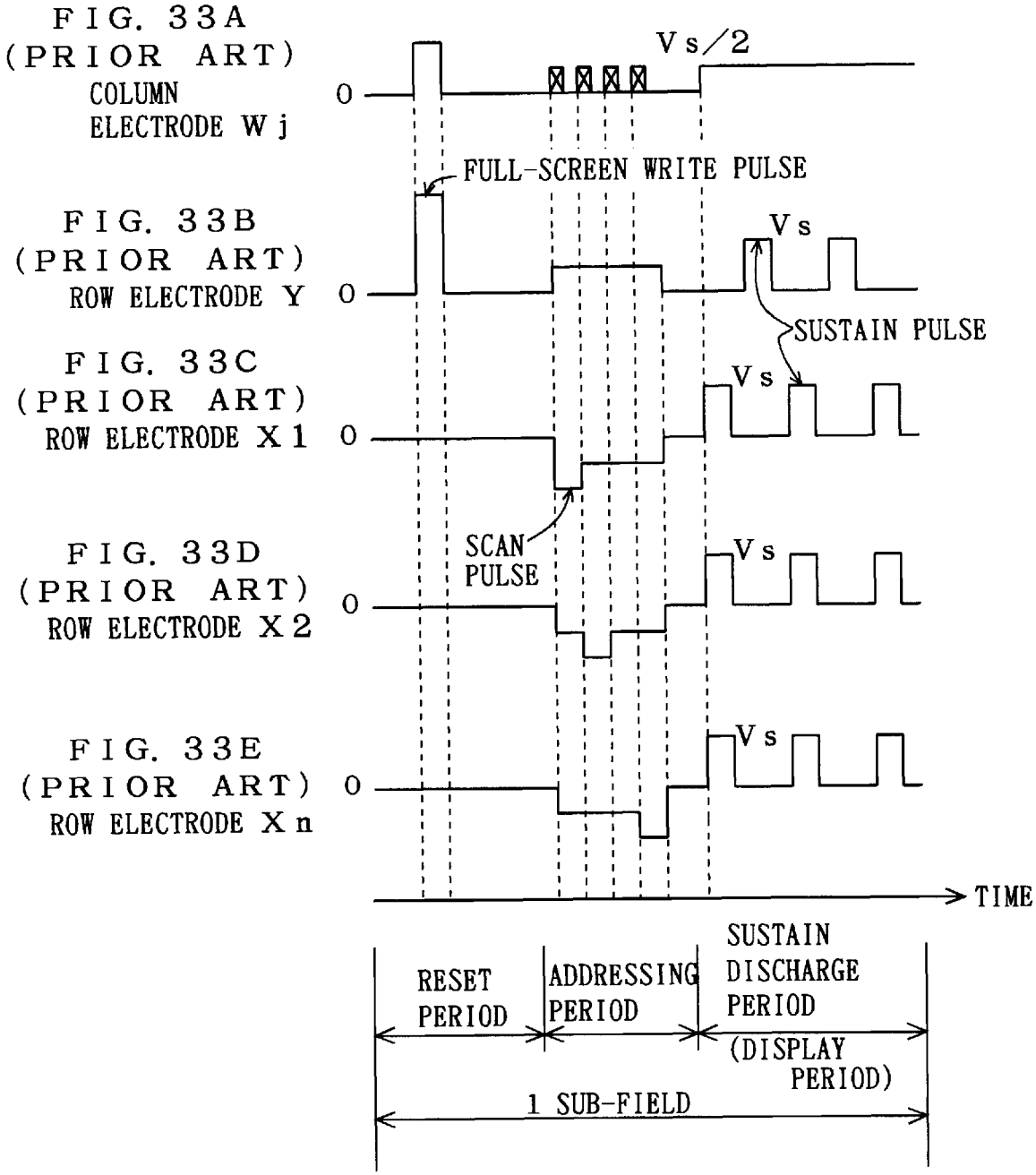
FIG. 33A (PRIOR ART)
FIG. 33B (PRIOR ART)
FIG. 33C (PRIOR ART)
FIG. 33D (PRIOR ART)
FIG. 33E (PRIOR ART)
FIGS. 33A to 33E are timing charts showing driving waveforms of surface-discharge type AC plasma display panel in the prior art.

For example, as shown in FIG. 33A, in the prior-art driving method, since a positive pulse is applied to the potential Vwj during the addressing period, negative charges are stacked above the column electrode Wj at the ending point of the addressing period. In this regard, the same applies to the present driving method of FIG. 30A. In this case, with the potential Vwj=0 V (ground potential) set in the sustain discharge period, when the first sustain pulse P1 of the sustain discharge period is applied to the row electrode Xi as shown in FIG. 30C, a discharge starts due to the potential of the wall charges on both sides of the column electrode Wj and the row electrode Xi before the sustain discharge is established between the row electrodes Xi and Yi as discussed earlier. In the prior art ①, to avoid this situation, the potential of each column electrodes Wj is set to the intermediate potential Vs/2 of the sustain pulse voltage as shown in FIG. 33A.

Conversely, in the present driving method, the potential Vwj of the column electrode Wj is controlled so that the discharge is actively produced between the column electrode Wj and the row electrode Xi or Yi with respect to the charge distribution condition at the ending point of the immediately-preceding addressing period in the SUS11 period which is a first period at the initial stage of the sustain discharge period. In other words, as shown FIG. 30A, the pulse to be applied to the column electrode Wj is controlled to be in synchronization with the sustain pulse Vyi to be applied to the row electrode Yi. Specifically, the potential Vwj is set to 0 V (ground potential) when the first and third sustain pulses P1 and P3 are applied and the potential Vwj is set to V11 (>Vw) when the second and fourth sustain pulses P2 and P4 are applied. Opposite to the above, there can be a case where the pulse to be applied to the column electrode Wj is controlled to be in synchronization with the sustain pulse to be applied to the row electrode Xi. Further, when a negative pulse is applied to the potential Vwj of the column electrode Wj, instead of the ground potential, a stronger discharge can be produced.

By giving the above-discussed pulse to the column electrode Wj, a discharge caused by the negative wall charges above the column electrode Wj occurs as well as the discharge between the row electrodes Xi and Yi when the first sustain pulse P1 is applied during the SUS11 period. When the supply of the first sustain pulse P1 is completed, positive wall charges are stacked above the column electrode Wj. Subsequently, when the second pulse P2 is applied, since the pulse voltage V11 applied to the column electrode Wj is superposed on the potential of the positive wall charges, it is possible to more actively produce the discharge between the column electrode Wj and the row electrode Xi or Yi. At this time, in the present driving method, since the discharge mainly induced by externally-applied voltage is caused by actively using the wall charges above the column electrode Wj, it is desirable that a value of the pulse voltage V11 should be set higher than the intermediate potential Vs/2 of the sustain pulse voltage.

Thus, the driving method in the SUS11 period can stably start the sustain discharge as compared with the prior-art driving method.

(SUS12 Period)

In the SUS11 period, since the stronger discharge can be triggered, it is possible to surely generate a large amount of wall charges and space charges for short time. Therefore, in the SUS12 period (the second period) following the SUS11 period, a stable transition to the surface discharge only between the row electrodes Xi and Yi can be made by using these large amounts of wall charges and space charges and the sustain discharge can be thereafter stably kept.

The eleventh preferred embodiment shows the discharge mainly induced by externally-applied voltage in the SUS12 period, and a driving method using the discharge mainly induced by wall charges together with that mainly induced by externally-applied voltage in the SUS12 period can be performed to achieve a stable discharge since a large amount of wall charges and space charges are generated in the SUS11 period.

As discussed above, since the discharge between the column electrode Wj and the row electrode Xi or Yi is actively produced in the SUS11 period, the phosphor layer 9C (see FIG. 28C) is exposed to the discharge, and the discharge during the SUS11 period may cause deterioration of the phosphor layer 9C. To avoid this situation, the present driving method reduces the discharge between the column electrode Wj and the row electrode Xi or Yi by (i) quickly setting the potential Vwj of the column electrode Wj to a constant voltage (including the ground voltage, preferably Vwj=Vs/2) or (ii) quickly bringing the output end of the driving circuit 18C for the column electrode Wj (see FIG. 26) into high impedance, after the discharge stably starts and a large amount of wall charges and space charges are generated in the SUS11 period.

In this case, when a pulse having the pulse voltage V11 of FIG. 30A is applied to the column electrode Wj during the SUS11 period, determining the SUS11 period to have two to three pulse-cycles in which the space charges generated by the discharge are saturated, it is possible to surely generate the space charges sufficient for the transition to the SUS12 period during the SUS11 period. Therefore, even if the discharge is thereafter reduced to only the surface discharge between the row electrodes Xi and Yi like the SUS12 period, the discharge is hard to intermit. Further, for the same reason, a driving method using the discharge mainly induced by wall charges together with that mainly induced by externally-applied voltage can be performed.

(Light Emission during Sustain Discharge Period)

In the SUS11 period at the initial stage of the sustain discharge period, the method of driving the PDP of the eleventh preferred embodiment can prevent the disappearance of discharge and the like and stably start the light emission of the PDP since the discharge is controlled in detail by applying a predetermined pulse to the column electrode Wj (the third electrode), in other words, by switching the potential Vwj of the column electrode Wj between the ground potential and the first voltage V11 which is predetermined.

After that, a stable sustain discharge, in other words, stable light emission of the PDP can be achieved by making a transition to the surface discharge between the row electrodes Xi and Yi in the SUS12 period. At this time, the potential Vwj of the column electrode Wj is set to the second potential which is lower than the predetermined first voltage V11. The second potential is a constant potential including the ground potential (preferably Vwj=Vs/2), or a potential which follows the variation of the potential Vxi or Vyi of the row electrode Xi or Yi.

Thus, the present driving method can achieve an improvement and further enhancement in display quality of the PDP through stabilizing the light emission of the PDP during the sustain discharge period.

Further, in the driving method of the eleventh preferred embodiment, a pulse in synchronization with the sustain pulse applied to the row electrode Xi or Yi can be applied to the column electrode Wj, instead of bringing the output end of the driving circuit 18C for the column electrode Wj into high impedance. For the same reason, it is preferable to bring the output end of the driving circuit 18C for the column electrode Wj into high impedance.

While the invention has been shown and described in detail, the foregoing description is in all aspects illustrative and not restrictive. It is therefore understood that numerous modifications and variations can be devised without departing from the scope of the invention.

We claim:

1. A method of driving a plasma display panel which comprises first and second electrodes both covered with dielectric and a third electrode provided in a direction to cross at least one of said first and second electrodes in a cell, a sustain discharge comprising a first discharge and a second discharge, said first discharge being mainly induced by externally-applied voltage which occurs on a rise of a sustain pulse, said second discharge being mainly induced by wall charges generated by said first discharge which occurs on a fall of said sustain pulse, said sustain discharge being performed a specified number of times between said first and second electrodes to obtain a predetermined luminance, said second discharge in said sustain discharge utilizing charged particles generated by said first discharge in a discharge space, and said sustain pulse falling within a period of time in which an effect of lowering discharge firing voltage obtained by said charged particles is present, thereby generating said second discharge.

2. The method of claim 1, wherein said sustain discharge utilizes a memory effect of said charged particles.

3. The method of claim 1, wherein a sustain discharge pulse has a pulse width of 1.6 $\mu$sec or less.

4. The method of claim 1, wherein an idle period between pulses to obtain said first discharge in said sustain discharge is 0.8 $\mu$sec or more.

5. The method of claim 1, wherein a fall of pulse in said sustain discharge is 300 nsec or less.

6. The method of claim 1, wherein an assistant pulse is applied in a direction to actively utilize said second discharge up to a value at which a polarity of residual wall charges is not reversed at the end of said second discharge.

7. The method of claim 6, wherein said assistant pulse is generated negatively to a ground potential on a fall of said sustain pulse.

8. The method of claim 6, wherein said assistant pulse is generated positively to the ground potential on a fall of said sustain pulse.

9. The method of claim 1, wherein a group of pulses causing a first assistant discharge is applied in a form not to induce said second discharge between an addressing discharge to select a predetermined cell and said sustain discharge, and said group of pulses causing said first assistant discharge each have an idle period narrower than that of a group of pulses for said sustain discharge.

10. A method of driving a plasma display panel according to claim 1, wherein said first discharge in said sustain discharge utilizes charged particles generated by a second discharge in said discharge space in a preceding sustain discharge, and said sustain pulse rising within a period of time in which an effect of lowering discharge firing voltage obtained by said charged particles is present, thereby generating said first discharge.

* * * * *